US011629890B1

(12) United States Patent
Vaisman et al.

(10) Patent No.: US 11,629,890 B1
(45) Date of Patent: Apr. 18, 2023

(54) THERMAL MANAGEMENT SYSTEMS

(71) Applicant: Booz Allen Hamilton Inc., McLean, VA (US)

(72) Inventors: Igor Vaisman, Carmel, IN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 124 days.

(21) Appl. No.: 17/114,785

(22) Filed: Dec. 8, 2020

Related U.S. Application Data

(60) Provisional application No. 62/949,517, filed on Dec. 18, 2019.

(51) Int. Cl.
*F25B 5/00* (2006.01)
*F25B 39/00* (2006.01)
(Continued)

(52) U.S. Cl.
CPC ..... *F25B 5/00* (2013.01); *F25B 39/00* (2013.01); *F25B 41/20* (2021.01); *F25B 41/31* (2021.01);
(Continued)

(58) Field of Classification Search
CPC .. F25B 5/00; F25B 41/31; F25B 41/20; F25B 39/00; F25B 2600/05; F25B 2600/2513;
(Continued)

(56) References Cited

U.S. PATENT DOCUMENTS 6,112,532 A * 9/2000 Bakken ..... F25B 9/008 62/149
6,314,749 B1 11/2001 Van Steenburgh, Jr.
(Continued)

FOREIGN PATENT DOCUMENTS

| | | |
|---|---|---|
| JP | 2010133606 | 6/2010 |
| JP | 2013184596 | 9/2013 |
| KR | 20180070885 | 6/2018 |

OTHER PUBLICATIONS

U.S. Appl. No. 16/448,196, Vaisman et al., filed Jun. 21, 2019.
(Continued)

*Primary Examiner* — Henry T Crenshaw
*Assistant Examiner* — Kamran Tavakoldavani
(74) *Attorney, Agent, or Firm* — Fish & Richardson P.C.

(57) ABSTRACT

Thermal management systems are described. These systems include a refrigerant receiver configured to store a refrigerant fluid, an evaporator, a closed-circuit refrigeration system having a closed fluid circuit path, with the refrigerant receiver and evaporator disposed in the closed fluid circuit path, and the closed fluid circuit path including a condenser and compressor. These systems also include a modulation capacity control circuit configured to selectively divert refrigerant vapor flow to the condenser from the compressor by diverting a portion of refrigerant vapor flow (diverted flow) from the compressor to the refrigerant receiver in accordance with cooling capacity demand. These systems also include an open-circuit refrigeration system having an open fluid circuit path with the refrigerant receiver and the evaporator, and an exhaust line that discharges the refrigerant fluid from the exhaust line so that the discharged refrigerant fluid is not returned to the open-circuit and the closed-circuit refrigerant fluid flow paths.

39 Claims, 40 Drawing Sheets

(51) Int. Cl.
*F25B 41/20* (2021.01)
*F25B 41/31* (2021.01)

(52) U.S. Cl.
CPC ... *F25B 2600/05* (2013.01); *F25B 2600/2513* (2013.01); *F25B 2700/21175* (2013.01)

(58) Field of Classification Search
CPC .... F25B 2700/21175; F25B 2400/0403; F25B 2400/0409
See application file for complete search history.

(56) References Cited

U.S. PATENT DOCUMENTS

| | | | | |
|---|---|---|---|---|
| 6,573,409 | B1 | 6/2003 | Ebner et al. | |
| 9,989,074 | B2 | 6/2018 | Nishijima et al. | |
| 10,126,022 | B1 * | 11/2018 | Cooper | F25B 5/04 |
| 10,739,052 | B2 | 8/2020 | Mahmoud et al. | |
| 10,746,440 | B2 | 8/2020 | Donovan et al. | |
| 2004/0255610 | A1 | 12/2004 | Nishijima et al. | |
| 2004/0261451 | A1 | 12/2004 | Erler et al. | |
| 2005/0081545 | A1 | 4/2005 | Gist et al. | |
| 2006/0254308 | A1 | 11/2006 | Yokoyama et al. | |
| 2008/0041079 | A1 | 2/2008 | Nishijima et al. | |
| 2013/0000348 | A1 | 1/2013 | Higashiiue et al. | |
| 2013/0251505 | A1 | 9/2013 | Wang et al. | |
| 2014/0331699 | A1 | 11/2014 | Higashiiue | |
| 2016/0010898 | A1 * | 1/2016 | Takeuchi | F25B 5/02 62/498 |
| 2016/0298899 | A1 | 10/2016 | James | |
| 2017/0219253 | A1 * | 8/2017 | Vaisman | F25B 1/10 |
| 2018/0328638 | A1 | 11/2018 | Mahmoud et al. | |
| 2021/0095901 | A1 | 4/2021 | Perez-Blanco | |

OTHER PUBLICATIONS

U.S. Appl. No. 17/020,913, May 6, 2021, Davis.
U.S. Appl. No. 16/666,851, Davis et al., filed Oct. 29, 2019.
U.S. Appl. No. 16/666,940, Vaisman et al., filed Oct. 29, 2019.
U.S. Appl. No. 16/666,966, Vaisman et al., filed Oct. 29, 2019.
U.S. Appl. No. 16/807,340, Vaisman et al., filed Mar. 3, 2020.
U.S. Appl. No. 16/872,584, Vaisman et al., filed May 12, 2020.
U.S. Appl. No. 17/114,702, Vaisman et al., filed Dec. 8, 2020.
U.S. Appl. No. 16/448,271, Vaisman et al., filed Jun. 21, 2019.
U.S. Appl. No. 16/448,283, Vaisman et al., filed Jun. 21, 2019.
U.S. Appl. No. 16/448,332, Vaisman et al., filed Jun. 21, 2019.
U.S. Appl. No. 16/448,388, Vaisman et al., filed Jun. 21, 2019.
U.S. Appl. No. 16/666,859, Davis et al., filed Oct. 29, 2019.
U.S. Appl. No. 16/666,865, Davis et al., filed Oct. 29, 2019.
U.S. Appl. No. 16/666,881, Davis et al., filed Oct. 29, 2019.
U.S. Appl. No. 16/666,899, Davis et al., filed Oct. 29, 2019.
U.S. Appl. No. 16/666,950, Vaisman et al., filed Oct. 29, 2019.
U.S. Appl. No. 16/666,954, Vaisman et al., filed Oct. 29, 2019.
U.S. Appl. No. 16/666,959, Vaisman et al., filed Oct. 29, 2019.
U.S. Appl. No. 16/666,962, Vaisman et al., filed Oct. 29, 2019.
U.S. Appl. No. 16/666,973, Vaisman et al., filed Oct. 29, 2019.
U.S. Appl. No. 16/666,977, Vaisman et al., filed Oct. 29, 2019.
U.S. Appl. No. 16/666,986, Vaisman et al., filed Oct. 29, 2019.
U.S. Appl. No. 16/666,992, Vaisman et al., filed Oct. 29, 2019.
U.S. Appl. No. 17/394,551, Vaisman et al., filed Aug. 5, 2021.
U.S. Appl. No. 16/684,775, Peters et al., filed Nov. 15, 2019.
U.S. Appl. No. 16/666,995, Vaisman et al., filed Oct. 29, 2019.
U.S. Appl. No. 17/178,378, Vaisman et al., filed Feb. 18, 2021.
U.S. Appl. No. 16/807,353, Vaisman et al., filed Mar. 3, 2020.
U.S. Appl. No. 16/807,411, Vaisman et al., filed Mar. 3, 2020.
U.S. Appl. No. 16/807,413, Vaisman et al., filed Mar. 3, 2020.
U.S. Appl. No. 16/807,582, Vaisman et al., filed Mar. 3, 2020.
U.S. Appl. No. 17/189,430, Vaisman et al., filed Mar. 2, 2021.
U.S. Appl. No. 17/191,788, Vaisman et al., filed Mar. 4, 2021.
U.S. Appl. No. 17/231,084, Vaisman et al., filed Apr. 15, 2021.
U.S. Appl. No. 16/872,590, Vaisman et al., filed May 12, 2020.
U.S. Appl. No. 16/872,592, Vaisman et al., filed May 12, 2020.
U.S. Appl. No. 17/114,728, Vaisman et al., filed Dec. 8, 2020.
U.S. Appl. No. 17/114,748, Vaisman et al., filed Dec. 8, 2020.
U.S. Appl. No. 17/114,766, Vaisman et al., filed Dec. 8, 2020.
U.S. Appl. No. 17/178,380, Vaisman et al., filed Feb. 18, 2021.
U.S. Appl. No. 17/178,390, Vaisman et al., filed Feb. 18, 2021.
U.S. Appl. No. 17/189,407, Vaisman et al., filed Mar. 2, 2021.
U.S. Appl. No. 17/189,410, Vaisman et al., filed Mar. 2, 2021.
U.S. Appl. No. 17/189,422, Vaisman et al., filed Mar. 2, 2021.
U.S. Appl. No. 17/191,797, Vaisman et al., filed Mar. 4, 2021.
U.S. Appl. No. 17/191,826, Vaisman et al., filed Mar. 4, 2021.
U.S. Appl. No. 17/231,092, Vaisman et al., filed Apr. 15, 2021.
Nagano et al., "Ejector Type Refrigerating Cycle," English Translation of foreign reference JP2010133606A, 2010, Whole Document.
Park et al., "Waste Heat Recovery Apparatus and Controlling Method thereof," English Translation of foreign reference KR20180070885A, 2018, Whole Document.
Yamanaka et al., "Refrigerating Cycle Device for Air-Conditioning Vehicle and for Temperature-Conditioning Parts Constituting Vehicle," English Translation of foreign reference JP2013184596A, 2013, Whole Document.

* cited by examiner

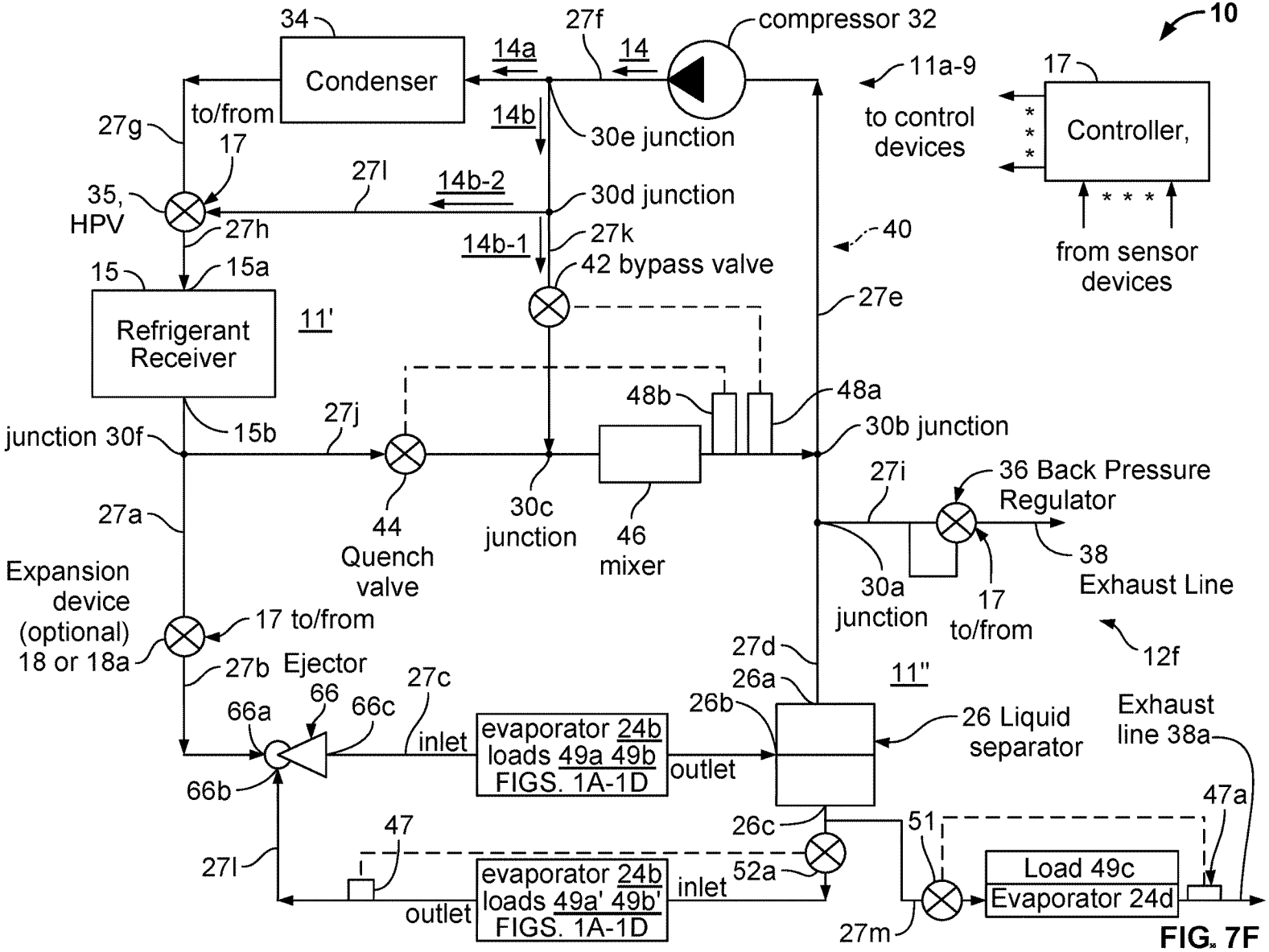
10
Controller,
17
from sensor devices
to control devices
11a-9
compressor 32
40
27e
48a
30b junction
27i
30a junction
36 Back Pressure Regulator
38 Exhaust Line
12f
Exhaust line 38a
47a
Load 49c
Evaporator 24d
FIG. 7F
26 Liquid separator
11"
51
27m
27d
26a
26b
26c
52a
outlet
inlet
evaporator 24b loads 49a 49b FIGS. 1A-1D
evaporator 24b loads 49a' 49b' FIGS. 1A-1D
47
27f
14
30e junction
30d junction
27k
42 bypass valve
48b
46 mixer
30c junction
14a
14b
14b-1
14b-2
Condenser
34
27l
11'
27j
44 Quench valve
27c
66c
Ejector 66
66a
66b
17 to/from
27b
Refrigerant Receiver
15
15a
15b
27h
35, HPV
27g
junction 30f
27a
Expansion device (optional) 18 or 18a

THERMAL MANAGEMENT SYSTEMS

CLAIM OF PRIORITY

This application claims priority under 35 USC § 119(e) to U.S. Provisional Patent Application Ser. No. 62/949,517, filed on Dec. 18, 2019, and entitled "THERMAL MANAGEMENT SYSTEMS," the entire contents of which are hereby incorporated by reference.

BACKGROUND

This disclosure relates to refrigeration.

Refrigeration systems absorb thermal energy from heat sources operating at temperatures above the temperature of the surrounding environment, discharging that absorbed thermal energy into the surrounding environment.

Conventional refrigeration systems can include a compressor, a heat rejection exchanger (i.e., a condenser), a liquid refrigerant receiver, an expansion device, and a heat absorption exchanger (i.e., an evaporator). Such systems can be used to maintain operating temperature set points for a wide variety of cooled heat sources (loads, processes, equipment, systems) thermally interacting with the evaporator.

Closed-circuit refrigeration systems may pump significant amounts of absorbed thermal energy from heat sources into the surrounding environment. In closed-circuit systems compressors are used to compress vapor from the evaporation and condensers are used to condense the vapor to cool the vapor into a liquid. The combination of condensers and compressors can add significant amount of weight and can consume relatively large amounts of electrical power. In general, the larger the amount of absorbed thermal energy that the system is designed to handle, the heavier the refrigeration system and the larger the amount of power consumed during operation, even when cooling of a heat source occurs over relatively short time periods.

SUMMARY

According to an aspect, a thermal management system includes a receiver configured to store a refrigerant fluid, the receiver having an inlet and an outlet, a condenser having an inlet and an outlet, a compressor having an inlet and an outlet, a liquid separator having an inlet, a vapor-side outlet, and a liquid-side outlet, an evaporator having an inlet and an outlet, the evaporator configurable to extract heat from a first heat load and a second heat load that are proximate to the evaporator, a closed-circuit refrigeration system having a closed-circuit fluid path including the condenser, the compressor, the receiver, the liquid separator, and the evaporator, a modulation capacity control circuit to modulate cooling capacity of the closed-circuit refrigeration system in accordance with a cooling capacity demand on the closed-circuit refrigeration system that results at least in part from extraction of the heat from the first heat load, by diverting a portion of refrigerant vapor from the outlet of the compressor away from the inlet of the condenser, an open-circuit refrigeration system having an open-circuit fluid path with the receiver and the evaporator, with the open circuit refrigeration system configured to discharge refrigerant vapor produced by extraction of the heat from the second heat load such that the discharged refrigerant vapor is not returned to the receiver, and a pump disposed in a refrigerant fluid loop with the evaporator and the liquid separator, the pump configured to pump liquid refrigerant from the liquid-side outlet of the liquid separator.

Embodiments of the thermal management systems may include any one or more of the following features or other features disclosed herein as may be specific to a particular one or more of the above aspects.

The pump has an inlet that receives refrigerant fluid from the liquid-side outlet and has an outlet that delivers the refrigerant fluid to the inlet of the evaporator. The outlet of the pump is coupled to the inlet of the evaporator.

The system further includes a junction device configured to have first and second inlets and an outlet, an expansion device having an inlet coupled to the receiver outlet and having an outlet coupled to the first inlet of the junction device. The outlet of the junction device is coupled to the inlet of the liquid separator. The modulating capacity control circuit includes a first junction device having an inlet coupled to the outlet of the compressor, a first outlet coupled to the inlet of the condenser, and a second outlet configured to output the diverted refrigerant vapor, a second junction device having an inlet that receives the diverted refrigerant vapor from the first junction device, a first outlet that outputs a first sub-portion of the diverted refrigerant vapor, and a second outlet that outputs a second sub-portion of the diverted refrigerant vapor, a head pressure valve having a first inlet coupled to the outlet of the condenser, a second inlet that receives the second sub-portion of the diverted refrigerant vapor, and an outlet coupled to the inlet to the receiver, and a bypass valve that has an inlet that receives the first sub-portion of the diverted refrigerant vapor from the second junction device, and the bypass valve further having an outlet.

The modulating capacity control circuit is further configured to selectively divert the first sub-portion of the diverted refrigerant vapor to the inlet of the bypass valve, and to selectively divert the second sub-portion of the diverted refrigerant vapor to the second inlet of the head pressure valve. The modulating capacity control circuit further includes a third junction device having an inlet that receives the first sub-portion of the diverted refrigerant vapor from the outlet of the bypass valve, a second inlet, and an outlet port, a mixer device having an inlet coupled to the outlet of the third junction device, and a quench valve having an inlet coupled to the second inlet of the third junction device.

The system further includes an expansion device having an inlet coupled to the outlet of the receiver and having an outlet.

The system further includes a fourth junction device having a first inlet, a second inlet, and an outlet, the first inlet receives refrigerant fluid from the receiver, the outlet is coupled to the inlet of the liquid separator, and the second inlet is coupled to the outlet of the evaporator, with the inlet of the evaporator coupled to the outlet of the pump. The system further includes a fourth junction device having a first inlet that receives refrigerant fluid from the receiver, a second inlet that receives refrigerant liquid from the liquid-side outlet of the liquid separator, and an outlet coupled to the inlet of the evaporator.

The evaporator is a first evaporator, the system further includes a second evaporator having an inlet and an outlet, with the inlet of the second evaporator coupled to the outlet of the pump and the outlet of the second evaporator coupled to the second inlet of the fourth junction device.

The inlet and the outlet of the evaporator are a first inlet and a first outlet, the evaporator further having a second inlet and a second outlet, with the first inlet of the evaporator coupled to the outlet of the fourth junction device, the first outlet of the evaporator coupled to the inlet of the liquid separator, the second inlet of the evaporator coupled to the outlet of the pump, and the second outlet of the evaporator coupled to the second inlet of the fourth junction device.

The system further includes a third evaporator coupled between the liquid-side outlet of the liquid separator and a second exhaust line. The system further includes an expansion device having an inlet and an outlet, with the inlet coupled to the liquid-side outlet of the liquid separator, and a sensor device disposed to sensor a thermodynamic property of refrigerant fluid at the outlet of the third evaporator and to produce a signal that controls operation of the expansion device.

The modulating capacity control circuit is further configured to selectively divert the first sub-portion of the compressed diverted refrigerant vapor to the inlet of the evaporator, and to selectively divert the second sub-portion of the compressed diverted refrigerant vapor to the second inlet of the head pressure valve.

The system further includes a third junction device having a first inlet, a second inlet and an outlet, with the first inlet coupled to the outlet of the bypass valve and the outlet coupled to the inlet to the evaporator, and a fourth junction device having a first inlet, a second inlet, and an outlet, with the first inlet configured to receive refrigerant fluid from the receiver, the second inlet configured to receive refrigerant fluid from the outlet of the pump, and with the outlet of the fourth junction device coupled to the second inlet of the third junction device.

The evaporator is a first evaporator, the system further includes a second evaporator having an inlet coupled to the outlet of the pump and having an outlet coupled to the second inlet of the fourth junction device. The inlet and the outlet of the evaporator are a first inlet and a first outlet, the evaporator further having a second inlet and a second outlet, wherein the first inlet of the evaporator is coupled to the outlet of the third junction device, the first outlet of the evaporator is coupled to the inlet of the liquid separator, the second inlet of the evaporator is coupled to the outlet of the pump, and the second outlet of the evaporator is coupled to the second inlet of the fourth junction device.

The system further includes a third evaporator coupled between the liquid-side outlet of the liquid separator and a second exhaust line. The system further includes an expansion device having an inlet coupled to the liquid-side outlet of the liquid separator and having an outlet coupled to the inlet of the third evaporator, and a sensor device disposed to sensor a thermodynamic property of refrigerant fluid at the outlet of the third evaporator and to produce a control signal to control operation of the expansion device.

The refrigerant fluid is ammonia.

The system further includes a control device coupled between an outlet of the receiver and the inlet of the evaporator, with the control device further configured to control a vapor quality of the refrigerant fluid at the outlet of the evaporator during operation of the open-circuit refrigeration system. One or more control signals cause the system to operate both the closed-circuit refrigeration system and the open-circuit refrigeration system.

The system further includes a junction device having an inlet, a first outlet, and a second outlet, with the inlet coupled to the vapor side outlet of the liquid separator and the first outlet coupled to the compressor inlet, and a regulator device having an inlet and an outlet, with the inlet coupled to the second outlet of the junction device, and the outlet coupled to the exhaust line, with the regulator device configured to regulate pressure at the regulator device inlet and to exhaust refrigerant vapor at the exhaust line from the system. The inlet of the liquid separator receives a mixed refrigerant fluid flow of refrigerant vapor and refrigerant liquid from the outlet of the evaporator.

The open-circuit refrigeration system, further includes an exhaust line. The regulator device is a back-pressure regulator, and the receiver, the evaporator, the liquid separator, the back-pressure regulator and the exhaust line are coupled in the open-circuit fluid path. The system further includes an expansion device having an inlet coupled to the receiver outlet and having an outlet coupled to the first inlet of the junction device, and wherein the expansion device is configurable to control a vapor quality of the refrigerant fluid at the outlet of the evaporator during operation of the open-circuit refrigeration system. The system further includes a controller configured to control operation of the closed-circuit refrigeration system and the open-circuit refrigeration system.

The second heat load is a high heat load, relative to the first heat load, which high heat load has one or more characteristics of being a high heat flux load or a highly temperature sensitive load or is operative for short periods of time, relative to one or more corresponding characteristics of the first heat load, and wherein the first heat load has cooling demand that varies over time. The first heat load has cooling demand that varies over time relative to the second heat load.

According to an additional aspect, a thermal management method includes transporting a refrigerant fluid from a receiver that stores refrigerant fluid, through a closed-circuit refrigeration system having a closed-circuit fluid path that includes the receiver, an evaporator, a pump, and a liquid separator, and upon receiving a control signal, transporting the refrigerant fluid from the receiver through an open-circuit refrigeration system that has an open-circuit fluid path with the receiver, the pump, and the liquid separator to an exhaust line, extracting heat from a first heat load and a second heat load proximate to the evaporator, modulating cooling capacity of the closed-circuit refrigeration system in accordance with a cooling capacity demand on the closed-circuit refrigeration system that results at least in part from extraction of the heat from the first heat load, and discharging a portion of the refrigerant vapor from the exhaust line so that the discharged refrigerant vapor is not returned to the refrigerant fluid flow path.

Embodiments of the thermal management systems may include any one or more of the following features or other features disclosed herein as may be specific to a particular one or more of the above aspects.

Modulating further includes selectively diverting a portion of refrigerant vapor from an outlet of a compressor away from an inlet of a condenser and to an inlet of the receiver, and maintaining by a head pressure valve, a head pressure at an outlet of the condenser. Modulating further includes receiving a first sub-portion of the diverted refrigerant vapor at an inlet of a bypass valve, and receiving condensed refrigerant from the condenser at an inlet of the head pressure valve and a second sub-portion of the diverted refrigerant vapor at a second inlet of the head pressure valve. The method further includes receiving a control signal by a back-pressure regulator that is coupled to the exhaust line to control discharge of the refrigerant vapor, such that the discharged refrigerant vapor is not returned to the receiver.

One or more of the above aspects may provide one or more of the following advantages and/or other advantages as disclosed herein.

Cooling of large loads and high heat flux loads that are also highly temperature sensitive can present a number of challenges. In conventional closed-circuit refrigeration systems (CCRS), cooling high heat flux loads typically involves circulating refrigerant fluid at a relatively high mass flow rate. However, closed-circuit system components include large compressors to compress vapor at a low pressure and condensers to remove heat from the compressed vapor at high pressure and convert to a liquid, and these components are typically heavy and consume significant power. As a result, many closed-circuit systems are not well suited for deployment in mobile platforms—such as on small vehicles or in space—where size and weight constraints may make the use of large compressors and condensers impractical. On the other hand, temperature sensitive loads such as electronic components and devices may require temperature regulation within a relatively narrow range of operating temperatures. In some cases, a thermal management system (TMS) may be specified to cool two different kinds of heat loads—high heat loads (high heat flux, highly temperature sensitive components) operative for short periods of time and low heat loads (relative to the high heat loads) operative continuously or for relatively long periods (relative to the high heat loads). However, to specify a refrigeration system for the high thermal load may result in a relatively large and heavy refrigeration system with a concomitant need for a large and heavy power system to sustain operation of the refrigeration system.

The thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components, while providing suitable temperature control during start-up and periods of transient operation.

At the same time, the disclosed thermal management systems would in general require less power than conventional closed-circuit systems for a given amount of refrigeration over specified periods of operation. Also disclosed are modulating capacity/temperature control circuits for controlling cooling of temperature varying heat loads. The modulating capacity/temperature control circuits add modulated capacity control to a closed-circuit portion of a TMS. A system with the modulating capacity control circuit can generate any cooling capacity in the capacity range of zero to full capacity of the CCRS to satisfy various heat loads in a heat load range from 0 to the full load capacity.

The details of one or more embodiments are set forth in the accompanying drawings and the description below. Other features and advantages will be apparent from the description, drawings, and claims.

DESCRIPTION OF DRAWINGS

FIGS. 7A-7F are schematic diagrams of examples of a thermal management system that includes an open-circuit/closed-circuit refrigeration system with an ejector and the modulating capacity control circuit of FIG. 1.

DETAILED DESCRIPTION

I. Introduction

Figure 1:
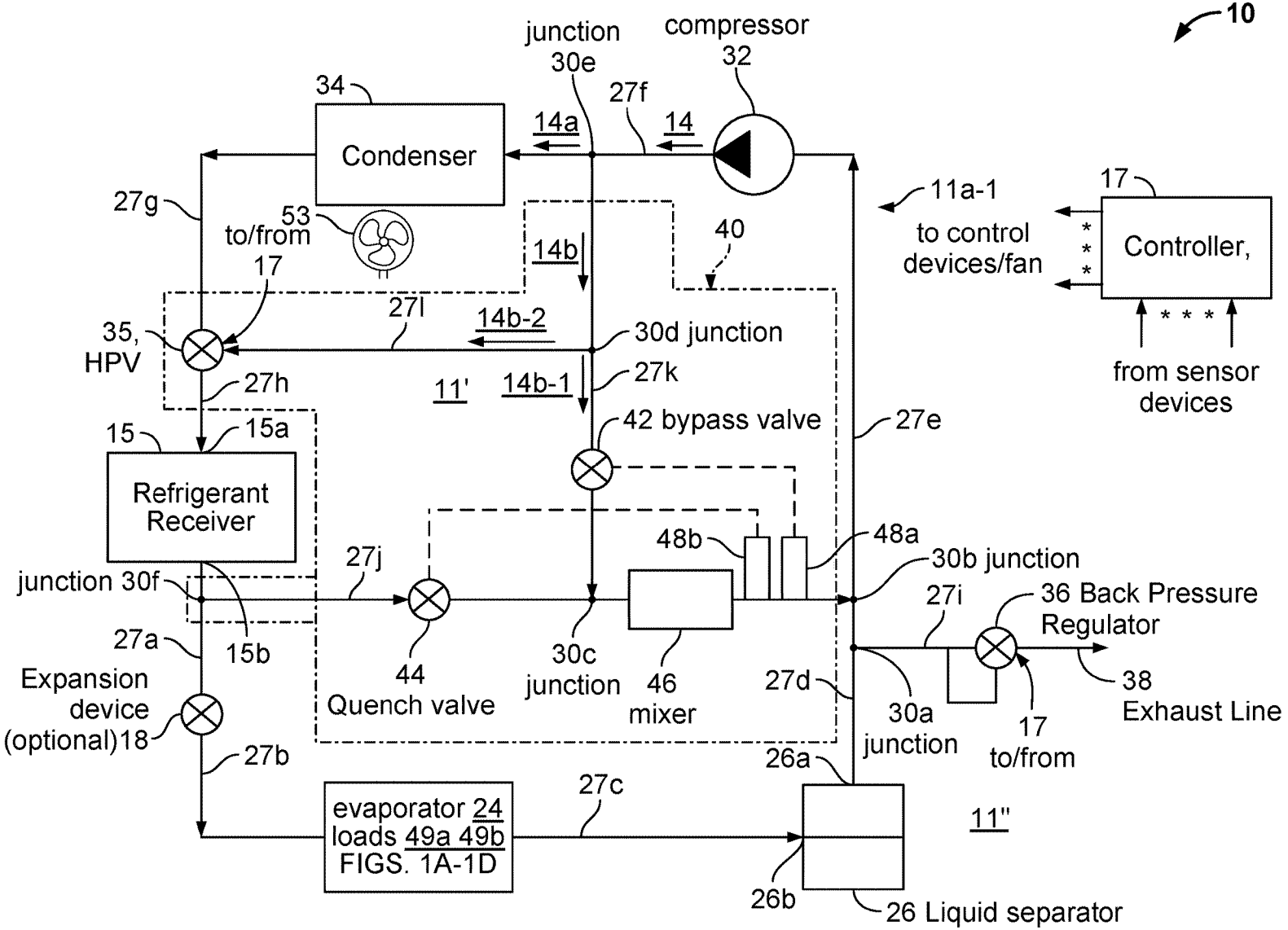
FIG. 1 is a schematic diagram of an example of a thermal management system that includes an integrated open-circuit/closed-circuit refrigeration system with a modulating capacity control circuit.

Cooling of large loads and high heat flux loads that are also highly temperature sensitive can present a number of challenges. On one hand, such loads generate significant quantities of heat that is extracted during cooling. In conventional closed-cycle refrigeration systems, cooling high heat flux loads typically involves circulating refrigerant fluid at a relatively high mass flow rate. However, closed-cycle system components that are used for refrigerant fluid circulation—including large compressors to compress vapor at a low pressure to vapor at a high pressure and condensers to remove heat from the compressed vapor at the high pressure and convert to a liquid—are typically heavy and consume significant power. As a result, many closed-cycle systems are not well suited for deployment in mobile platforms—such as on small vehicles or in space—where size and weight constraints may make the use of large compressors and condensers impractical.

On the other hand, temperature sensitive loads such as electronic components and devices may require temperature regulation within a relatively narrow range of operating temperatures. Maintaining the temperature of such a load to within a small tolerance of a temperature set point can be challenging when a single-phase refrigerant fluid is used for heat extraction, since the refrigerant fluid itself will increase in temperature as heat is absorbed from the load.

Directed energy systems that are mounted to mobile platforms such as ground (e.g., trucks), airborne (e.g., planes/jets), or marine (e.g., ships) platforms, or that exist in space, may present many of the foregoing operating challenges, as such systems may include high heat flux, temperature sensitive components that require precise cooling during operation in a relatively short time. The thermal management systems disclosed herein, while generally applicable to the cooling of a wide variety of thermal loads, are particularly well suited for operation with such directed energy systems.

In some cases, a thermal management system (TMS) may be specified to cool two different kinds of heat loads—high heat loads (high heat flux, highly temperature sensitive components) operative for short periods of time and low heat loads (relative to the high heat loads) operative continuously or for relatively long periods (relative to the high heat loads). However, to specify a refrigeration system for the high thermal load may result in a relatively large and heavy refrigeration system with a concomitant need for a large and heavy power system to sustain operation of the refrigeration system.

Such systems may not be acceptable for mobile applications. Also, start-up and/or transient processes may exceed the short period in which cooling duty is applied for the high heat loads that are operative for short periods of time. Transient operation of such systems cannot provide precise temperature control. Therefore, thermal energy storage (TES) units are integrated with small refrigeration systems and recharging of such TES units are used instead. Still, TES units may be too heavy and too large for mobile applications and/or space applications. In addition, such systems are complex devices and reliability may present problems especially for critical applications. For example, suitable temperature control may not be provided during start-up or transient periods of operation of the system.

In particular, the thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components, while providing suitable temperature control during start-up and periods of transient operation.

At the same time, the disclosed thermal management systems that use a compressor would in general require less power than conventional closed-circuitry systems for a given amount of refrigeration over specified periods of operation. Whereas certain conventional refrigeration systems used closed-circuit refrigerant flow paths, the systems and methods disclosed herein use modified closed-circuit refrigerant flow paths in combination with open-cycle refrigerant flow paths to handle a variety of heat loads. Depending upon the nature of the refrigerant fluid, exhaust refrigerant fluid may be incinerated as fuel, chemically treated, and/or simply discharged at the end of the flow path.

Discussed below are various embodiments of Open-circuit Refrigeration Systems integrated with a Closed-Circuit Refrigeration System (OCRSCCRS). Embodiments 11*a*-1 to 11*a*-18 use a first modulation control circuit 40 and embodiments 11*b*-1 to 11*b*-13 use a second modulation control circuit 40'. Each one of the OCRSCCRS 11*a*-1 to 11*a*-16 and 11*b*-1 to 11*b*-13 includes a Closed-circuit Refrigeration System (CCRS) 11' and an Open-Circuit Refrigeration System (OCRS) 11". For reasons of clarity in the illustrations, each of the first modulation control circuit 40 and the second modulation control circuit 40' are denoted by dashed lines in FIGS. 1 and 11 only, and are otherwise several of the figures being referenced by an arrow pointing to the general area of the respective modulation control circuits.

II. Thermal Management Systems with Closed-Circuit Refrigeration Systems Integrated with Open-Circuit Refrigeration Systems with Modulated Capacity Control Referring to FIG. 1, a thermal management system (TMS) 10 that includes an Closed-Circuit Refrigeration System (CCRS) 11' integrated with a Open-Circuit Refrigeration System (OCRS) 11" providing an integrated open circuit refrigeration system and closed circuit refrigeration system (OCRSCCRS) 11*a*-1 as shown. The TMS 10 provides closed-circuit refrigeration for low heat loads over long time intervals and open-circuit refrigeration for refrigeration of high heat loads over short time intervals (relative to the interval of refrigeration of low heat load).

The CCRS 11' includes a receiver 15 that stores refrigerant, an optional solenoid valve (not shown), a first control device 18 (e.g., an expansion valve device), an evaporator arrangement 24 (evaporator 24) with detailed examples shown in FIGS. 1B-1E, a liquid separator 26 having a vapor-side port 26*a* and a liquid-side port 26*b*, a junction device 30*a*, a compressor 32, a condenser 34 (or a gas cooler of a trans-critical refrigeration system), and a head pressure control valve 35 all of which are coupled via conduits 27*a*-27*h*. The solenoid valve (not shown) typically would be coupled between the receiver 15 outlet and the expansion valve device 18 inlet and can be used when the expansion valve device 18 is not configured to completely stop refrigerant flow when the system 10 is in an off state. Expansion valve device 18 is configured to cause adiabatic flash evaporation of a part of liquid refrigerant received from the receiver 15.

Throughout the application, inlet and outlet sides of the various instantiations of the evaporator 24 are denoted by legends "inlet" and "outlet." In general, fluid flow is explicitly understood from these instantiations as well as arrows appearing on conduits coupling the various components, as illustrated in the figures. Also, generally in the figures, solid lines generally depict items, e.g., conduits, which carry fluid whereas dashed lines depict control/sensor lines.

Not shown in FIG. 1, but which would be typically included, is an oil return path. The oil return path includes conduit and an oil separator (OS). In some implementations of the CCRS 11', an oil is used for lubrication of the compressor 32 and the oil travels with the refrigerant through the closed-circuit portion of the OCRSCCRS 11*a*-1. The oil is removed from the refrigerant by the OS and is recirculated back to the compressor 32. The OS can reside in communication with the inlet of the liquid separator 26, within the liquid separator 26 or elsewhere within the OCRSCCRS 11*a*-1.

Typically, the OS is installed at the compressor discharge and oil separated in the OS is returned to the compressor 32 via a loop. In systems with no OS, oil travels and accumulates in the liquid separator 26. Liquid separators can be configured to enable oil return to the compressor through the line connecting the liquid separator exit and compressor in the absence of an oil separator, but this alterative may not provide adequate oil separation and recovery as would use of an oil separator.

Figure 1A:
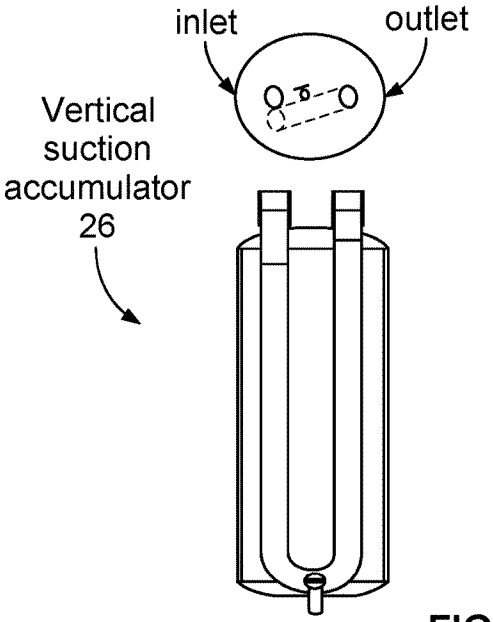
FIG. 1A is a schematic diagram of an oil separator.

FIG. 1A shows an example of oil return in a vertical suction accumulator that may operate as the liquid separator 26. Vertical accumulators use a U-tube or tube-within-a-tube configuration to draw gaseous refrigerant off the top of a vessel. At the bottom of the U-tube, an orifice picks up a small amount of oil and liquid refrigerant and meters it back with the gaseous refrigerant. The small amount of liquid refrigerant boils off in the suction line, while the oil is be carried with the gaseous refrigerant back to the compressor 32.

Referring again to FIG. 1, the OCRS 11" includes the receiver 15, the optional solenoid valve (not shown), the optional first control device 18 (i.e., expansion valve device 18), the evaporator 24, the liquid separator 26, and the junction device 30*a* coupled via the conduits 27*a*-27*e*. The OCRS 11" also includes a conduit 27*i* that is coupled to the junction device 30*a* and a second control device 36, e.g., a back-pressure regulator, that is coupled to an exhaust line 38. TMS 10 includes the OCRSCCRS 11*a*-1 to cool heat loads 49*a*, 49*b* (shown with the evaporator 24). The heat load 49*a* is a low heat load 49*a* that operates over long (or continuous) time intervals and is cooled by the CCRS 11', whereas the high heat load 49*b* is a high heat load 49*b* that operates short time intervals of time relative to the operating interval of the low heat load 49*a*.

FIGS. 1B-1E (discussed below) illustrate specific configurations for the evaporator arrangement 24 (also referred to herein as evaporator 24) and heat loads 49*a*, 49*b*. Each of these specific configurations are generally applicable to the various embodiments discussed herein.

The OCRS 11" handles cooling of the high loads during short periods and the CCRS 11' deals with continuously operating loads. However, often steady-state heat loading varies. Nevertheless, the precise control of the heat load temperatures is still required. One technique to provide precise control of the heat load temperatures includes use of a variable speed compressor and/or a variable speed condenser cooling fluid fan/pump. However, the variable speed compressor has limited speed range. The variable speed condenser cooling fluid fan/pump also has limits as well. If these controls are the only mechanisms used for capacity/temperature control, the control offered may not be sufficient.

Therefore, in FIG. 1 is a modulating capacity/temperature control circuit 40 for controlling cooling of temperature varying heat loads. The modulating capacity/temperature control circuit 40 adds modulated capacity control to the CCRS 11'. The system 10 with the modulating capacity control circuit 40 can generate any cooling capacity in the capacity range of zero to full capacity of the CCRS 11' to satisfy various heat loads in a heat load range from zero to the full load capacity of the CCRS 11'.

The modulating capacity control circuit 40 includes one or more of the head pressure control valve 35, a hot gas bypass valve 42, a quench valve 44, and a mixer 46. The quench valve 44, the hot gas bypass valve 42, and the head pressure control valve 35 are available as mechanical devices with built in control capability and as electronic devices. The bypass valve 42 is coupled to an outlet of the compressor 32 via junction devices 30*d* and 30*e*. The bypass valve 42 is controlled or responsive to a control signal that comes either from a sensor 48*a* (or indirectly from the sensor 48*a* via a controller 17). The quench valve 44 is coupled via conduit 27*j* between the outlet of the receiver 15 and a port of another junction device 30*c*. The quench valve 44 is controlled or responsive to a control signal that comes either from a sensor 48*b* (or indirectly from the sensor 48*b* via the controller 17). The mixer 46 is coupled to another port of the junction 30*c*, an outlet of the bypass valve 42, and a port of the junction 30*b*. Along the conduit 27*j* that couples the mixer 46 to the quench valve 44 and junctions 30*c*, 30*b* and 30*f* are disposed sensors 48*a*, 48*b*. The junction 30*d* is coupled via conduit 27*l* to an inlet to the head pressure control valve 35.

The modulating capacity control circuit 40 as described herein includes the hot gas bypass valve 42, the quench valve 44, and the head pressure control valve 35, but all of these components are not necessarily included in a given TMS system. In some implementations, there may only be the bypass valve 42 interacting with the quench valve 44 and mixer 46. In other implementations there only may be the head pressure control valve 35 interacting with the quench valve 44 and mixer 46 provided that the head pressure control valve 35 outlet is routed to the evaporator 24 inlet. Other implementations may use the head pressure control valve 35 and the quench valve 44 interacting with the mixer 46.

However, even when the system 10 has the bypass valve 42, the quench valve 44, and the head pressure control valve 35, each of the bypass valve 42, the quench valve 44, and the head pressure control valve 35 need not be ON at the same time. That is, the bypass valve 42, the quench valve 44, and the head pressure control valve 35 can used together or independently of each other.

A. Closed-Circuit Refrigeration Operation

When the low heat load 49*a* is applied, the TMS 10 is configured to have the CCRS 11' provide refrigeration to the low heat load 49*a*. In this instance, controller 17 produces signals to cause the back-pressure regulator 36 to be placed in an OFF state (i.e., closed). With the back-pressure regulator 36 closed, the CCRS 11' provides cooling duty to handle the low heat loads through the CCRS 11'.

In the closed-circuit refrigeration configuration, circulating refrigerant enters the compressor 32 as a saturated or superheated vapor and is compressed to a higher pressure at a higher temperature (a superheated vapor). This superheated vapor is at a temperature and pressure at which it can be condensed in the condenser 34 by either cooling water or cooling air (e.g., provided by a variable flow fan 53) flowing across a coil or tubes in the condenser 34. Compressed circulating refrigerant fluid (denoted by arrow 14) exits from the compressor 32 and enters junction 30*e*.

In the configuration of FIG. 1, a first portion (denoted by arrow 14*a*) of the compressed circulating refrigerant 14, via junction 30*e*, is fed to the condenser 34 and a second portion (denoted by arrow 14*b*) of the compressed circulating refrigerant 14 is fed to the modulating capacity control circuit 40.

At the condenser 34, the first portion 14*a* of the circulating refrigerant loses heat and thus removes heat from the system 10, which removed heat is carried away by either the water or air (whichever may be the case) flowing over the coil or tubes, providing a condensed liquid refrigerant. The first portion 14*a* of the circulating refrigerant is routed into the refrigerant receiver 15 through receiver inlet 15*a*, exits the refrigerant receiver 15 through receiver outlet 15*b*, and enters the control device, e.g., the expansion valve device 18 (through the optional solenoid valve, if used.) The refrigerant is enthalpically expanded in the expansion valve device 18 and the high pressure sub-cooled liquid refrigerant turns into liquid-vapor mixture at a low pressure and temperature. The temperature of the liquid and vapor refrigerant mixture (evaporating temperature) is lower than the temperature of the low heat load 49*a*. The mixture is routed through a coil or tubes in the evaporator 24.

The heat from the heat load 49*a*, in contact with or proximate to the evaporator 24, evaporates the liquid portion of the two-phase refrigerant mixture, and may superheat the refrigerant stream. The saturated or superheated vapor exiting the evaporator 24 passes through the liquid vapor separator 26 and enters the compressor 32. The evaporator 24 is where the circulating refrigerant absorbs and removes heat from the applied low heat load 49*a* which heat is subsequently rejected in the condenser 34 and transferred to an ambient by water or air used in the condenser 34. To complete the refrigeration cycle, the refrigerant vapor from the evaporator 24 is stored in the liquid vapor separator 26 and again a saturated vapor portion of the refrigerant in the liquid vapor separator 26 is routed back into the compressor 32.

The second portion 14*b* of the compressed circulating refrigerant is split into a first sub-portion (denoted by arrow 14*b*-1) and a second sub-portion (denoted by arrow 14*b*-2). The hot gas bypass valve 42 receives the first compressed circulating refrigerant sub-portion 14*b*-1 from the junction device 30*d*, bypassing the condenser 34, the receiver 15, the expansion device 18, and the evaporator 24, and directs the compressed circulating refrigerant sub-portion 14*b*-1 into the junction 30*c*. This first compressed circulating refrigerant sub-portion 14*b*-1 is enthalpically expanded from a high pressure to a low pressure in the bypass valve 42 under control of the sensor 48*a*.

The second compressed circulating refrigerant sub-portion 14*b*-2 is directed to the head pressure valve 35 that feeds the second compressed circulating refrigerant sub-portion into the refrigerant receiver 15. The output of the refrigerant receiver 15 is coupled, via junction 30*f*, to the inlet of the quench valve 44. The quench valve 44 has an output that is coupled to the junction 30*c*. Junction 30*c* is coupled to an input to the mixer 46. An output of the mixer 46 is coupled to the junction 30*b*. The quench valve 44 directs and enthalpically expands a portion of the liquid refrigerant from the receiver 15 under control of the sensor 48*b*, bypassing the expansion valve device 18 and the evaporator 24.

As discussed above, when the OCRS 11" is off, the steady-state CCRS 11' provides temperature control of continuous loads. Thus, the hot gas bypassed, i.e., the first sub-portion 14*b*-1, and second sub-portion 14*b*-2 that is fed into the receiver 15 and is involved with the liquid flow stream from the receiver 15, both bypass the evaporator 24 to appropriately accommodate the reduced heat load. The mixer 46 operates as a mixing heat exchanger providing direct contact of the expanded vapor stream and two-phase mixture formed after the expansion of the liquid stream at the low pressure.

The hot gas bypass valve 42, as controlled by sensor 48*a*, controls a set low evaporating/suction pressure. The hot gas bypass valve 42 is actuated when the evaporating pressure is reduced below the set evaporating/suction pressure limit for example. The quench valve 44 is an expansion valve device that controls refrigerant superheat at the mixer 46 exit. Under control of the sensor 48*b*, the quench valve 44 opens a flow opening when the superheat increases and thus increases the refrigerant flow rate to recover an increase in superheat. The quench valve 44 closes the flow opening when the superheat is reduced, and thus reduces the refrigerant flow rate to recover lessened superheat. The mixer 46 mixes the vapor (first sub-portion) and two-phase mixture (expanded refrigerant liquid). The liquid portion evaporates, leaving the mixer 46 with the superheat controlled by the quench valve 44.

Condensing temperature depends on ambient temperature. When ambient temperature is low, the condensing pressure temperature is low as well. At a certain low condensing pressure, pressure difference between the condensing and evaporating pressures and compressor discharge and suction pressures become very low and unacceptable for proper operation of the compressor 34, the expansion valve device 18, and the quench valve 44. The head pressure control valve 35 therefore is provided to control the condensing pressure to be above the set low limit.

An approach for maintaining normal head pressure in the refrigeration system during periods of low ambient temperature is to restrict liquid flow from the condenser 34 in the CCRS 11' to the refrigerant receiver 15. At the same time, the modulating capacity control circuit 40 diverts hot gas to the inlet of the receiver 15. This diversion backs liquid refrigerant up into the condenser 34 reducing the condenser capacity, which in turn, increases condensing pressure. However, at the same time the hot gas raises liquid pressure in the receiver 15, allowing the system to operate normally.

The head pressure control valve 35 restricts liquid flow exiting the condenser 34 when the ambient air that is cooling the condenser 34 is very cold. As a result, liquid accumulates in the condenser 34 reducing the volume and heat transfer area for the incoming high pressure vapor that is discharged from the compressor 32. With reduced condenser volume, a condensation rate is reduced and pressure in the condenser 34 and in the compressor discharge line increases, opening the other port of the head pressure control valve 35, allowing high pressure vapor to flow into the receiver 15, which elevates refrigerant pressure in the receiver 15. Generally, low ambient temperature provides lower condensing pressure, lower pressure in the receiver 15, lower pressure at the expansion valve device 18 inlet, and lower pressure differential across the expansion valve device 18. The head pressure control valve 35 elevates pressure differential across the expansion valve device 18 to a level at which the expansion valve device 18 becomes operable. The head pressure control valve 35 may or may not be used in conjunction with the variable flow fan 53 (shown only in FIG. 1, but generally applicable to any of the embodiments discussed herein) pulling air through the condenser 34. Alternatively, in some implementations the speed at which the variable flow fan 53 pulls air through the condenser 34 can be used to control head pressure, without the need for head pressure valve 35.

B. Open/Closed-Circuit Refrigeration Operation

On the other hand, when a high heat load 49*b* is applied, a mechanism such as the controller 17 causes the OCRSC-CRS 11*a*-1 to operate in both a closed and open cycle configuration.

The CCRS 11' is similar to that described above, except that the evaporator 24 in this case operates within a threshold of a vapor quality, the liquid separator 26 receives two-phase mixture, and the compressor 32 receives saturated vapor from the liquid separator 26.

When the OCRSCCRS 11*a*-1 operates with the open cycle enabled, this causes the controller 17 to be configured to cause the second control device, e.g., the back-pressure regulator 36 to be placed in an ON position, thus opening the back-pressure regulator 36 to permit the back-pressure regulator 36 to exhaust vapor through the exhaust line 38. The back-pressure regulator 36 maintains a back pressure at an inlet to the back-pressure regulator 36, according to a set point pressure, while allowing the back-pressure regulator 36 to exhaust refrigerant vapor through the exhaust line 38. Also, the controller 17 switches the hot gas bypass valve 42 and quench valve 44 OFF to enable maximal refrigerant flow rate from the compressor 32 suction to the receiver 15 and minimal amount of refrigerant exhausted from the TMS 10. Exhausted refrigerant vapor is not returned to the refrigerant flow or the refrigerant receiver 15.

The OCRSCCRS 11*a*-1 operates like a thermal energy storage (TES) system, increasing cooling capacity of the TMS 10 when a pulsing heat load is activated, but without a duty cycle cooling penalty commonly encountered with TES systems. The TMS 10 may operate at certain cooling duty as well. One of the advantages of the OCRS approach over a conventional TES is that the conventional TES is an intermediate device in heat transfer between the cooling source and the object to be cooled. The conventional TES must be colder than the fluid communicating between the TES and the object being cooled. The refrigerant of the system cooling TES must be colder than the TES.

On the other hand, the OCRS 11" provides direct cooling and the refrigerant does not need to be cooled as low as in a TMS employing a TES system. Moreover, latent heat of the refrigerant is much larger than the latent heat of the TES phase change material. Poor thermal conductivity of the phase change material in TES is an issue, especially, when the phase change material starts melting. The OCRS solution does not have communication hardware between the object to be cooled and the TES and between the cooling system and the TES. Therefore, the OCRS approach is more effective and lighter than the TES approach.

The cooling duty is executed without the concomitant penalty of conventional TES systems provided that the receiver 15 has enough refrigerant charge and the refrigerant flow rate flowing through the evaporator 24 matches the rate needed by the high load 49*b*. The back-pressure regulator 36 exhausts the refrigerant vapor less the refrigerant vapor recirculated by the compressor 32. The rate of exhaust of the refrigerant vapor through the exhaust line 38 is governed by the ratio of the mass flow rate pumped by the compressor and the mass flow rate demand required by the related heat loads.

When the high load 49*b* is no longer in use or its temperature is reduced, this occurrence is sensed by a sensor (not shown) and a signal from the sensor (or otherwise, such as communicated directly by the high heat load) is sent to the controller 17. The controller 17 is configured to partially or completely close the back-pressure regulator 36 by changing the set point pressure (or otherwise), partially or totally closing the exhaust line 38 to reduce or cut off exhaust refrigerant flow through the exhaust line 38. When the high load reaches a desired temperature or is no longer being used, the back-pressure regulator 36 is placed in the OFF status and is thus closed, and CCRS 11' continues to operate as needed.

CCRS 11' helps to reduce amount of exhausted refrigerant. Generally, the system 10 uses the compressor 32 to save ammonia, and it would not be desired to shut compressor off. Also, the compressor 32 can help to keep a high pressure in the refrigerant receiver 15 if a head pressure control valve is applied.

On the other hand, in some embodiments, the TMS 10 could be configured to operate in modes where the compressor 32 is turned off and the TMS 10 operates in open-circuit mode only (such as in fault conditions in the circuit or cooling requirements).

The OCRSCCRS 11*a*-1 would generally also include the controller 17 (see FIG. 17 for an exemplary embodiment) that produces control signals (based on sensed thermodynamic properties) to control operation of the various devices 18, etc., as needed, as well as the compressor 32 and back-pressure regulator 36. Controller 17 may receive signals, process received signals and send signals (as appropriate) from/to the expansion valve device 18, the optional solenoid valve, the back-pressure regulator 36, and a motor of the compressor 32 changing its speed, shutting compressor 32 off or starting it, etc.

As used herein, compressor 32 is, in general, a device that increases the pressure of a gas by reducing the gas' volume. Usually the term compressor refers to devices operating at and above ambient pressure, (some refrigerant compressors may operate inducing refrigerant at pressures below ambient pressure, e.g., desalination vapor compression systems employ compressors with suction and discharge pressures below ambient pressure).

In general, the solenoid control valve (not shown) includes a solenoid that uses an electric current to generate a magnetic field to control a mechanism to regulates an opening in a valve to control fluid flow. The control device is configurable to stop refrigerant flow as an on/off valve, if the expansion valve cannot shut off fluid flow robustly.

Expansion valve device 18 functions as a flow control device and in particular as a refrigerant expansion device. In general, expansion valve device 18 can be implemented as any one or more of a variety of different mechanical and/or electronic devices. For example, in some embodiments, expansion valve device 18 can be implemented as a fixed orifice, a capillary tube, and/or a mechanical or electronic expansion valve. In general, fixed orifices and capillary tubes are passive flow restriction elements which do not actively regulate refrigerant fluid flow.

Mechanical expansion valves (usually called thermostatic or thermal expansion valves) are typically flow control devices that enthalpically expand a refrigerant fluid from a first pressure to an evaporating pressure, controlling the superheat at the evaporator exit. Mechanical expansion valves generally include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb transfers the pressure in the bulb through the chamber to the diaphragm, and moves the diaphragm and the seat to close or to open the orifice.

Typical electrically controlled expansion valves include an orifice, a moving seat, a motor or actuator that changes the position of the seat with respect to the orifice, a controller, and pressure and temperature sensors at the evaporator exit.

Examples of suitable commercially available expansion valves that can function as expansion valve device 18 include, but are not limited to, thermostatic expansion valves available from the Sporlan Division of Parker Hannifin Corporation (Washington, Mo.) and from Danfoss (Syddanmark, Denmark).

The controller 17 calculates the superheat for the expanded refrigerant fluid based on pressure and temperature measurements at the evaporator exit. If the superheat is above a set-point value, the expansion valve seat moves to increase the cross-sectional area and the refrigerant fluid volume and mass flow rates to match the superheat set-point value. If the superheat is below the set-point value, the seat moves to decrease the cross-sectional area and the refrigerant fluid flow rates.

Referring now to FIGS. 1B-1E additional evaporator arrangements that are alternative configurations of the evaporator arrangement 24 and heat loads 49*a*, 49*b* are shown.

Figure 1B:
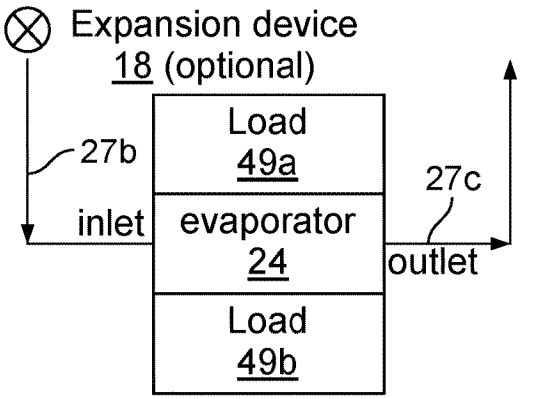
FIGS. 1B-1E are schematic diagrams showing alternative configurations for arrangement of evaporators/loads on the integrated open-circuit/closed-circuit refrigeration system, generally applicable to described embodiments.

In the configuration of FIG. 1B, both the low heat load 49*a* and the high heat load 49*b* are coupled to (or are in proximity to) a single, i.e., the same evaporator 24.

Figure 1C:
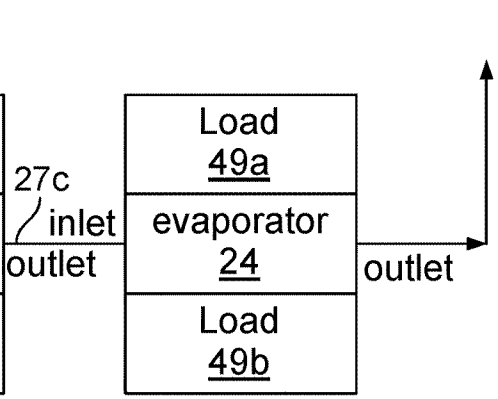

In the configuration of FIG. 1C, each of a pair of evaporators (generally 24) have the low heat load 49*a* and the high heat load 49*b* coupled or proximate thereto. In an alternative configuration of FIG. 1B, (not shown), the low heat load 49*a* would be coupled (or proximate) to a first one of the pair of evaporators (generally 24) and the high heat load 49*b* would be coupled (or proximate) to a second one of the pair of evaporators (generally 24).

Figure 1E:
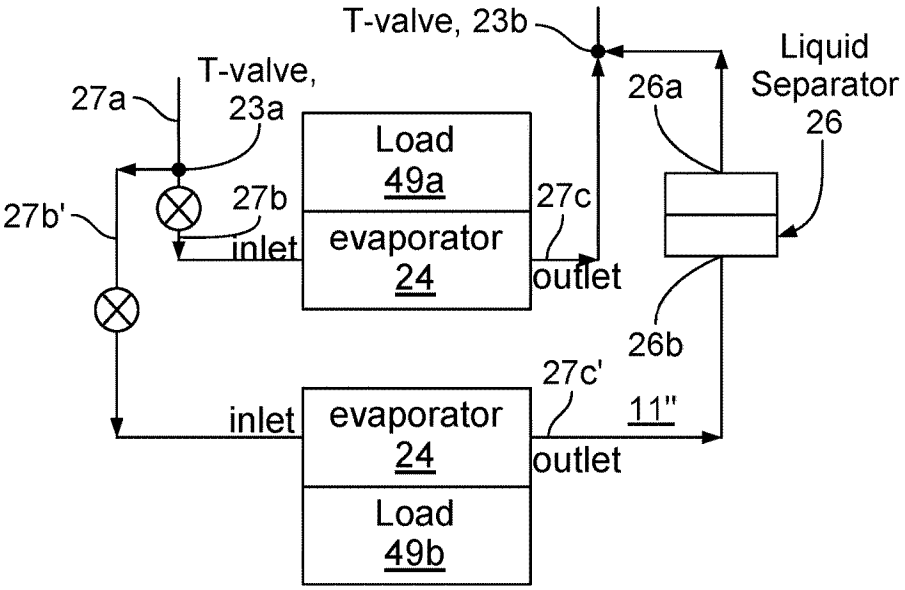
Figure 1D:
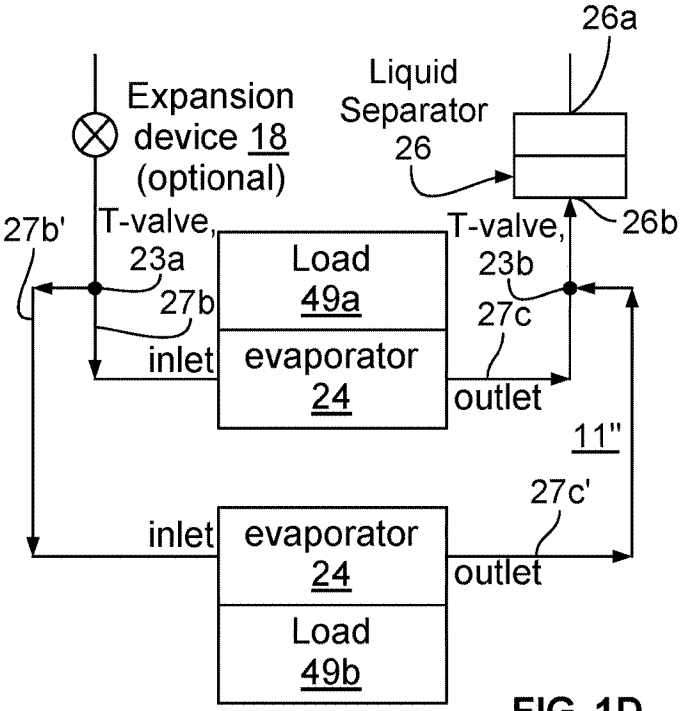

In the configurations of FIG. 1D, 1E, the low heat load 49*a* and the high heat load 49*b* are coupled to (or are in proximity to) corresponding ones of the pair of evaporators (generally 24). In the configurations of FIGS. 1D and 1E, a first T-valve 23*a* (e.g., junction either passive or active), as shown, splits refrigerant flow from the receiver 15, into two paths (conduit 27*b* and conduit 27*b*') that feed two evaporators (generally 24). One of these evaporators 24 is coupled (or proximity to) the low heat load 49*a* and the other of these evaporators 24 is coupled (or proximate to) the high heat load 49*b*. Other configurations are possible.

In the configuration of FIG. 1D, the outputs of the evaporators (generally 24) are coupled via conduit 27*c* and conduit 27*c*' to a second T-valve 23*b* (active or passive) that has an output that feeds the input 26*b* of the liquid separator 26. On the other hand, in the configuration of FIG. 1E, the outputs of the evaporators (generally 24) are coupled differently. The output of the evaporator 24 that has low heat load 49*a* feeds an inlet of the valve 23*b*, whereas the output of the evaporator 24 that has high heat load 49*b* feeds inlet 26*b* of the liquid separator 26. This arrangement in effect, removes the liquid separator 26 from the CCRS 11'. In some configurations, the T valves can be switched (meaning that they can be controlled (automatically or manually) to shut off either or both inlets) or passive meaning that they do not shut off either inlet and thus can be T junctions.

Evaporator

Figure 2B:
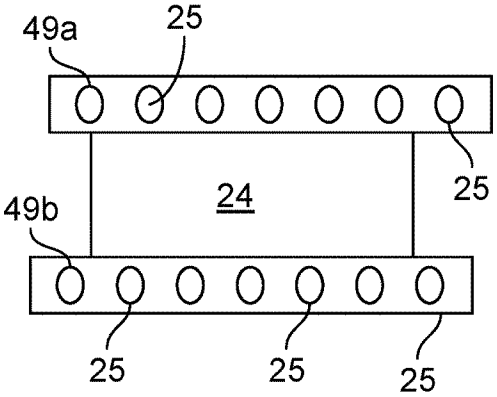
FIGS. 2A and 2B are schematic diagrams showing side and end views, respectively, of an example of the thermal load that includes refrigerant fluid channels.
Figure 2A:
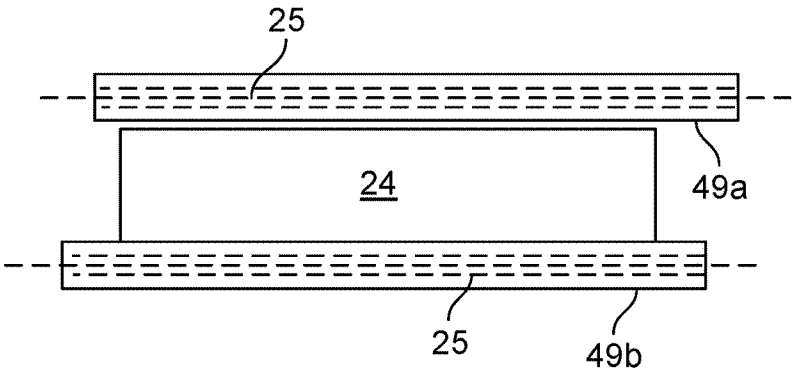

Referring to FIGS. 2A and 2B, the evaporator 24 can be implemented in a variety of ways. In general, evaporator 24 functions as a heat exchanger, providing thermal contact between the refrigerant fluid and heat load(s) 49*a*, 49*b*. Typically, evaporator 24 includes one or more flow channels extending internally between an inlet and an outlet of the evaporator 24, allowing refrigerant fluid to flow through the evaporator 24 and absorb heat from heat loads 49*a*, 49*b*.

A variety of different evaporators can be used in TMS 10. In general, any cold plate may function as the evaporator 24 of the open-circuit refrigeration systems disclosed herein. Evaporator 24 can accommodate any refrigerant fluid channels 25 (including mini/micro-channel tubes), blocks of printed circuit heat exchanging structures, or more generally, any heat exchanging structures that are used to transport single-phase or two-phase fluids. The evaporator 24 and/or components thereof, such as fluid transport channels 25, can be attached to the heat loads 49*a*, 49*b* mechanically, or can be welded, brazed, or bonded to the heat load in any manner.

In some embodiments, evaporator 24 (or certain components thereof) can be fabricated as part of heat loads 49*a*, 49*b* or otherwise integrated into one or more of the heat loads 49*a*, 49*b*, as is generally shown in FIGS. 2A and 2B, in which high heat load 49*b* has one or more integrated refrigerant fluid channels 25. The portion of high heat load 49*b* with one or more refrigerant fluid channels 25 effectively functions as the evaporator 24 for the system 10. The evaporator 24 can be implemented as plurality of evaporators connected in parallel and/or in series or as individual evaporators, as shown for evaporator 24 for high heat load 49*b* (FIG. 2B).

Figure 2C:
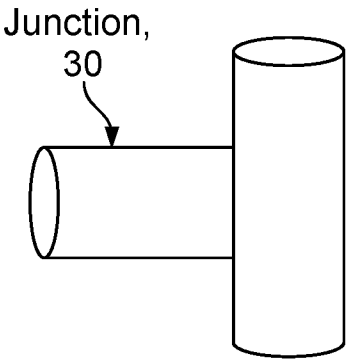
FIG. 2C is a schematic diagram of a junction device.

FIG. 2C shows the junction device 30 that is exemplary of the junction devices discussed herein as having three ports.

Receiver

Figure 3:
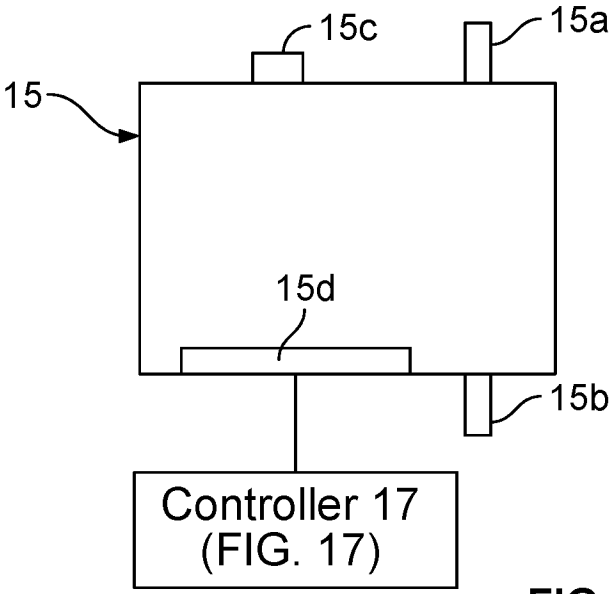
FIG. 3 is a schematic diagram of an example of a receiver for refrigerant fluid in the thermal management system.

FIG. 3 shows a schematic diagram of an example of receiver 15. Receiver 15 includes an inlet port 15*a*, an outlet port 15*b*, a pressure relief valve 15*c*, and a heater 15*d* (optional). To charge receiver 15, refrigerant fluid is typically introduced into receiver 15 via the inlet port 15*a*, and this can be done, for example, at service locations. Operating in the field the refrigerant exits receiver 15 through outlet port 15*b* that is connected to conduit 27*a* (FIG. 1). In case of emergency, if the fluid pressure within receiver 15 exceeds a pressure limit value, pressure relief valve 15*c* opens to allow a portion of the refrigerant fluid to escape through valve 15*c* to reduce the fluid pressure within receiver 15. Receiver 15 is typically implemented as an insulated vessel that stores a refrigerant fluid at relatively high pressure.

When ambient temperature is very low, and as a result, pressure in the receiver 15 is low and insufficient to drive refrigerant fluid flow through the system, a heater 15*d* can be used to control vapor pressure of the liquid refrigerant in the receiver 15. The heater 15*d* is connected via a control line to the controller 17 (further described below by FIG. 17). Heater 15*d*, which can be implemented as a resistive heating element (e.g., a strip heater) or any of a wide variety of different types of heating elements, can be activated by controller 17 to heat the refrigerant fluid within receiver 15.

Receiver 15 can also include insulation (not shown in FIG. 3) applied around the receiver to reduce thermal losses.

In general, receiver 15 can have a variety of different shapes. In some embodiments, for example, the receiver is cylindrical. Examples of other possible shapes include, but are not limited to, rectangular prismatic, cubic, and conical. In certain embodiments, receiver 15 can be oriented such that outlet port 15*b* is positioned at the bottom of the receiver. In this manner, the liquid portion of the refrigerant fluid within receiver 15 is discharged first through outlet port 15*b*, prior to discharge of refrigerant vapor. In certain embodiments, the refrigerant fluid can be an ammonia-based mixture that includes ammonia and one or more other substances. For example, mixtures can include one or more additives that facilitate ammonia absorption or ammonia burning.

While, in the OCRSCCRS 11*a*-1, the compressor 32 consumes power, the discharge pressure can be lower than the discharge pressure of an equivalent closed-circuit refrigeration system to handle both heat loads 49*a*, 49*b* and, therefore, the power consumed by the compressor 32 can be less than the power consumed by a compressor of the equivalent closed-circuit refrigerant system.

Figure 4:
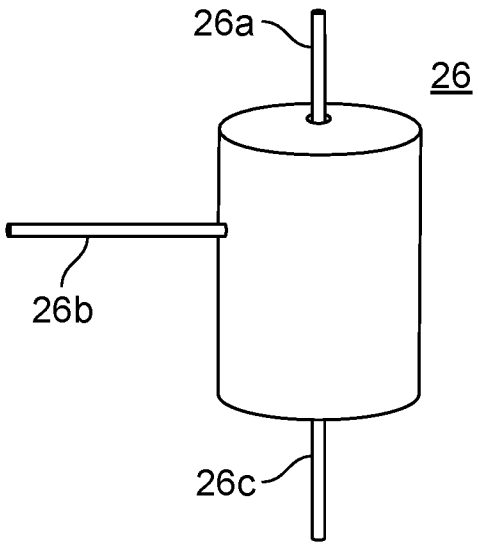
FIG. 4 is diagrammatical views of a three-port liquid separator.

FIG. 4 depicts a configuration for the liquid separator 26, (implemented as a coalescing liquid separator or a flash drum for example), which has the vapor-side port 26*a* and the liquid-side port 26*c* coupled to conduits (not referenced) and has an input port 26*b*. In FIG. 1, the liquid separator 26 is used as an accumulator with liquid-side port 26*c* tied to the input port 26*b* allowing liquid to be stored in the liquid separator 26. In other embodiments discussed below the vapor-side port 26*a* and the liquid-side port 26*c* are output ports, and the input port 26*b* is the input port to the liquid separator 26. Other conventional details such as membranes or meshes, etc. are not shown.

Described herein are several alternative types of open-circuit refrigeration system configurations that can be used with the OCRSCCRS 11*a*-1. These alternatives include an OCRSCCRS with controlled superheat (FIG. 5); an OCRSCCRS with recuperative heat exchanger (FIG. 6); ejector assisted OCRSCCRS types (FIGS. 7A-7G); and pump assisted OCRSCCRS types (FIGS. 9A-9F) all of which use the modulating capacity control circuit 40.

Also described below is another set of alternative types of open-circuit refrigeration system configurations that can be used with the OCRSCCRS. These alternatives are OCRSCCRS that use the alternative type (FIG. 11); ejector assisted OCRSCCRS type (FIGS. 12A-12F); pump assisted OCRSCCRS types (FIGS. 13A-13E); and an OCRSCCRS that uses a recuperative heat exchanger (FIG. 15), all of which use the alternative modulating capacity control circuit 40'.

Figure 5:
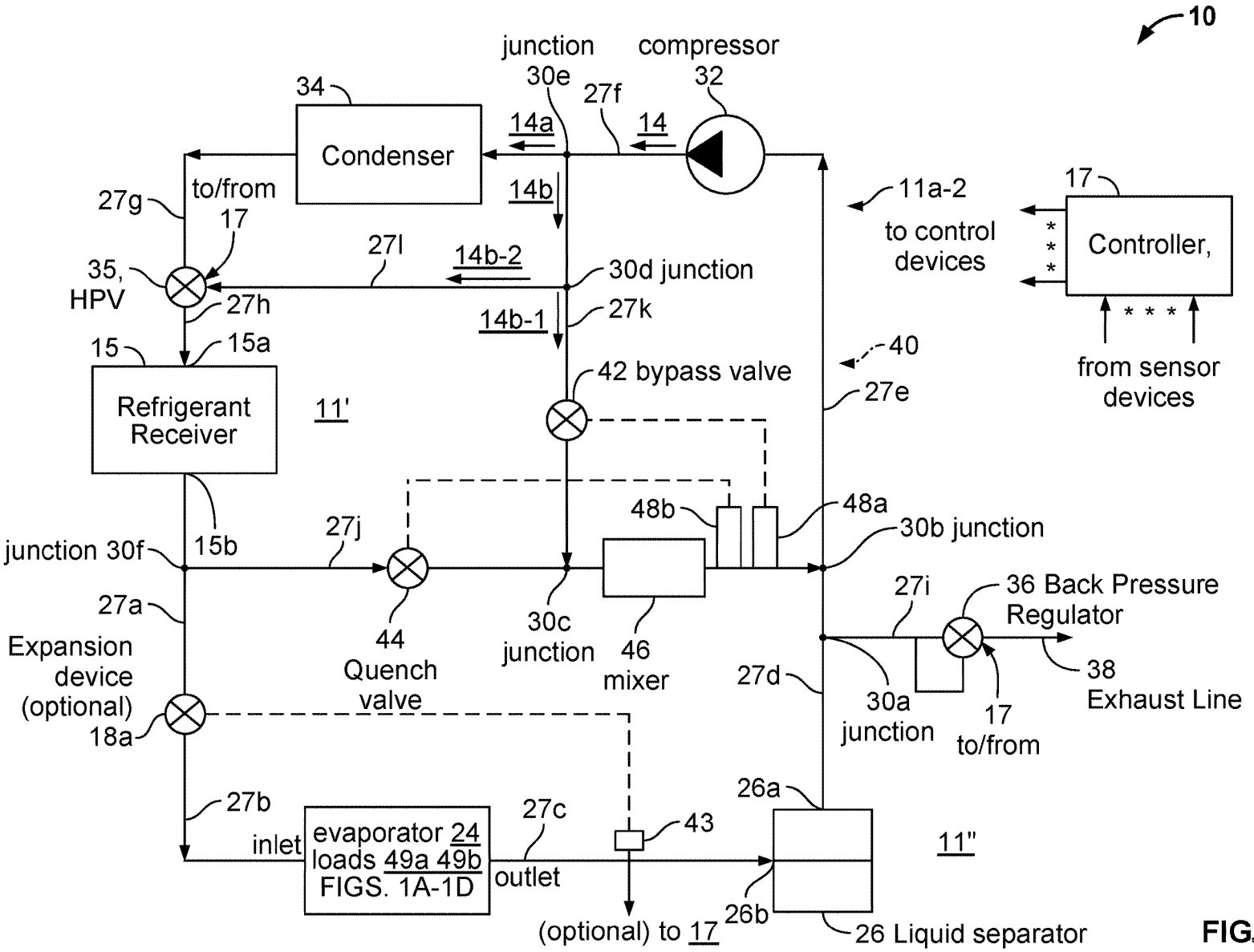
FIG. 5 is a schematic diagram of a thermal management system that includes an open-circuit/closed-circuit refrigeration system with controlled superheat, with modulating capacity control circuit of FIG. 1.
Figure 6:
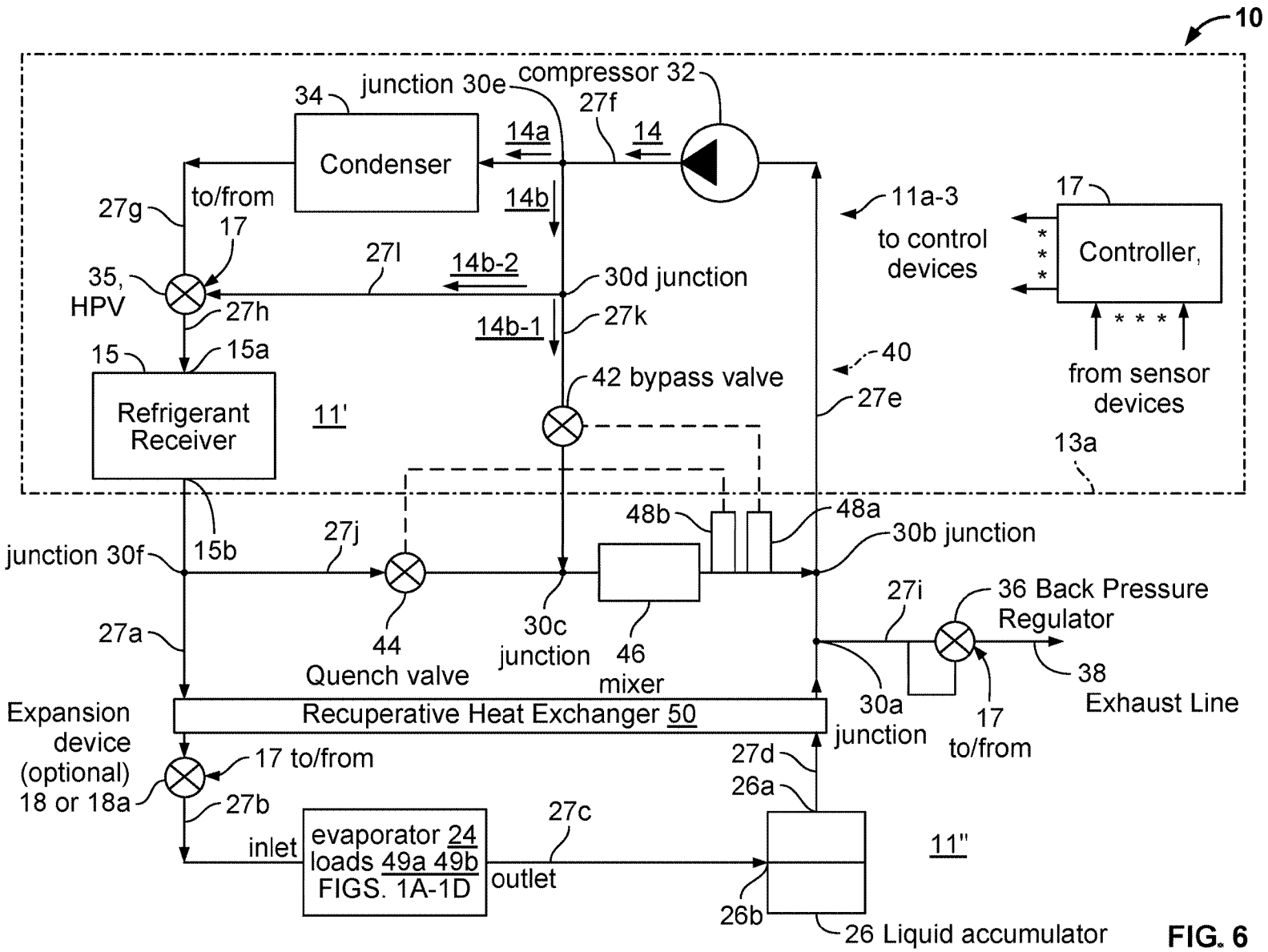
FIG. 6 is a schematic diagram of a thermal management system that includes an open-circuit/closed-circuit refrigeration system with a recuperative heat exchanger, with modulating capacity control circuit of FIG. 1.

FIGS. 5, 6; 7A-7G; and 9A-9F show alternative configurations 11*a*-2 to 11*a*-16 for the OCRS 11" using the modulating capacity control circuit 40, whereas FIGS. 11, 12A-12F and 13A-13E show alternative open-circuit refrigeration system 11" configurations 11*b*-1 to 11*b*-12 using a modulating capacity control circuit 40'. Items illustrated and referenced, but not mentioned in the discussion below are discussed and referenced in FIG. 1 and/or FIG. 11.

Figure 15:
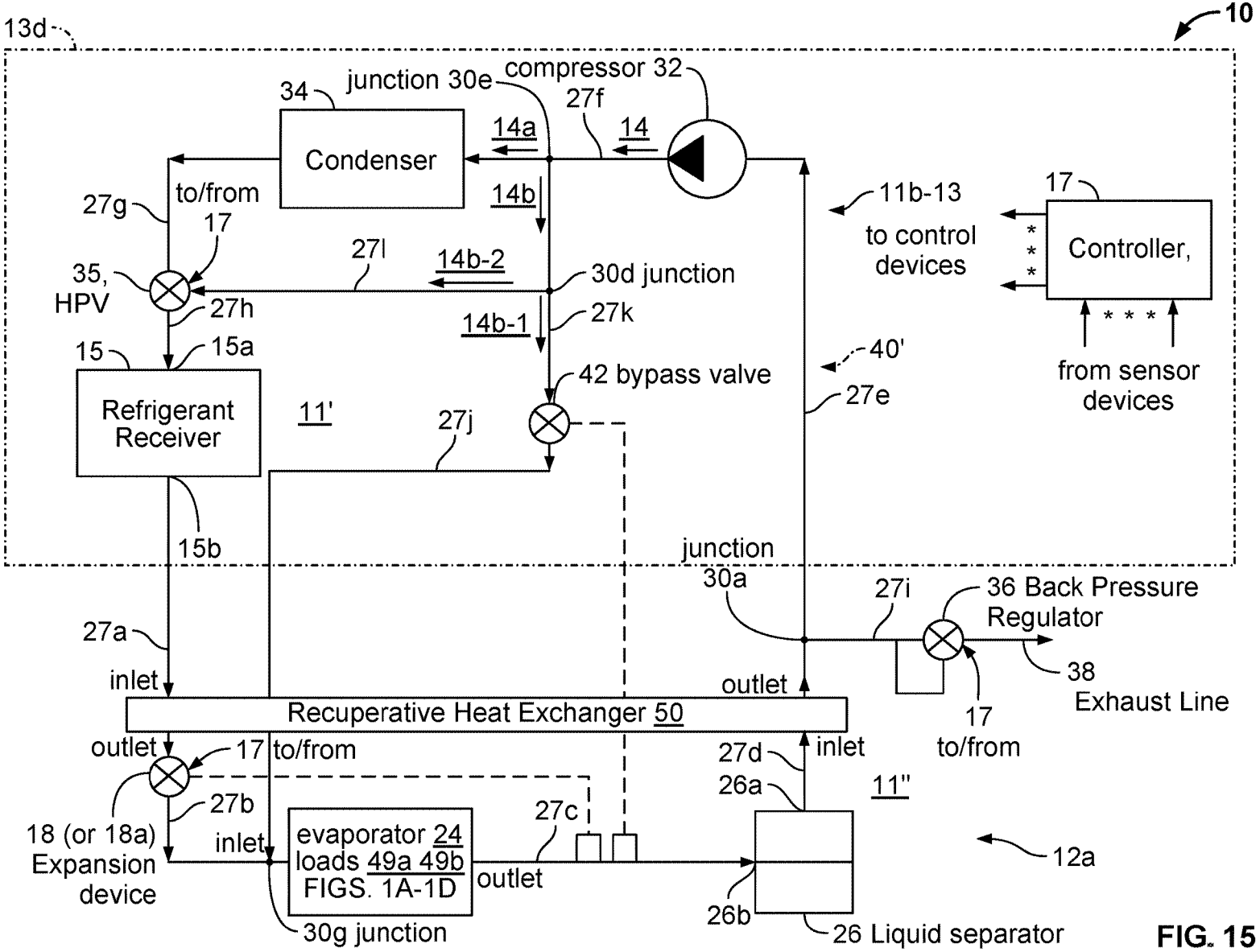
FIG. 15 is a schematic diagram of a thermal management system that includes an open-circuit/closed-circuit refrigeration system with recuperative heat exchanger and the alternative modulating capacity control circuit.

In FIGS. 6 and 15 a portion of the OCRSCCRS 11*b*-3 and a portion of the OCRSCCRS 11*b*-13 (including portions of the CCRS 11' and the OCRS 11") are grouped in dashed line boxes 13*a*, 13*d*, respectively. These boxes 13*a*, 13*d* will be referred to in the discussion of FIGS. 6A-6B and 15A-15B in the interests of brevity.

Figure 12A:
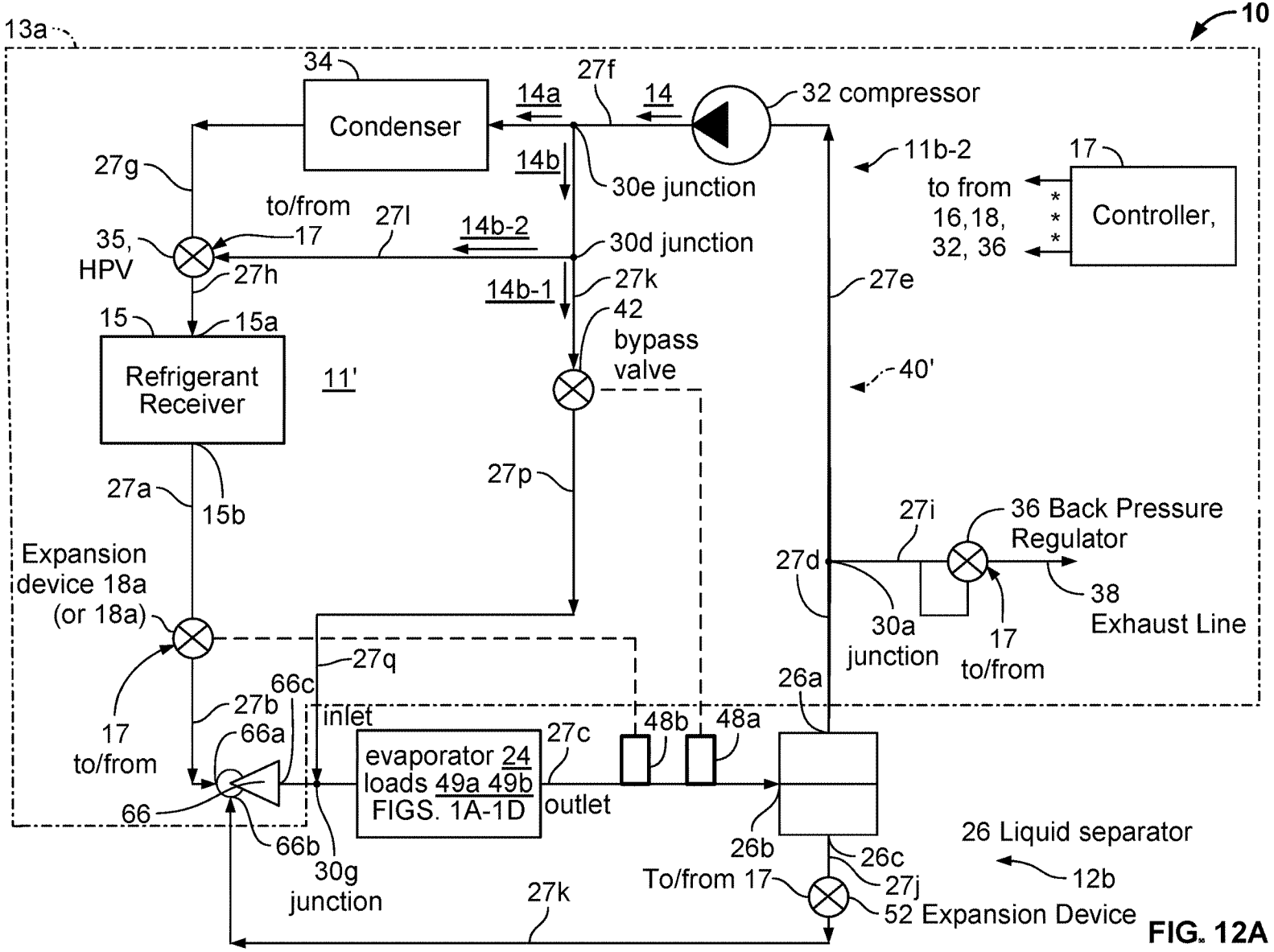
FIGS. 12A-12F are schematic diagrams of examples of a thermal management system that includes an open-circuit/closed-circuit refrigeration system with an ejector and the modulating capacity control circuit of FIG. 11.
Figure 12B:
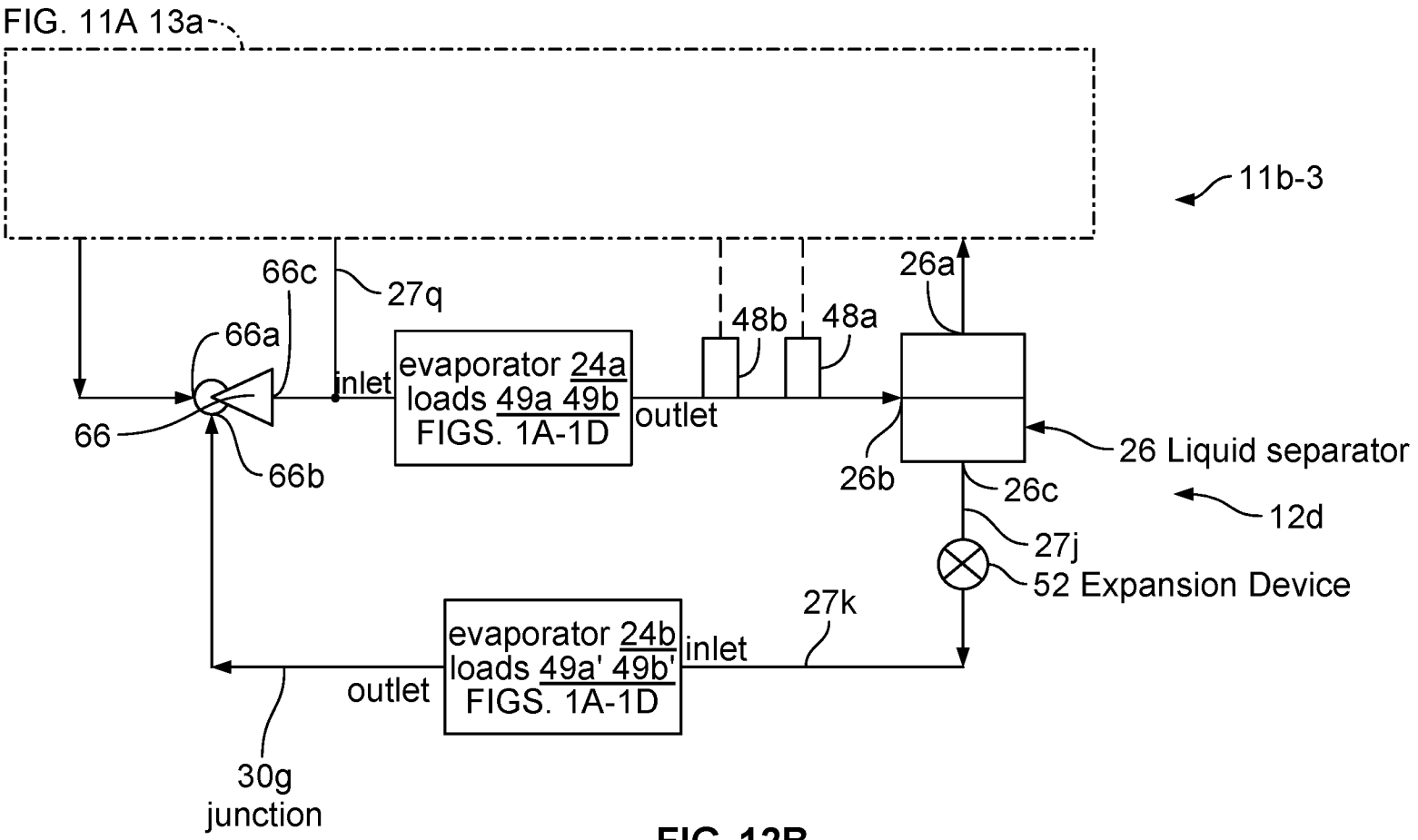
Figure 12C:
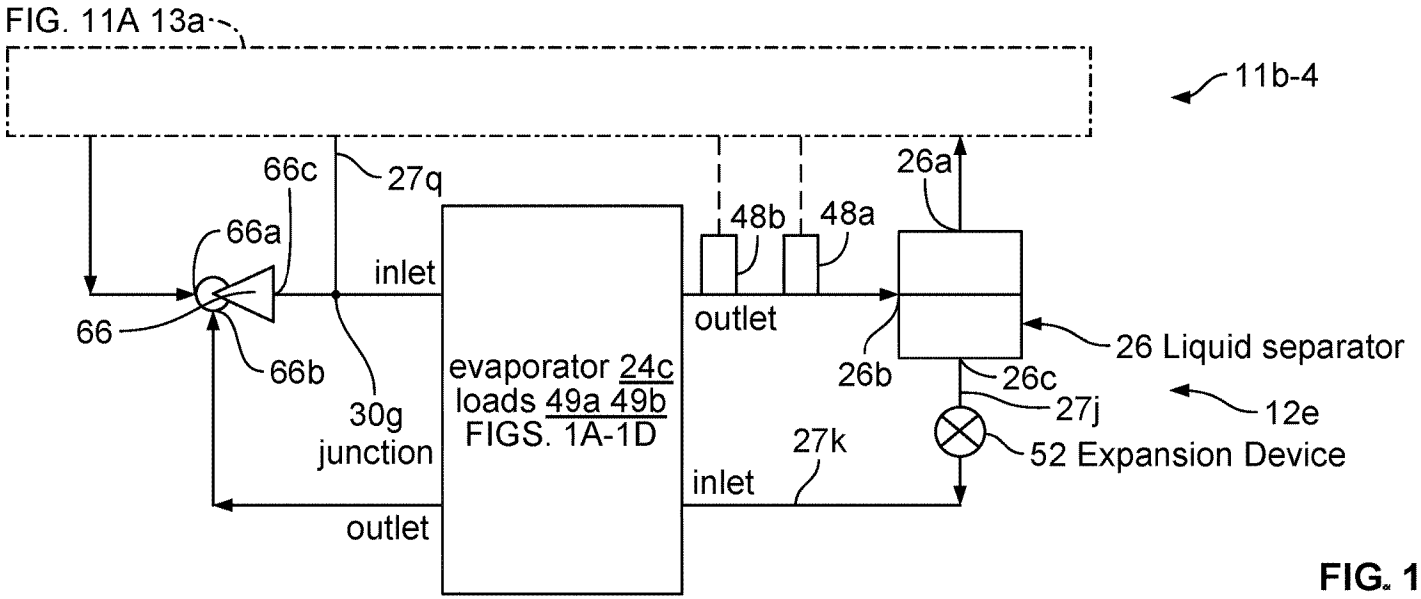
Figure 12D:
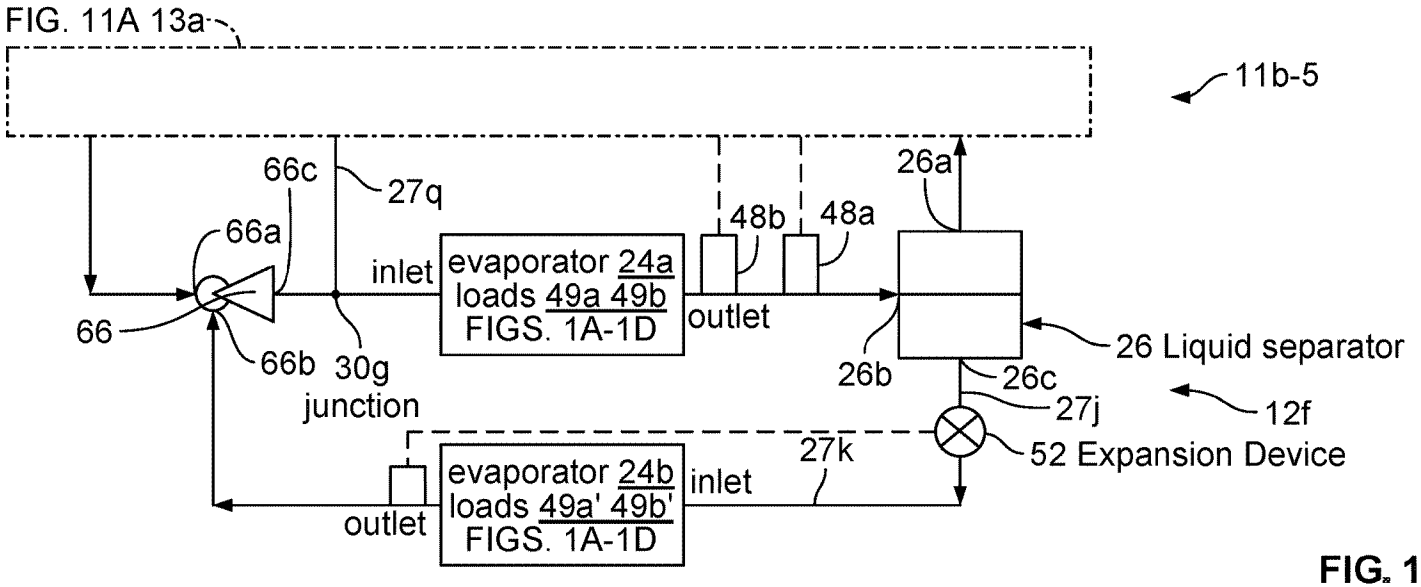
Figure 12E:
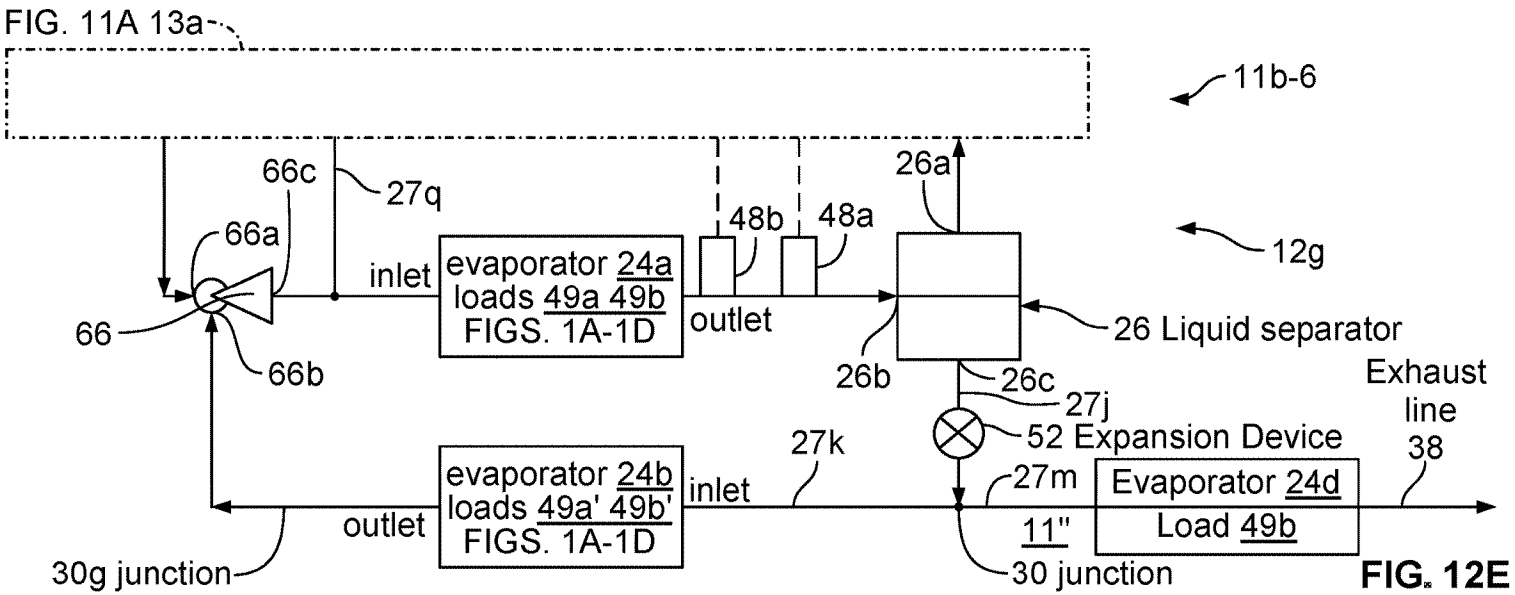
Figure 12F:
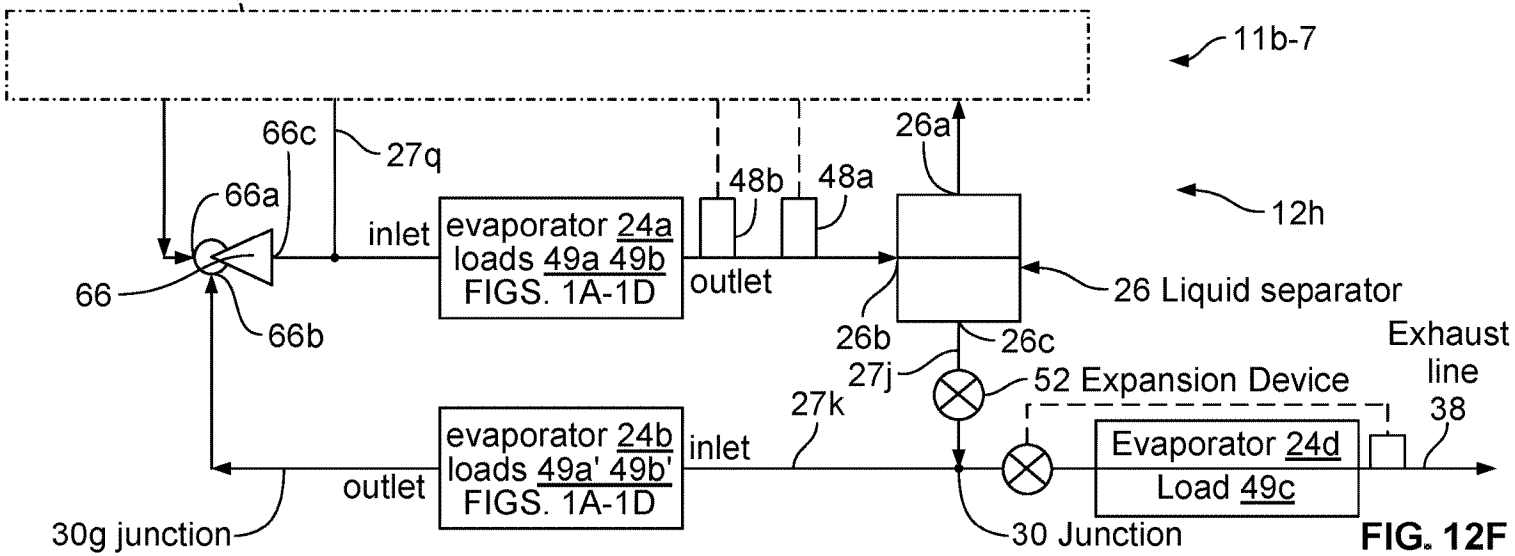
Figure 13A:
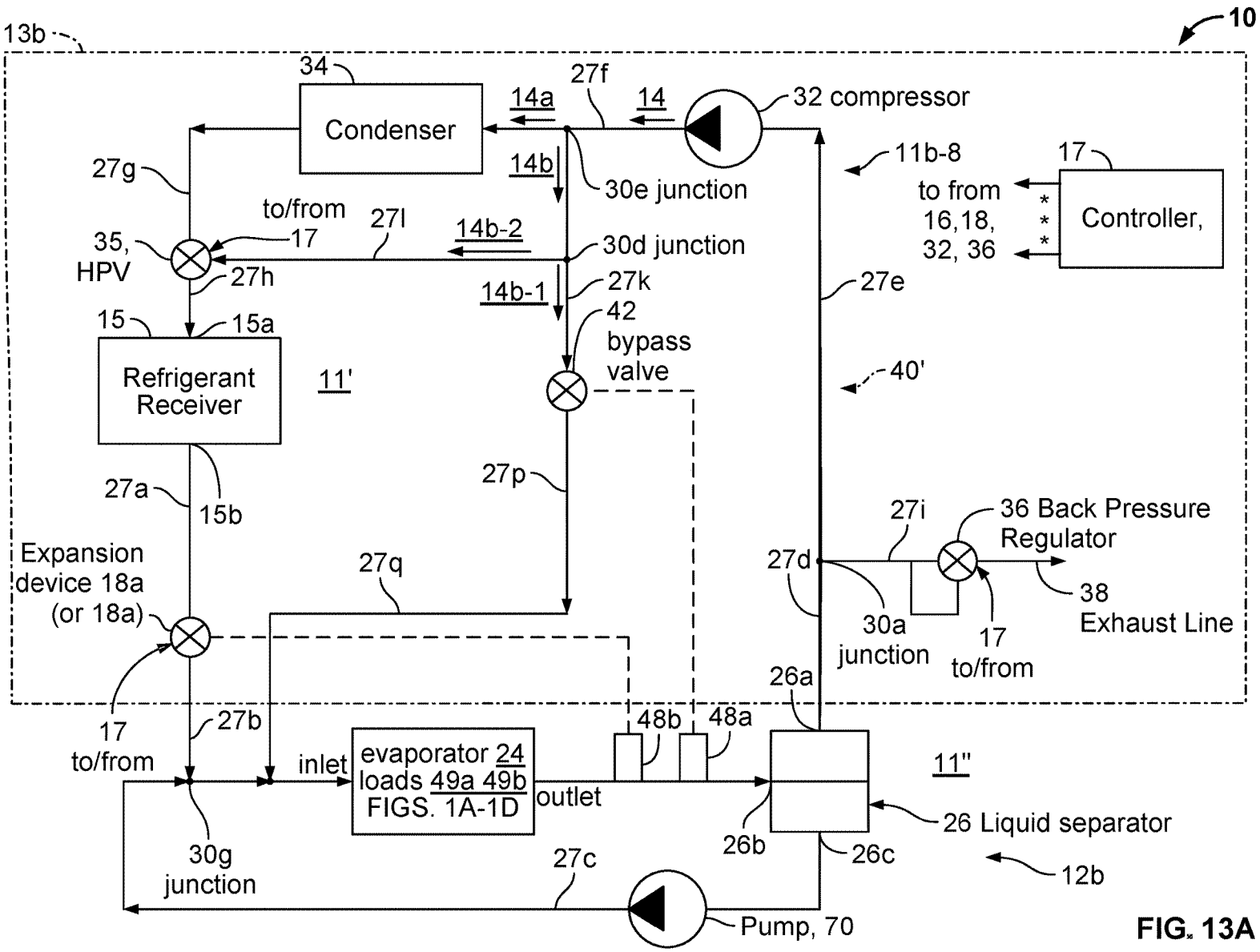
FIGS. 13A-13E are schematic diagrams of examples of a thermal management system that includes an open-circuit/closed-circuit refrigeration system with pump and the modulating capacity control circuit of FIG. 11.

In addition, in FIGS. 12A and 13A a portion of the OCRSCCRS 11*b*-2 and a portion of the OCRSCCRS 11*b*-8 (including portions of the CCRS 11' and the OCRS 11") are grouped in dashed line boxes 13*b*, 13*c*, respectively. These boxes 13*b*, 13*c* will be referred to in the discussion of FIGS. 12B-12F and 13B-13E in the interests of brevity.

Referring to FIG. 5, an example of the thermal management system (TMS) 10 that includes an Open-Circuit Refrigeration System integrated with a Closed-Circuit Refrigeration System (OCRSCCRS) 11*a*-2 is shown. The OCRSCCRS 11*a*-2 is similar in concept to OCRSCCRS 11*a*-1 (FIG. 1). The CCRS 11' includes the receiver 15, optional solenoid valve (not shown), and a control device 18*a*, e.g., an expansion valve device. The CCRS 11' also includes the evaporator arrangement 24 (evaporator 24), the liquid separator 26, the junction device 30*a*, the compressor 32, the condenser 34 (or a gas cooler of a trans-critical refrigeration system), and the head pressure control valve 35 all of which are coupled via conduits 27*a*-27*h*, and discussed in more detail in FIG. 1.

The OCRS 11" includes the receiver 15, optional solenoid valve (not shown), the control device 18, the evaporator arrangement 24 (evaporator 24), the liquid separator 26, the junction device 30*a*, and the back-pressure regulator 36 coupled to the exhaust line 38, all of which are coupled via conduits 27*a*-27*d*, 27*i*, and discussed in more detail in FIG. 1.

Figure 17:
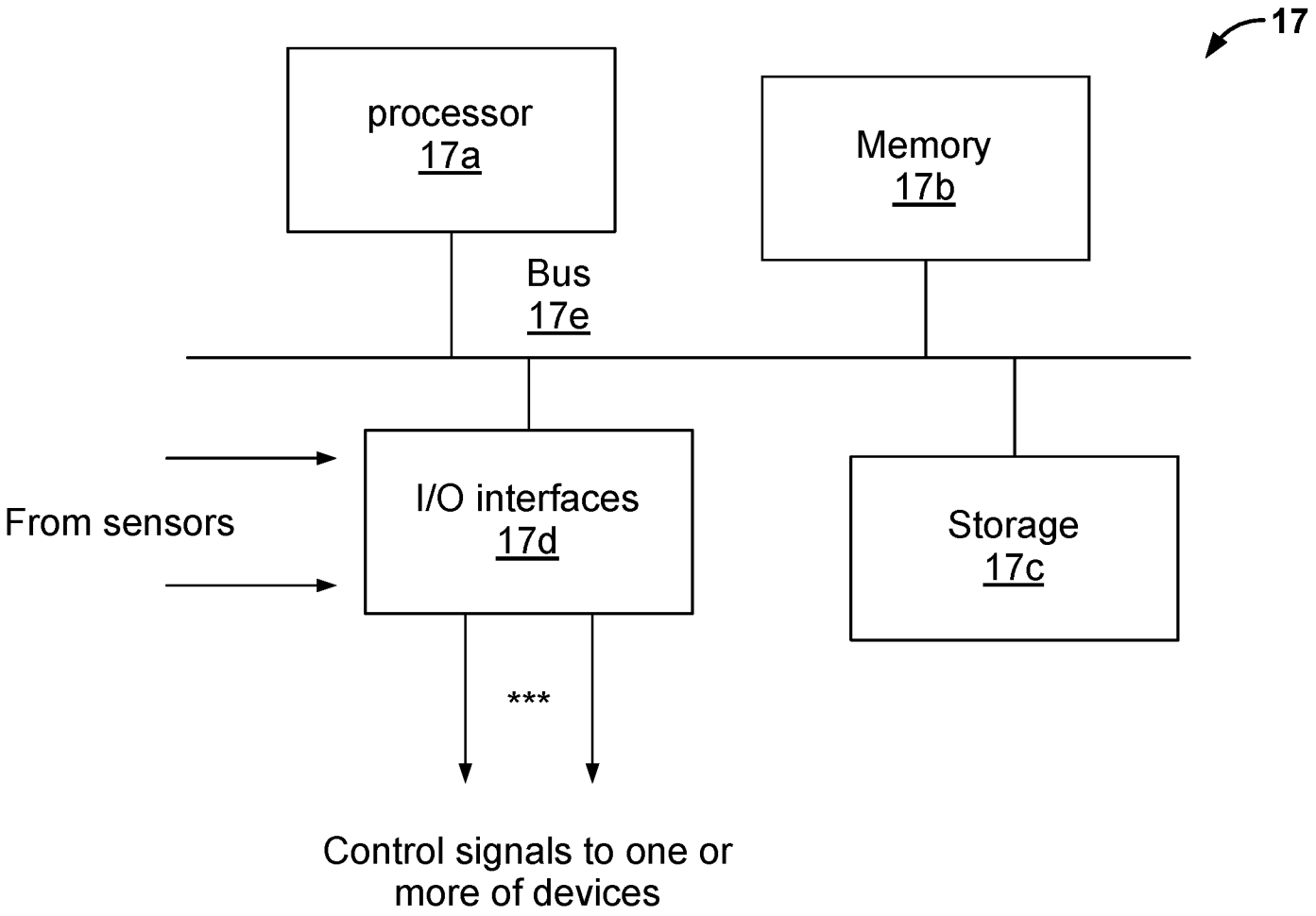
FIG. 17 is a block diagram of a controller.

In OCRSCCRS 11*a*-2, the control device 18*a* is an electronically controlled expansion valve device. The electronically controlled expansion device 18*a* can be operated with a sensor device 43 that controls the electronically controlled expansion valve device 18*a* either directly or through controller 17 (FIG. 17). The evaporator 24 operates in two-phase (liquid/vapor) and superheated regions with controlled superheat. The electronically controlled expansion valve device 18*a* and the sensor 43 provide a mechanism to measure and control superheat (or vapor quality if the evaporator arrangement 24 is configured to exhaust the two-phase refrigerant stream). Otherwise, the CCRS 11' is generally, as discussed above in FIG. 1, which provides cooling for low heat loads over long time intervals while the OCRS 11" provides cooling for high heat loads over short time intervals.

The OCRSCCRS 11*a*-2 also includes the modulating capacity control circuit 40 of FIG. 1. The bypass valve 42 is coupled to an outlet of the compressor 32, via junction devices 30*d* and 30*e* and conduit 27*k*. The bypass valve 42 is controlled or responsive to a control signal that comes either from a sensor 48*a* (or indirectly from the sensor 48*a* via the controller 17). The quench valve 44 is coupled between a port of the junction device 30*f* (that is at the outlet of the receiver 15), via conduit 27*j*, and the port of the junction device 30*c* (that is at the inlet to the mixer 46). The quench valve 44 is controlled via the sensor 48*b* (or indirectly from the sensor 48*b* via the controller 17). The mixer 46 is coupled to a port of the junction 30*c* and a port of the junction 30*b* and along the conduit that couples the mixer 46 are disposed the sensors 48*a*, 48*b*. The junction 30*d* is coupled via conduit 27*l* to an inlet to the head pressure control valve 35.

A. Closed-Circuit Refrigeration Operation

When the low heat load 49*a* is applied, the TMS 10 is configured to have the CCRS 11' provide refrigeration to the low heat load 49*a*. In this instance, controller 17 produces signals to cause the back-pressure regulator 36 to be placed in an OFF state (i.e., closed). With the back-pressure regulator 36 closed, the CCRS 11' provides cooling duty to handle the low heat loads through the CCRS 11".

Operation of the CCRS 11' for the OCRSCCRS 11*a*-2 is similar to that as described in FIG. 1, except for operation of the electronically controlled expansion valve device 18*a*. In the closed-circuit refrigeration configuration, the first portion (denoted by arrow 14*a*) of the compressed circulating refrigerant 14 is fed, via junction 30*e*, to the condenser 34 and a second portion (denoted by arrow 14*b*) of the compressed circulating refrigerant 14 is fed to the modulating capacity control circuit 40, as in FIG. 1. The first portion 14*a* of the circulating refrigerant is routed into the refrigerant receiver 15, exits the refrigerant receiver 15, and enters the control device, e.g., the electronically controlled expansion valve device 18*a* (through the optional solenoid valve, if used) as in FIG. 1. The heat from the heat load 49*a*, in contact with or proximate to the evaporator 24, evaporates the liquid portion of the two-phase refrigerant mixture, and may superheat the mixture.

The second portion 14*b* of the compressed circulating refrigerant is split into a first sub-portion (denoted by arrow 14*b*-1) and a second sub-portion (denoted by arrow 14*b*-2), as in FIG. 1. The hot gas bypass valve 42 receives the first compressed circulating refrigerant sub-portion 14*b*-1 from the junction device 30*d*, bypassing the condenser 34, the receiver 15, the electronically controlled expansion valve device 18*a*, and the evaporator 24, and directs the compressed circulating refrigerant sub-portion 14*b*-1 into the junction 30*c*. This first compressed circulating refrigerant sub-portion 14*b*-1 is enthalpically expanded from a high pressure to a low pressure in the bypass valve 42 under control of the sensor 48*a*.

The second compressed circulating refrigerant sub-portion 14*b*-2 is directed to the head pressure valve 35 that feds the second compressed circulating refrigerant sub-portion 14*b*-2 into the refrigerant receiver 15. The output of the refrigerant receiver 15 is coupled to the quench valve 44. The quench valve 44 has an output that is coupled to the junction 30*c*. Junction 30*c* is coupled to an input to the mixer 46. An output of the mixer 46 is coupled to the junction 30*b*. The quench valve 44 directs and enthalpically expands liquid refrigerant including the second sub-portion 14*b*-2 of the compressed liquid refrigerant from high pressure to low pressure, via receiver 15, while bypassing the expansion device 18*a* and the evaporator 24.

As discussed above, when the OCRS 11" is off, the steady-state CCRS 11' provides temperature control of continuous loads. Thus, the hot gas bypass, i.e., the first sub-portion 14*b*-1, and second sub-portion 14*b*-2 that is fed into the receiver 15 and is involved with the liquid flow stream from the receiver 15, both bypass the evaporator 24 to appropriately accommodate the reduced heat load. The mixer 46 operates as a mixing heat exchanger providing direct contact of the expanded vapor stream and two-phase mixture formed after the expansion of the liquid stream at the low pressure. The hot gas bypass valve 42, as controlled by sensor 48*a*, controls a set low evaporating/suction pressure. If the evaporating pressure is reduced below the set evaporating/suction pressure limit the hot gas bypass valve 42 is actuated. The quench valve 44 is an expansion valve device that controls refrigerant superheat at the mixer 46 exit. The quench valve 44 opens a flow opening when the superheat increases and thus increases the refrigerant flow rate to recover an increase in superheat. The quench valve 44 closes the flow opening when the superheat is reduced, and thus reduces the refrigerant flow rate to recover lessened superheat. The mixer 46 mixes the vapor (first sub-portion) and two-phase mixture (refrigerant liquid and second sub-portion). The liquid portion evaporates, leaving the mixer 46 with the superheat controlled by the quench valve 44.

B. Open/Closed-Circuit Refrigeration Operation

On the other hand, when a high heat load 49*b* is applied, a mechanism such as the controller 17 causes the OCRSCCRS 11*a*-2 to operate in both a closed and open cycle configuration.

The CCRS 11' is similar to that described above, except that the evaporator 24 in this case operates within a threshold of a vapor quality, the liquid separator 26 receives two-phase mixture, and compressor receives saturated vapor from the liquid separator 26. When the OCRSCCRS 11*a*-2 operates with the open cycle, this causes the controller 17 to be configured to cause the back-pressure regulator 36 to be placed in an ON position, thus opening the back-pressure regulator 36 to permit the back-pressure regulator 36 to exhaust vapor through the exhaust line 38. The back-pressure regulator 36 maintains a back pressure at its inlet, according to a set point pressure, while allowing the back-pressure regulator 36 to exhaust refrigerant vapor through the exhaust line 38, generally as discussed in FIG. 1.

The expansion valve device 18*a* is operated with the sensor device 43 that measures a superheat at the exit from the evaporator 24. In FIG. 5, OCRSCCRS 11*a*-2 includes the electronically controlled expansion valve device 18*a* operated with the sensor device 43 that controls the electronically controlled expansion valve device 18*a* either directly or (by the controller 17) and the back-pressure regulator 36 disposed in line with the exhaust line 38 to control superheat.

Referring now to FIG. 6, the OCRSCCRS 11*a*-3 includes the OCRS 11" integrated with the CCRS 11'. The OCRS 11" is an alternative configuration to that of FIG. 5. Unlike the configuration in FIG. 5, the configuration of FIG. 6 employs a device which allows for recuperation of the energy of the cold refrigerant and reduces the mass flow rate demand during cooling of the high load 49*b*, while saving energy during cooling load 49*a*. It also allows for lower vapor quality at the evaporator 24 exit because of the presence of a recuperative heat exchanger 50 that evaporates any remaining liquid prior to being fed to the inlet of the compressor 32. (In some implementations the presence of a recuperative heat exchanger 50 can eliminate the need for the liquid separator 26.)

An alternative to the TMS 10 using the recuperative heat exchanger 50 of FIG. 6 is to locate the recuperative heat exchanger 50 "below" a line shown in FIG. 6 as the connections between the receiver outlet 15*b* and junction 30*b*, e.g., coupled to the outlet of the receiver 15 and the outlet of the junction device 30*b*. Another alternative to the TMS 10 using the recuperative heat exchanger 50 of FIG. 6 is to locate a first recuperative heat exchanger 50 as shown in FIG. 6 and includes a second recuperative heat exchanger (not shown) "above" the line formed by the connections between the receiver outlet 15*b* and junction 30*b*, e.g., coupled to the outlet of the receiver 15 and the outlet of the junction device 30*b*, i.e., the TMS 10 would have two recuperative heat exchangers.

In a similar manner as in FIG. 1, the OCRSCCRS 11*a*-3 includes the modulating capacity control circuit 40 that includes the bypass valve 42 coupled between the outlet of the compressor 32, via junction devices 30*d* and 30*e* and conduit 27*k*, and inlet to the mixer 46, via the junction 30*c*. The bypass valve 42 is controlled or responsive to a control signal that comes either from a sensor 48*a* (or indirectly from the sensor 48*a* via the controller 17). The quench valve 44 is coupled between the port of the junction device 30*f*, via conduit 27*j* (that is at the outlet of the receiver 15), and a port of the junction device 30*c* (that is at the inlet to the mixer 46). The quench valve 44 is controlled via the sensor 48*b* (or indirectly from the sensor 48*b* via the controller 17). The mixer 46 is coupled to a port of the junction 30*c* and the port of the junction 30*b* and along the conduit that couples the mixer 46 are disposed the sensors 48*a*, 48*b*. The junction 30*d* is coupled via conduit 27*l* to an inlet to the head pressure control valve 35.

OCRSCCRS 11*a*-3 has the CCRS 11' and operates with the modulation control circuit 40 similar to that as discussed in FIG. 1, and has the OCRS 11" that provides cooling for high heat loads over short time intervals, as generally discussed above in FIG. 1. However, OCRSCCRS 11*a*-3 includes in addition to the receiver 15, the control device 18 (e.g., an expansion valve device 18*a*), the evaporator 24, liquid separator 26 and junction devices 30*a*, 30*b*, and 30*f*, and conduits 27*a*-27*f*, 27*j*, 27*k*, recuperative heat exchanger 50 coupled in an input path between the receiver 15 and the expansion device 18 and in an output path from vapor-side outlet of the liquid separator 26 to a port of the junction device 30*a*.

In FIG. 6, the OCRSCCRS 11*a*-3 has the expansion valve device 18 and the back-pressure regulator 36 disposed in line with the exhaust line 38. The back-pressure regulator 36 can maintain a relatively constant pressure in the receiver 15 during entire period of operation of the OCRSCCRS 11*a*-3. The expansion valve device 18 can also be the electronically controlled expansion valve device 18*a*. The recuperative heat exchanger 50 transfers heat energy from the refrigerant fluid emerging from liquid separator 26 to refrigerant fluid upstream from expansion valve device 18. Inclusion of the recuperative heat exchanger 50 reduces mass flow rate demand and allows operation of evaporator 24 within threshold of vapor quality.

The discussion below regarding vapor quality presumes that the recuperative heat exchanger 50 is configured to generate sufficient superheat. The vapor quality of the refrigerant fluid after passing through evaporator 24 can be controlled either directly or indirectly with respect to a vapor quality set point by the controller 17. The evaporator 24 may be configured to maintain exit vapor quality below the critical vapor quality defined as "1."

Vapor quality is defined as the ratio of mass of vapor to mass of liquid+vapor and is generally kept in a range of approximately 0.5 to almost 1.0; more specifically 0.6 to 0.95; more specifically 0.75 to 0.9 more specifically 0.8 to 0.9 or more specifically about 0.8 to 0.85. "Vapor quality" is thus mass of vapor/total mass (vapor+liquid). In this sense, vapor quality cannot exceed "1" or be equal to a value less than "0."

In practice vapor quality may be expressed as "equilibrium thermodynamic quality" that is calculated as follows:

$$X=(h-h')/(h''-h'),$$

where h is specific enthalpy, specific entropy or specific volume, h' is specific enthalpy, specific entropy or specific volume of a saturated liquid and "h"" is specific enthalpy, specific entropy or specific volume of a saturated vapor. In this case X can be mathematically below 0 or above 1, unless the calculation process is forced to operate differently. Either approach is acceptable.

During operation of system 10, cooling can be initiated by a variety of different mechanisms. In some embodiments, for example, TMS 10 includes temperature sensors attached to loads 49*a*-49*b* (as will be discussed subsequently). When the temperature of loads 49*a*-49*b* exceeds a certain temperature set point (i.e., threshold value), the controller 17 connected to the temperature sensor can initiate cooling of loads 49*a*-49*b*. Alternatively, in certain embodiments, TMS 10 operates essentially continuously—provided that the refrigerant fluid pressure within receiver 15 is sufficient—to cool load 49*a* and a temperature sensors attached to load 49*b* will cause the controller 17 to switch in the OCRS 11" when the temperature of load 49*b* exceeds a certain temperature set point (i.e., threshold value). As soon as receiver 15 is charged with refrigerant fluid, refrigerant fluid is ready to be directed into evaporator 24 to cool loads 49*a*-49*b*. In general, cooling is initiated when a user of the system or the heat load issues a cooling demand.

Upon initiation of a cooling operation, refrigerant fluid from receiver 15 is discharged from outlet 15*b*, through an optional solenoid control valve, (if present, but not shown), and is transported through conduit 27*a* to control device 18, which directly or indirectly controls vapor quality (or superheat) at the evaporator outlet. In the following discussion, control device 18 is implemented as an electronic expansion valve. However, it should be understood that more generally, control device 18 can be implemented as any component or device that performs the functional steps described below and provides for vapor quality control (or superheat) at the evaporator outlet.

Once inside the expansion valve, the refrigerant fluid undergoes constant enthalpy expansion from an initial pressure $p_r$ (i.e., the receiver pressure) to an evaporation pressure $p_e$ at the outlet of the expansion valve. In general, the evaporation pressure $p_e$ depends on a variety of factors, e.g., the desired temperature set point value (i.e., the target temperature) at which loads 49*a*-49*b* is/are to be maintained and the heat input generated by the respective heat loads. Set points will be discussed below.

The initial pressure in the receiver 15 tends to be in equilibrium with the surrounding temperature and is different for different refrigerants. The pressure in the evaporator 24 depends on the evaporating temperature, which is lower than the heat load temperature and is defined during design of the TMS 10. The TMS 10 is operational as long as the receiver-to-evaporator pressure difference is sufficient to drive adequate refrigerant fluid flow through the expansion valve device 18. After undergoing constant enthalpy expansion in the expansion valve device 18, the liquid refrigerant fluid is converted to a mixture of liquid and vapor phases at the temperature of the fluid and evaporation pressure $p_e$. The two-phase refrigerant fluid mixture is transported via conduit 27*b* to evaporator 24.

A. Closed-Circuit Refrigeration Operation

The OCRSCCRS 11*a*-3 also includes the modulating capacity control circuit 40. Closed-circuit refrigeration operation is similar to that described in FIG. 1.

When the two-phase mixture of refrigerant fluid is directed into evaporator 24, the liquid phase absorbs heat from loads 49*a* and/or 49*b*, driving a phase transition of the liquid refrigerant fluid into the vapor phase. Because this phase transition occurs at (nominally) constant temperature, the temperature of the refrigerant fluid mixture within evaporator 24 remains unchanged, provided at least some liquid refrigerant fluid remains in evaporator 24 to absorb heat.

Further, the constant temperature of the refrigerant fluid mixture within evaporator 24 can be controlled by adjusting the pressure $p_e$ of the refrigerant fluid, since adjustment of $p_e$ changes the boiling temperature of the refrigerant fluid. Thus, by regulating the refrigerant fluid pressure $p_e$ upstream from evaporator 24, the temperature of the refrigerant fluid within evaporator 24 (and, nominally, the temperature of high heat load 49*b*) can be controlled to match a specific temperature set-point value for high heat load 49*b*, ensuring that loads 49*a*-49*b* are maintained at, or very near, a target temperature. Additionally, further control is provided by the modulating capacity control circuit 40 that adjusts cooling capacity based on varying cooling requirements for the low heat load 49*a*.

For open-circuit operation, the pressure drop across the evaporator 24 causes a drop of the temperature of the refrigerant mixture (which is the evaporating temperature), but still the evaporator 24 can be configured to maintain the heat load temperature within the set tolerances.

In some embodiments, for example, the evaporation pressure of the refrigerant fluid can be adjusted by pressure of the back-pressure regulator 36 to ensure that the temperature of thermal loads 49*a*-49*b* is maintained to within ±5 degrees C. (e.g., to within ±4 degrees C., to within ±3 degrees C., to within ±2 degrees C., to within ±1 degree C.) of the temperature set point value for the high load 49*b*.

As discussed above, within evaporator 24, a portion of the liquid refrigerant in the two-phase refrigerant fluid mixture is converted to refrigerant vapor by undergoing a phase change. As a result, the refrigerant fluid mixture that emerges from evaporator 24 has a higher vapor quality (i.e., the fraction of the vapor phase that exists in refrigerant fluid mixture) than the refrigerant fluid mixture that enters evaporator 24.

As the refrigerant fluid mixture emerges from evaporator 24, a portion of the refrigerant fluid can optionally be used to cool one or more additional thermal loads. Typically, for example, the refrigerant fluid that emerges from evaporator 24 is nearly in the vapor phase. The refrigerant fluid vapor (or, more precisely, high vapor quality fluid vapor) can be directed into a heat exchanger coupled to another thermal load, and can absorb heat from the additional thermal load during propagation through the heat exchanger.

For open-circuit operation, the refrigerant fluid emerging from evaporator 24 is transported through conduit 27*d* to the recuperative heat exchanger 50. After passing through the recuperative heat exchanger 50, the refrigerant fluid is discharged as exhaust, via back-pressure regulator 36 through exhaust line 38.

Refrigerant fluid discharge can occur directly into the environment surrounding TMS 10. Alternatively, in some embodiments, the refrigerant fluid can be further processed; various features and aspects of such processing are discussed in further detail below.

It should be noted that the foregoing steps, while discussed sequentially for purposes of clarity, occur simultaneously and continuously during cooling operations. In other words, refrigerant fluid is continuously being discharged from receiver 15, undergoing continuous expansion in expansion valve device 18, flowing continuously through evaporator 24, and being discharged from system 10, while thermal loads 49*a*-49*b* are being cooled.

During operation of system 10, as refrigerant fluid is drawn from receiver 15 and used to cool thermal load 49*b*, the receiver pressure $p_r$ falls. If the refrigerant fluid pressure $p_r$ in receiver 15 is reduced to a value that is too low, the pressure differential $p_r - p_e$ may not be adequate to drive sufficient refrigerant fluid mass flow to provide adequate cooling of thermal load 49*b*. Accordingly, when the refrigerant fluid pressure $p_r$ in receiver 15 is reduced to a value that is sufficiently low, the capacity of TMS 10 to maintain a particular temperature set point value for loads 49*a*-49*b* may be compromised. Therefore, the pressure in the receiver 15 or pressure drop across the expansion valve device 18 (or any related refrigerant fluid pressure or pressure drop in system 10) can be an indicator of the remaining operational time. An appropriate warning signal can be issued (e.g., by the controller 17) to indicate that, in a certain period of time, the system may no longer be able to maintain adequate cooling performance; operation of the system can even be halted if the refrigerant fluid pressure in receiver 15 reaches the low-end threshold value.

It should be noted that while in the figures only a single receiver 15 is shown, in some embodiments, TMS 10 can include multiple refrigerant receivers to allow for operation of the system over an extended time period. Each of the multiple receivers can supply refrigerant fluid to the system to extend to total operating time period. Some embodiments may include plurality of evaporators connected in parallel, which may or may not be accompanied by a plurality of expansion valves and plurality of evaporators.

B. System Operational Control

As discussed in the previous section, by adjusting the pressure $p_e$ of the refrigerant fluid, the temperature at which the liquid refrigerant phase undergoes vaporization within evaporator 24 can be controlled. Thus, in general, the temperature of heat loads 49*a*-49*b* can be controlled by a device or component of TMS 10 that regulates the pressure of the refrigerant fluid within evaporator 24. System operating parameters include the superheat and the vapor quality of the refrigerant fluid emerging from evaporator 24.

The vapor quality, which is a number from 0 to 1, represents the fraction of the refrigerant fluid that is in the vapor phase. Considering high heat load 49*b*, individually, because heat absorbed from high heat load 49*b* is used to drive a constant-temperature evaporation of liquid refrigerant to form refrigerant vapor in evaporator 24, it is generally important to ensure that, for a particular volume of refrigerant fluid propagating through evaporator 24, at least some of the refrigerant fluid remains in liquid form right up to the point at which the exit aperture of evaporator 24 is reached to allow continued heat absorption from high heat load 49*b* without causing a temperature increase of the refrigerant fluid. If the fluid is fully converted to the vapor phase after propagating only partially through evaporator 24, further heat absorption by the (now vapor-phase) refrigerant fluid within evaporator 24 will lead to a temperature increase of the refrigerant fluid and high heat load 49*b*.

On the other hand, liquid-phase refrigerant fluid that emerges from evaporator 24 represents unused heat-absorbing capacity, in that the liquid refrigerant fluid did not absorb sufficient heat from high heat load 49*b* to undergo a phase change. To ensure that TMS 10 operates efficiently, the amount of unused heat-absorbing capacity should remain relatively small.

In addition, the boiling heat transfer coefficient that characterizes the effectiveness of heat transfer from high heat load 49*b* to the refrigerant fluid is typically very sensitive to vapor quality. When the vapor quality increases from zero to a certain value, called a critical vapor quality, the heat transfer coefficient increases. When the vapor quality exceeds the critical vapor quality, the heat transfer coefficient is abruptly reduced to a very low value, causing dryout within evaporator 24. In this region of operation, the two-phase mixture behaves as superheated vapor.

In general, the critical vapor quality and heat transfer coefficient values vary widely for different refrigerant fluids, and heat and mass fluxes. For all such refrigerant fluids and operating conditions, the systems and methods disclosed herein control the vapor quality at the outlet of the evaporator such that the vapor quality approaches the threshold of the critical vapor quality.

To make maximum use of the heat-absorbing capacity of the two-phase refrigerant fluid mixture for high heat load 49*b*, the vapor quality of the refrigerant fluid emerging from evaporator 24 should nominally be equal to the critical vapor quality. Accordingly, to both efficiently use the heat-absorbing capacity of the two-phase refrigerant fluid mixture and also ensure that the temperature of high heat load 49*b* remains approximately constant at the phase transition temperature of the refrigerant fluid in evaporator 24, the systems and methods disclosed herein are generally configured to adjust the vapor quality of the refrigerant fluid emerging from evaporator 24 to a value that is less than or equal to the critical vapor quality.

Another important operating consideration for TMS 10 is the mass flow rate of refrigerant fluid within the TMS 10. Evaporator can be configured to provide minimal mass flow rate controlling maximal vapor quality, which is the critical vapor quality. By minimizing the mass flow rate of the refrigerant fluid according to the cooling requirements for heat load 49, TMS 10 operates efficiently. Each reduction in the mass flow rate of the refrigerant fluid (while maintaining the same temperature set point value for heat load 49) means that the charge of refrigerant fluid added to receiver 15 initially lasts longer, providing further operating time for TMS 10.

Within evaporator 24, the vapor quality of a given quantity of refrigerant fluid varies from the evaporator inlet (where vapor quality is lowest) to the evaporator outlet (where vapor quality is highest). Nonetheless, to realize the lowest possible mass flow rate of the refrigerant fluid within the system, the effective vapor quality of the refrigerant fluid within evaporator 24—even when accounting for variations that occur within evaporator 24—should match the critical vapor quality, as closely as possible.

In summary, to ensure that the system operates efficiently and the mass flow rate of the refrigerant fluid is relatively low, and at the same time the temperature of high heat load 49*b* is maintained within a relatively small tolerance, TMS 10 adjusts the vapor quality of the refrigerant fluid emerging from evaporator 24 to a value such that an effective vapor quality within evaporator 24 matches, or nearly matches, the critical vapor quality.

In system 10, control device 18 is generally configured to control the vapor quality of the refrigerant fluid emerging from evaporator 24. As an example, when control device 18 is implemented as an expansion valve, the expansion valve regulates the mass flow rate of the refrigerant fluid through the valve. In turn, for a given set of operating conditions (e.g., ambient temperature, initial pressure in the receiver, temperature set point value for high heat load 49*b*), the vapor quality determines mass flow rate of the refrigerant fluid emerging from evaporator 24.

Control device 18 typically controls the vapor quality of the refrigerant fluid emerging from evaporator 24 in response to information about at least one thermodynamic quantity that is either directly or indirectly related to the vapor quality.

In general, a wide variety of different measurement and control strategies can be implemented in TMS 10 to achieve various control objectives discussed herein.

Figure 6A:
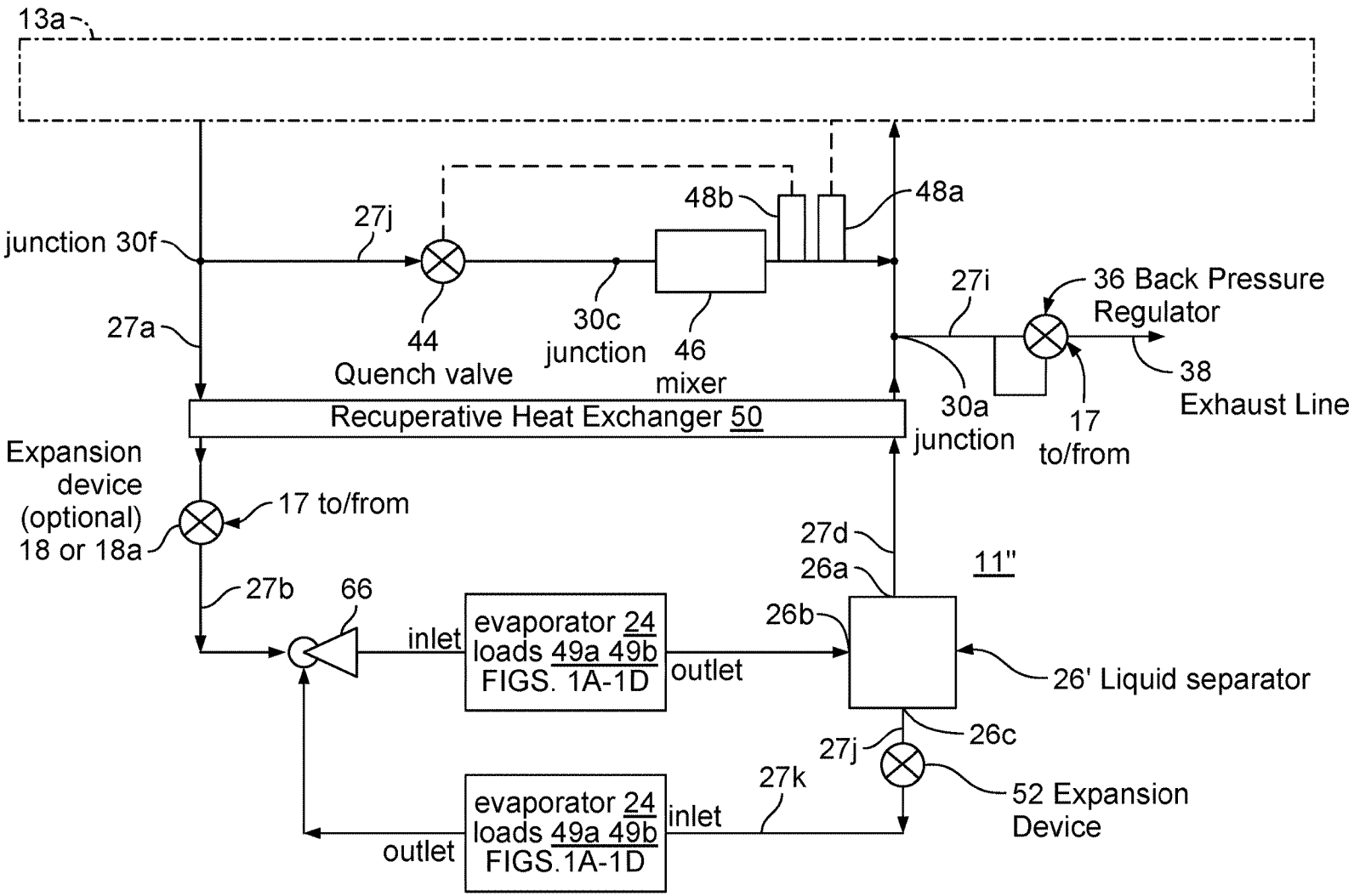
FIGS. 6A and 6B show alternative examples of the thermal management system that includes an open-circuit/closed-circuit refrigeration system with a recuperative heat exchanger, with modulating capacity control circuit of FIG. 1, with an ejector (FIG. 6A) or a pump (FIG. 6B).
Figure 6B:
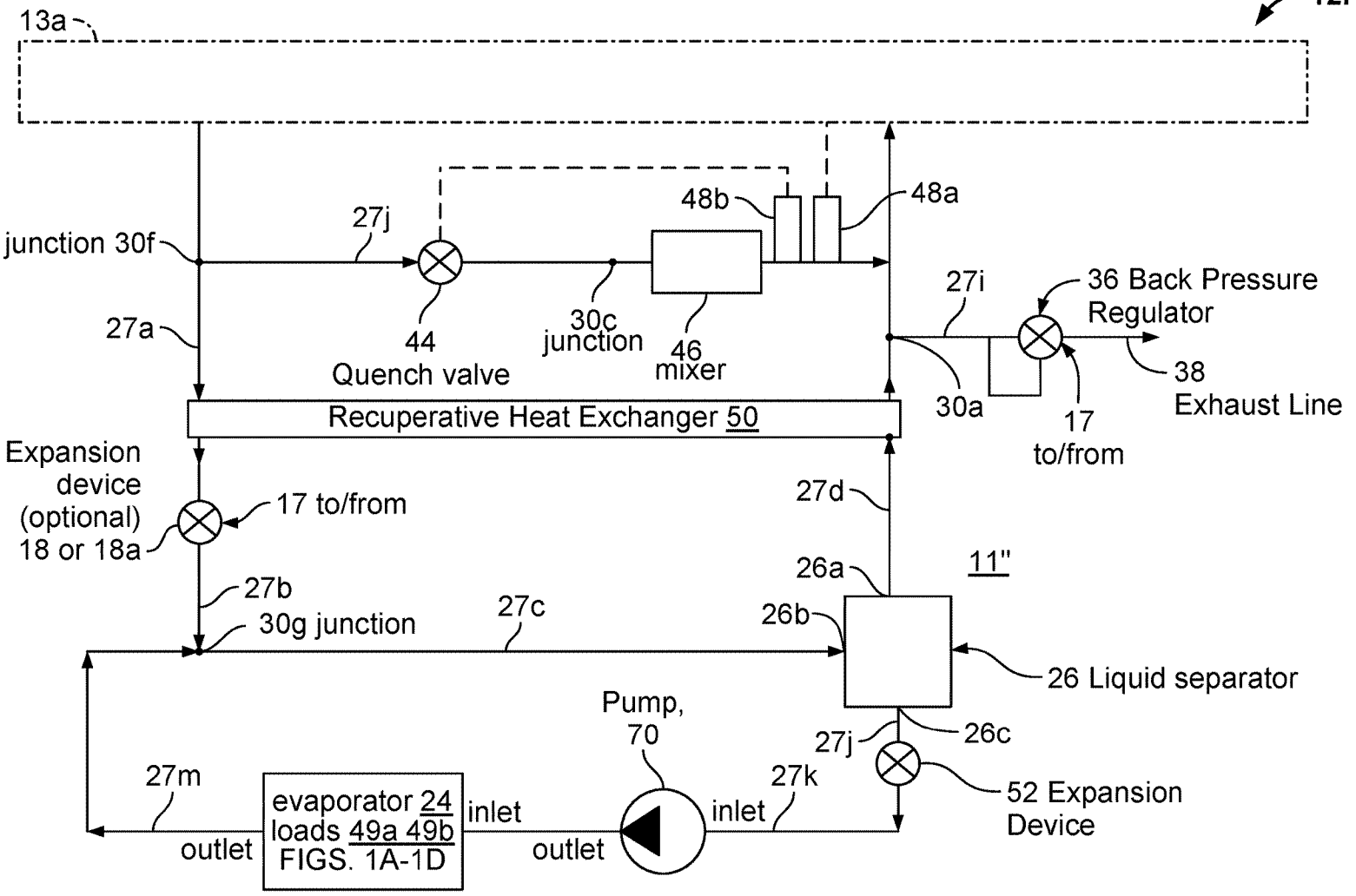

The recuperative heat exchanger 50 may be used with any of the embodiments 11*a*-1 to 11*a*-16 discussed below. For example, FIGS. 6A and 6B show alternative implementations using the recuperative heat exchanger. FIG. 6A shows an implementation using an ejector 66, whereas FIG. 6B shows an implementation using a pump 70. Detailed discussion of implementations using the ejector are discussed below in conjunction with FIGS. 7A-7G and of the pump implementation are discussed in conjunction with FIGS. 9A-9G.

III. Thermal Management Systems with Closed-Circuit Refrigeration Systems Integrated with Open-Circuit Refrigeration Systems with Ejector Boost and Modulated Capacity Control FIGS. 7A-7G show ejector assisted type alternative configurations for OCRSCCRS implementations 11*a*-4 to 11*a*-10 each having the OCRS 11" and the CCRS 11' portions, as shown. The use of an ejector can assist in reducing a power requirement of the TMS 10. Items illustrated and referenced, but not mentioned in the discussion below are discussed and referenced in FIG. 1.

Figure 7A:
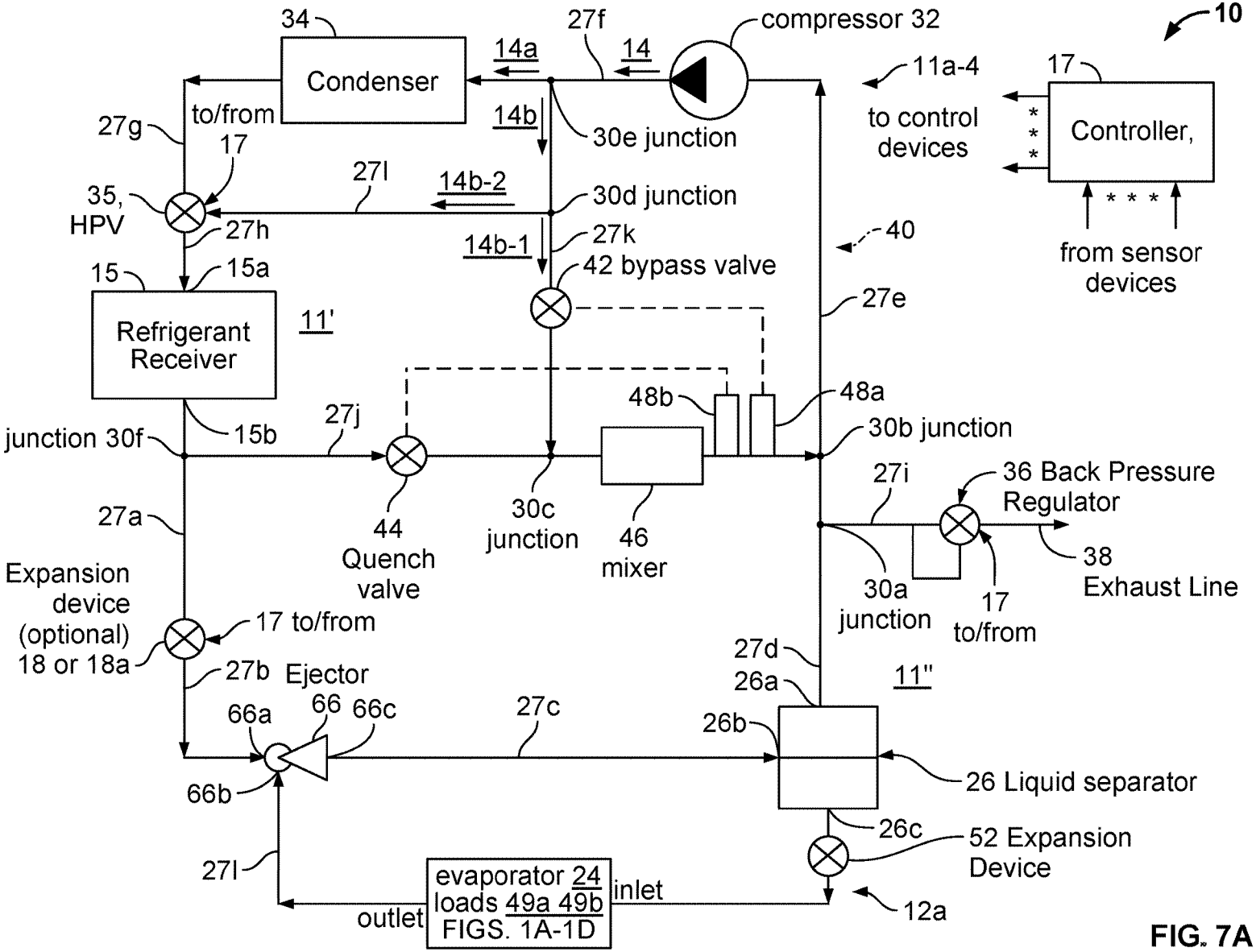

Referring now to FIG. 7A, the TMS 10 includes the OCRSCCRS 11*a*-4 that has the OCRS 11" integrated with the CCRS 11'. The OCRS 11" of OCRSCCRS 11*a*-4 uses an ejector assisted open-circuit refrigeration system (E-OCRS) configuration 12*a*. The CCRS 11' is generally, as discussed above in FIG. 1, and includes the modulating capacity control circuit 40. The CCRS 11' provides cooling for low heat loads over long time intervals while the OCRS 11" provides cooling for high heat loads over short time intervals, as generally discussed above in FIG. 1.

TMS 10 includes the OCRSCCRS 11*a*-4 and the heat loads 49*a*, 49*b*. The heat load 49*a* is a low heat load 49*a* whereas heat load 49*b* is a high heat load 49*b*, as discussed above.

CCRS 11' is ejector assisted as is the OCRS 11". The OCRSCCRS 11*a*-4 includes the receiver 15 that is configured to store sub-cooled liquid refrigerant, as discussed above, and may include an optional solenoid valve and a first control device, such as, an expansion valve device 18. Both, either, or neither of the optional solenoid valve and the optional expansion valve device 18 may be used in each of the embodiments of the OCRSCCRS 11*a*-4 to 11*a*-10 of FIGS. 7A-7G. The components of the CCRS 11' are generally the same as in FIG. 1, expect that CCRS 11' of FIG. 7A (and FIGS. 7B to 7G discussed below) also includes an ejector 66 and may include other components as discussed below.

The ejector 66 has a primary inlet or high-pressure inlet 66*a* that is coupled to the receiver 15 (either directly or through the optional expansion valve device 18 and/or optional solenoid valve). Outlet 66*c* of the ejector 66 is coupled via conduit 27*c* to the inlet port of 26*b* of a liquid separator 26. The ejector 66 also has a secondary inlet or low-pressure inlet 66*b*. The liquid separator 26 in addition to the inlet port 26*b* has the vapor-side port 26*a* and the liquid-side port 28*c*, as explained above. The vapor-side port 26*a* of the liquid separator 26 is coupled via conduit 27*d* to a first port of the junction 30*a* that has the second port coupled to an inlet (not referenced) of the back-pressure regulator 36. The back-pressure regulator 36 has an outlet (not referenced) that feeds exhaust line 38. The third port of the junction device 30*a* is coupled to the compressor 32. The compressor 32 is coupled to condenser 34. The OCRSCCRS 11*a*-4 also includes an optional, second expansion valve device 52, and an evaporator 24. The evaporator 24 is coupled to the ejector 66 and the liquid-side port 26*c* of the liquid separator 26.

The OCRSCCRS 11*a*-4 includes the modulating capacity control circuit 40 that includes the bypass valve 42 coupled between the outlet of the compressor 32, via junction devices 30*d* and 30*e*, and an inlet to the mixer 46, via the junction 30*c*. The bypass valve 42 is controlled or responsive to a control signal that comes either from sensor 48*a* (or indirectly from the sensor 48*a* via the controller 17). The quench valve 44 is coupled between the port of the junction device 30*f* (that is at the outlet of the receiver 15) and the port of the junction device 30*c* (that is at the inlet to the mixer 46). The quench valve 44 is controlled via the sensor 48*b* (or indirectly from the sensor 48*b* via the controller 17). The mixer 46 is coupled to the bypass valve 42 and the quench valve 44 via the port of the junction 30*c* and to the port of the junction 30*b* with the sensors 48*a*, 48*b* disposed along the conduit that couples the mixer 46 and junction 30*b*. The junction 30*d* is coupled via conduit 27*l* to an inlet to the head pressure control valve 35.

A. Closed-Circuit Refrigeration Operation

When the low heat load 49*a* is applied, the TMS 10 is configured to have the CCRS 11' provide refrigeration to the low heat load 49*a*. In this instance, controller 17 produces signals to cause the back-pressure regulator 36 to be placed in an OFF state (i.e., closed). With the back-pressure regulator 36 closed, the CCRS 11' provides cooling duty to handle the low heat loads through the CCRS 11'.

The closed-circuit refrigeration system CCRS 11' is structured, as discussed above in FIG. 1, with the addition of the loop (not referenced) provided by the ejector 66, liquid separator 26, and evaporator 24. Refrigerant from the receiver 15 enters the primary port 66*a* of the ejector 66 (see detailed discussion immediately following) and through the loop, meaning that refrigerant flows from the ejector 66 into the liquid separator 26, from the liquid separator 26 into the expansion valve device 52 where the refrigerant is expanded, and then flows into the evaporator 24, which cools heat load 49*a*. The expansion valve device 52 enthalpically expands refrigerant that is fed to the evaporator 24. The refrigerant is returned to the ejector 66 and to the liquid separator 26, while a vapor fraction of the refrigerant is fed to the compressor 32 and to the condenser 34, as discussed above. The liquid separator 26 is used to insure only vapor exists at the input to the compressor 32.

The CCRS 11' provides cooling for low heat loads 49*a* over long time intervals. Refrigerant from the outlet of the evaporator 24 is fed to the secondary 66*b* inlet of the ejector 66. The ejector 66 entrains the secondary fluid flow, i.e., it acts as a "pump," to "pump" the secondary fluid flow, e.g., liquid/vapor, from the evaporator 24 using energy of the primary refrigerant flow from the refrigerant receiver 15. See FIG. 8 for a more detailed description of a typical ejector 66.

B. Open/Closed-Circuit Refrigeration Operation

In some embodiments, refrigerant flow through the OCRSCCRS 11*a*-4 during open-circuit operation is controlled in the CCRS 11' either solely by the ejector 66 and back-pressure regulator 36 or by those components aided by either the expansion valve device 18, depending on requirements of the application, e.g., ranges of mass flow rates, cooling requirements, receiver capacity, ambient temperatures, thermal load, etc. and the expansion valve device 52.

While both expansion valve device 18 and optional solenoid valve (not shown) may not typically be used, in some implementations, either or both would be used and would function as a flow control device to control refrigerant flow into the primary inlet 66*a* of the ejector 66. In some embodiments, expansion valve device 18 can be integrated with the ejector 66. In various embodiments of the OCRSCCRS 11*a*-3, the expansion valve device 18 may be required under some circumstances where there are or can be significant changes in, e.g., an ambient temperature, which might impose additional control requirements on the OCRSCCRS 11*a*-4.

The back-pressure regulator 36 outlet is disposed at the exhaust line 38 and the back-pressure regulator inlet is coupled to the vapor-side outlet 26*a* of the liquid separator 26 and generally functions to control the vapor pressure upstream of the back-pressure regulator 36. In OCRSCCRS 11*a*-4, the back-pressure regulator 36 is a control device that controls the refrigerant fluid vapor pressure from the liquid separator 26 and indirectly controls evaporating pressure/temperature when the OCRSCCRS 11*a*-4 is operating in open-circuit mode.

In general, back-pressure regulator 36 can be implemented using a variety of different mechanical and electronic flow regulation devices, as mentioned above. The back-pressure regulator 36 regulates fluid pressure upstream from the regulator, i.e., regulates the pressure at the inlet to the back-pressure regulator 36 according to a set pressure point value.

For expansion valve devices 18 and 52 mechanical expansion valve and/or electrically controlled expansion valves could be used, as discussed above. Also in some of the further embodiments discussed below, the controller 17 can be used with electrical expansion valves to calculate a value of superheat for the expanded refrigerant fluid based on pressure and temperature measurements at the liquid separator exit, as discussed above.

Some loads require maintaining thermal contact between the loads 49*b* and evaporator 24 with the refrigerant being in the two-phase region (of a phase diagram for the refrigerant) and, therefore, the expansion valve device 52 maintains a proper vapor quality at the evaporator exit. Alternatively, a sensor communicating with controller 17 may monitor pressure in the refrigerant receiver 15, as well as a pressure differential across the expansion valve device 18, a pressure drop across the evaporator 24, a liquid level in the liquid separator 26, and power input into electrically actuated heat loads, or a combination of the above.

In FIG. 7A, the evaporator 24 is coupled to the secondary inlet 66*b* (low-pressure inlet) of the ejector 66 and to an outlet of the expansion valve device 52, such that the expansion valve device 52 and conduit 27*j*, 27*k* couple the evaporator 24 to the liquid-side outlet of the liquid separator 26. During open-circuit operation, the ejector 66 again acts as a "pump," to "pump" a secondary fluid flow, e.g., liquid/vapor from the evaporator 24 using energy of the primary refrigerant flow from the refrigerant receiver 15.

The evaporator 24 may be configured to maintain exit vapor quality below the critical vapor quality defined as "1." However, the higher the exit vapor quality the better it is for operation of the ejector 66. Vapor quality is the ratio of mass of vapor to mass of liquid+vapor and is generally kept in a range of approximately 0.5 to almost 1.0; more specifically 0.6 to 0.95; more specifically 0.75 to 0.9 more specifically 0.8 to 0.9 or more specifically about 0.8 to 0.85, as discussed above.

The OCRS 11" portion operates as follows. The liquid refrigerant from the receiver 15 (primary flow) is fed to the primary inlet 66*a* of the ejector 66 and expands at a constant entropy in the ejector 66 (in the ideal case; in reality the nozzle is characterized by the isentropic efficiency of the ejector) and turns into a two-phase (vapor/liquid) state. The refrigerant in the two-phase state from the ejector 66 enters the liquid separator 26, at inlet port 26*b* with only or substantially only liquid exiting the liquid separator at the liquid-side outlet 28*c* and only or substantially only vapor exiting the separator 26 at the vapor-side outlet 28*a*. The liquid stream exiting at outlet 28*c* enters and is expanded in the expansion valve device 52 into a liquid/vapor stream that enters the evaporator 24. The expansion valve device 52 is configured to maintain suitable vapor quality at the evaporator exit (or a superheat if this is acceptable to operate the high heat load 49*b*) and related recirculation rate.

The evaporator 24 provides cooling duty and discharges the refrigerant in a two-phase state at relatively low exit vapor quality (low fraction of vapor to liquid, e.g., generally below 0.5) into the secondary inlet 66*b* of the ejector 66. The ejector 66 entrains the refrigerant flow exiting the evaporator 24 and combines it with the primary flow from the receiver 15. Vapor exits from the vapor-side outlet 26*a* of the liquid separator 26 and is exhausted by the exhaust line 38. The back-pressure regulator 36 regulates the pressure upstream of the regulator 36 so as to maintain upstream refrigerant fluid pressure in OCRSCCRS 11*a*-4.

As discussed above, when the OCRS 11" is off, the steady-state CCRS 11' provides temperature control of continuous loads. The first sub-portion 14*b*-1 and second sub-portion 14*b*-2 that is fed into the receiver 15 and is involved with the liquid flow stream from the receiver 15 both bypass the evaporator 24 to appropriately accommodate the reduced heat load. The mixer 46 operates as a mixing heat exchanger providing direct contact of the expanded vapor stream and two-phase mixture formed after the expansion of the liquid stream at the low pressure. The hot gas bypass valve 42 is controlled by sensor 48*a* to control a set low evaporating/suction pressure. If the evaporating pressure is reduced below the set evaporating/suction pressure limit the hot gas bypass valve 42 is actuated.

The quench valve 44 is an expansion valve device that controls refrigerant superheat at the mixer 46 exit. The quench valve 44 opens to increase refrigerant flow when the superheat increases and thus increases the refrigerant flow rate to recover an increase in superheat. The quench valve 44 closes the flow opening when the superheat is reduced, and thus reduces the refrigerant flow rate to recover lessened superheat. The mixer 46 mixes the vapor (first sub-portion) and two-phase mixture (refrigerant liquid and second sub-portion). The liquid portion evaporates, leaving the mixer 46 with the superheat controlled by the quench valve 44.

Figure 7B:
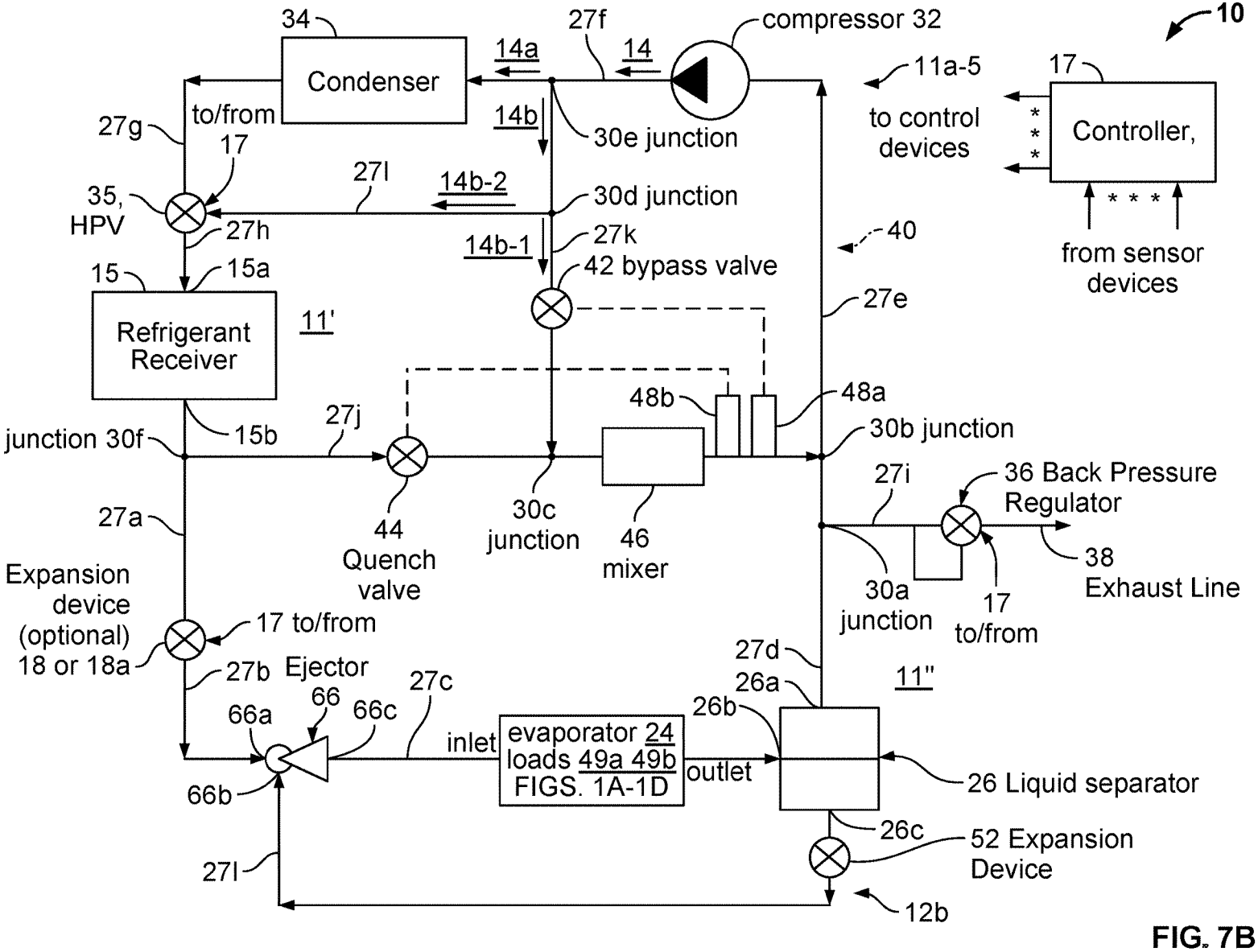

Referring now to FIG. 7B, the TMS 10 includes OCRSCCRS 11*a*-5 that includes the OCRS 11" integrated with the CCRS 11' and including the modulation circuit 40, with operation of the modulation circuit 40 as discussed above. The OCRS 11" of OCRSCCRS 11*a*-5 uses an alternative ejector assisted closed-circuit refrigeration system (E-OCRS) 12*b*.

CCRS 11' is the same as discussed in FIG. 7A, except that the evaporator 24 is disposed in a path between the ejector outlet 66*c* and the liquid separator inlet 26*b*. The E-OCRS 12*b* portion of the OCRS 11" is similar to E-OCRS 12*a* except for the loop circuit that comprises the evaporator 24 and expansion valve device 52 has the evaporator 24 disposed between the ejector outlet 66*c* and the liquid separator inlet 26*b*.

In OCRSCCRS 11*a*-5, the expansion valve device 52 is coupled between the liquid-side port 26*c* of the liquid separator 26 and the suction or secondary inlet 66*b* of the ejector 66. The vapor-side outlet 26*a* of the liquid separator 26 is coupled to a first port of the junction 30*a* and a second port of the junction 30*a* is coupled to the back-pressure regulator 36 that is coupled to the exhaust line 38. A third port of the junction 30*a* is coupled to the compressor 32 that in turn is coupled to the condenser 34 that is coupled to an inlet 15*a* to the receiver 15. Conduits 27*a*-271 couple the various aforementioned items as shown.

In OCRSCCRS 11*a*-5 with E-OCRS 12*b*, the recirculation rate is equal to the vapor quality at the evaporator exit. The expansion valve device 52 is optional, and when used, is a fixed orifice device. The control device 18 can be built in the motive nozzle of the ejector 66 and provides active control of the thermodynamic parameters of refrigerant state at the evaporator exit.

This embodiment of the OCRSCCRS 11*a*-5 operates as follows, with the back-pressure regulator 36 in a closed or off position:

Refrigerant from the receiver 15 is directed into the ejector 66 (optionally through an optional solenoid valve and an optional expansion valve device 18) and expands at a constant entropy in the ejector 66 (in an ideal case; in reality the nozzle is characterized by the ejector isentropic efficiency), and turns into a two-phase (vapor/liquid) state. The refrigerant in the two-phase state enters the evaporator 24 that provides cooling duty (to loads 49*a*, 49*b*) and discharges the refrigerant in a two-phase state at an exit vapor quality (fraction of vapor to liquid) below a unit vapor quality ("1"). The discharged refrigerant is fed to the inlet 26*b* of the liquid separator 26, where the liquid separator 26 separates the discharge refrigerant with only or substantially only liquid exiting the liquid separator 26 at outlet 26*c* (liquid-side port) and only or substantially only vapor exiting the separator 26 at outlet 26*a* the (vapor-side port). The vapor-side may contain some liquid droplets since the liquid separator 26 has a separation efficiency below a "unit" separation. The liquid stream exiting at outlet 26*c* enters and is expanded in the expansion valve device 52, if used, into a liquid/vapor stream that enters the suction or secondary inlet 66*b* of the ejector 66. The ejector 66 entrains the refrigerant flow exiting the expansion valve device 52 by the refrigerant from the refrigerant receiver 15.

In closed-circuit operation, the back-pressure regulator 36 is turned off and vapor from the liquid separator 26 is fed to the compressor 32 and condenser 34, as generally discussed above. In open-circuit operation, back-pressure regulator 36 is turned on and a portion of the vapor is exhausted through exhaust line 38, as generally discussed above. The modulation circuit 40 operates as discussed above.

In OCRSCCRS 11*a*-5, by placing the evaporator 24 between the outlet 66*c* of the ejector 66 and the inlet 26*b* of the liquid separator 26, OCRSCCRS 11*a*-5 avoids the necessity of having liquid refrigerant pass through the liquid separator 26 during the initial charging of the evaporator 24 with the liquid refrigerant, in contrast with the OCRSCCRS 11*a*-4 (FIG. 7A). At the same time liquid trapped in the liquid separator 26 may be wasted after the OCRSCCRS 11*a*-5 shuts down.

When a fixed orifice device is not used, the expansion valve device 18 can be an electrically controlled expansion valve that operate with sensors. For example the sensors can monitor vapor quality at the evaporator exit, pressure in the refrigerant receiver, pressure differential across the expansion valve device 18, pressure drop across the evaporator 24, liquid level in the liquid separator 26, power input into electrically actuated heat loads or a combination of the above.

Figure 7C:
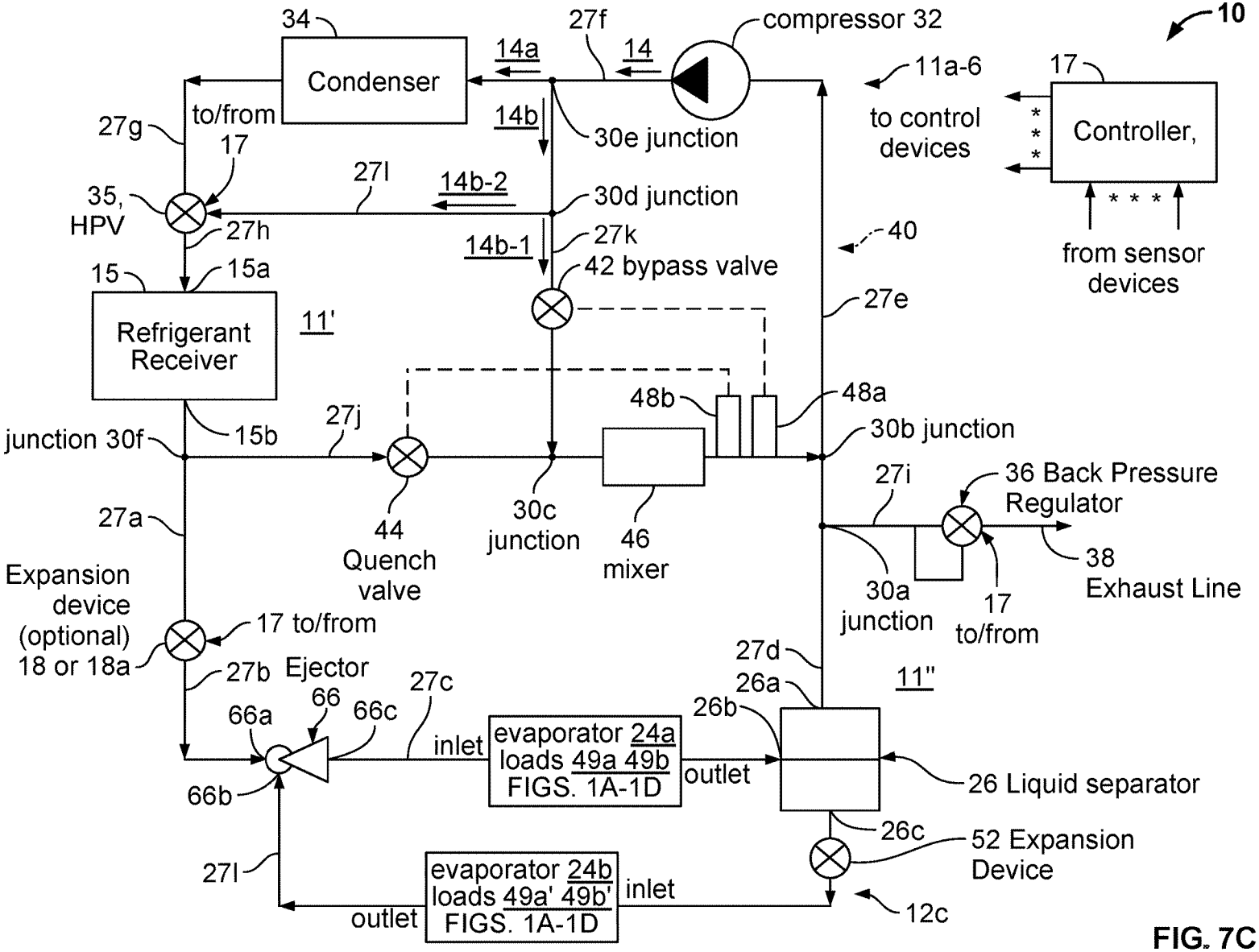

Referring now to FIG. 7C, the TMS 10 includes the OCRSCCRS 11*a*-6 that includes the OCRS 11' integrated with the CCRS 11'. The OCRS 11" of OCRSCCRS 11*a*-6 uses an alternative ejector assisted closed-circuit refrigeration system (E-OCRS) 12*c*.

The CCRS 11' is similar to or the same as discussed in FIG. 7A and FIG. 7B, and includes the modulation circuit 40, with operation of the modulation circuit 40, as discussed above. The OCRS 11" is also similar to that discussed in FIGS. 7A and 7B. The CCRS 11' and the OCRS 11" both include a loop circuit comprised of two evaporators 24*a*, 24*b* and the expansion valve device 52.

The CCRS 11', modulation circuit 40, and the E-OCRS 12*c* are in general as discussed above for the embodiments of FIGS. 7A and 7B, but include an evaporator 24*a* between outlet 66*c* of the ejector 66 and inlet 26*b* to the liquid separator 26, and evaporator 24*b* between the outlet of expansion valve device 52 and the secondary inlet 66*b* to the ejector 66. Thermal loads 49*a*, 49*b* are coupled to the evaporator 24*a*. The evaporator 24*a* is configured to extract heat from the load 49*a* that is in contact with or in proximity to the evaporator 24*a*. Thermal loads 49*a*', 49*b*' are coupled to the evaporator 24*b*. The evaporator 24*b* is configured to extract heat from the loads 49*a*', 49*b*' that are in contact with the evaporator 24*b*. Conduits 27*a*-27*m* couple the various aforementioned items, as shown.

The cooling capacities of the OCRSCCRS 11*a*-4 and 11*a*-5 of FIGS. 7A and 7B are sensitive to recirculation rates, while this configuration can operate with loads 49*a*', 49*b*' that allow for operation in superheated regions. The OCRSCCRS 11*a*-6 of FIG. 7C is not sensitive to recirculation rate, which may be beneficial when the heat loads may significantly reduce recirculation rate. An operating advantage of the OCRSCCRS 11*a*-6 is that by placing evaporators 24*a*, 24*b* at both the outlet 66*c* and the secondary inlet 66*b* of the ejector 66, it is possible to run the evaporators 24*a*, 24*b* combining the features of the configurations mentioned above.

Figure 7D:
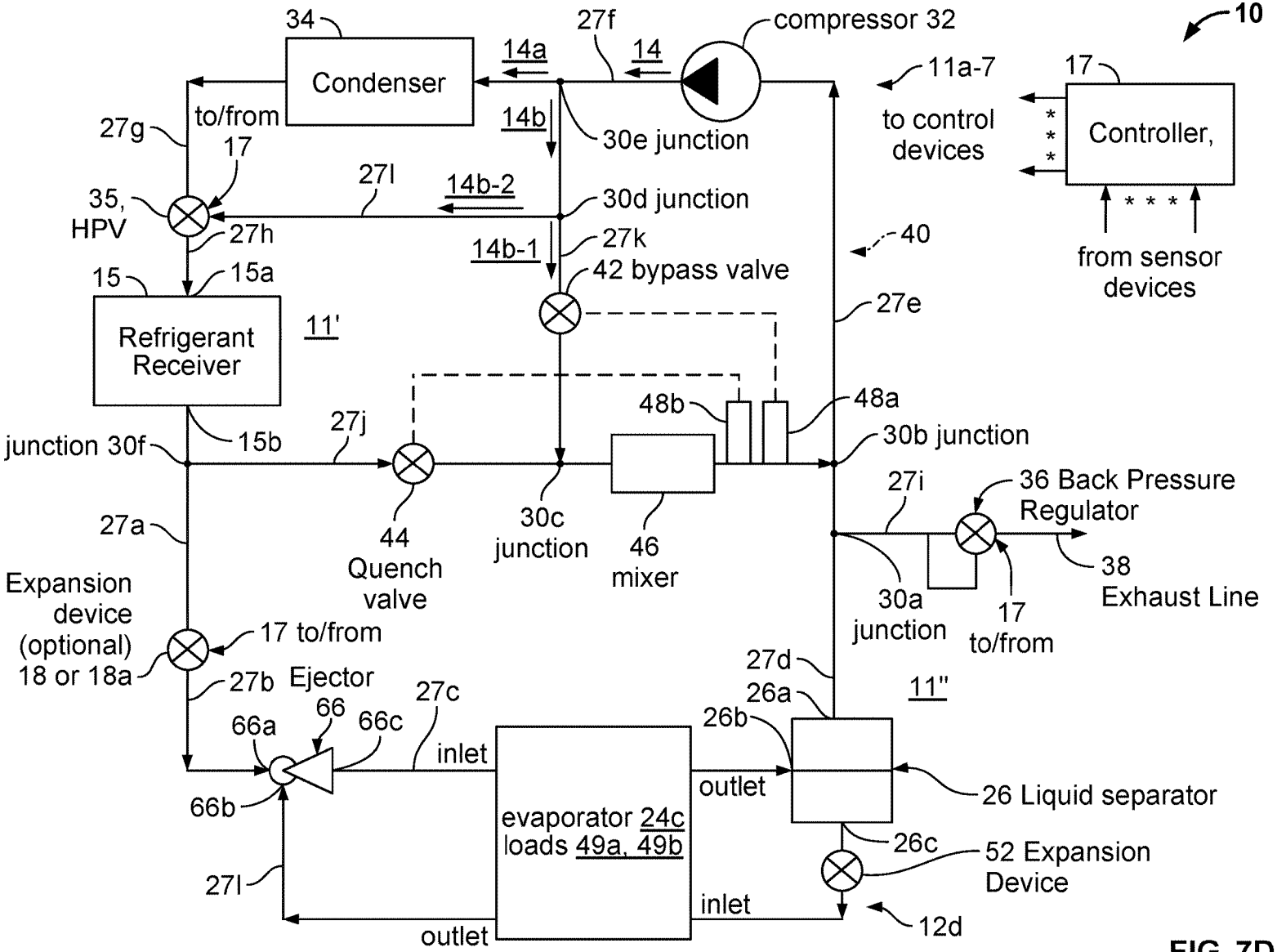

Referring now to FIG. 7D, the TMS 10 includes the OCRSCCRS 11*a*-7 that includes the OCRS 11" integrated with the CCRS 11' and includes the modulation circuit 40, with operation as discussed above. The OCRS 11" of OCRSCCRS 11*a*-7 uses another alternative ejector assisted closed-circuit refrigeration system (E-OCRS) 12*d*.

The OCRSCCRS 11*a*-7 with the alternative E-OCRS 12*d* is generally the same as FIGS. 7A-7C, except that the OCRSCCRS 11*a*-7 includes a single evaporator 24*c* that is attached downstream from and upstream of the ejector 66. The CCRS 11' includes the devices, as discussed above, and has a loop circuit comprised of the evaporator 24*c* and expansion valve device 52. The E-OCRS 12*d* portion of the OCRSCCRS 11*a*-7 includes the loop circuit comprised of the evaporator 24*c* and expansion valve device 52. Conduits 27*a*-271 couple the various aforementioned items, as shown.

The evaporator 24*c* has a first inlet that is coupled to the outlet 66*c* of the ejector 66 and a first outlet that is coupled to the inlet 26*b* of the liquid separator 26. The evaporator 24*c* has a second inlet that is coupled to the outlet of the expansion valve device 52 and has a second outlet that is coupled to the suction inlet 66*b* of the ejector 66. The vapor-side outlet 26*a* of the liquid separator 26 is coupled via the back-pressure regulator 36 to the exhaust line 38.

In this embodiment, the single evaporator 24*c* is attached downstream from and upstream of the ejector 66 and requires a single evaporator in comparison with the configuration of FIG. 7C having the two evaporators 24*a*, 24*b*. In OCRSCCRS 11*a*-7, the vapor-side outlet 26*a* of the liquid separator 26 is coupled to a first port of the junction 30*a* and a second port of the junction 30*a* is coupled to the back-pressure regulator 36 that is coupled to the exhaust line 38. A third port of the junction 30*a* is coupled to the compressor 32 that in turn is coupled to the condenser 34 and that is coupled to the receiver 15. Conduits 27*a*-27*m* couple the various aforementioned items as shown.

A first thermal load 49*a* is coupled to the evaporator 24*c*. The evaporator 24*c* is configured to extract heat from the first load 49*a* that is in contact with the evaporator 24*c*. A second thermal load 49*b* is also coupled to the evaporator 24*c*. The evaporator 24*c* is configured to extract heat from the second load 49*a* that is in contact with the evaporator 24*c*.

Figure 7E:
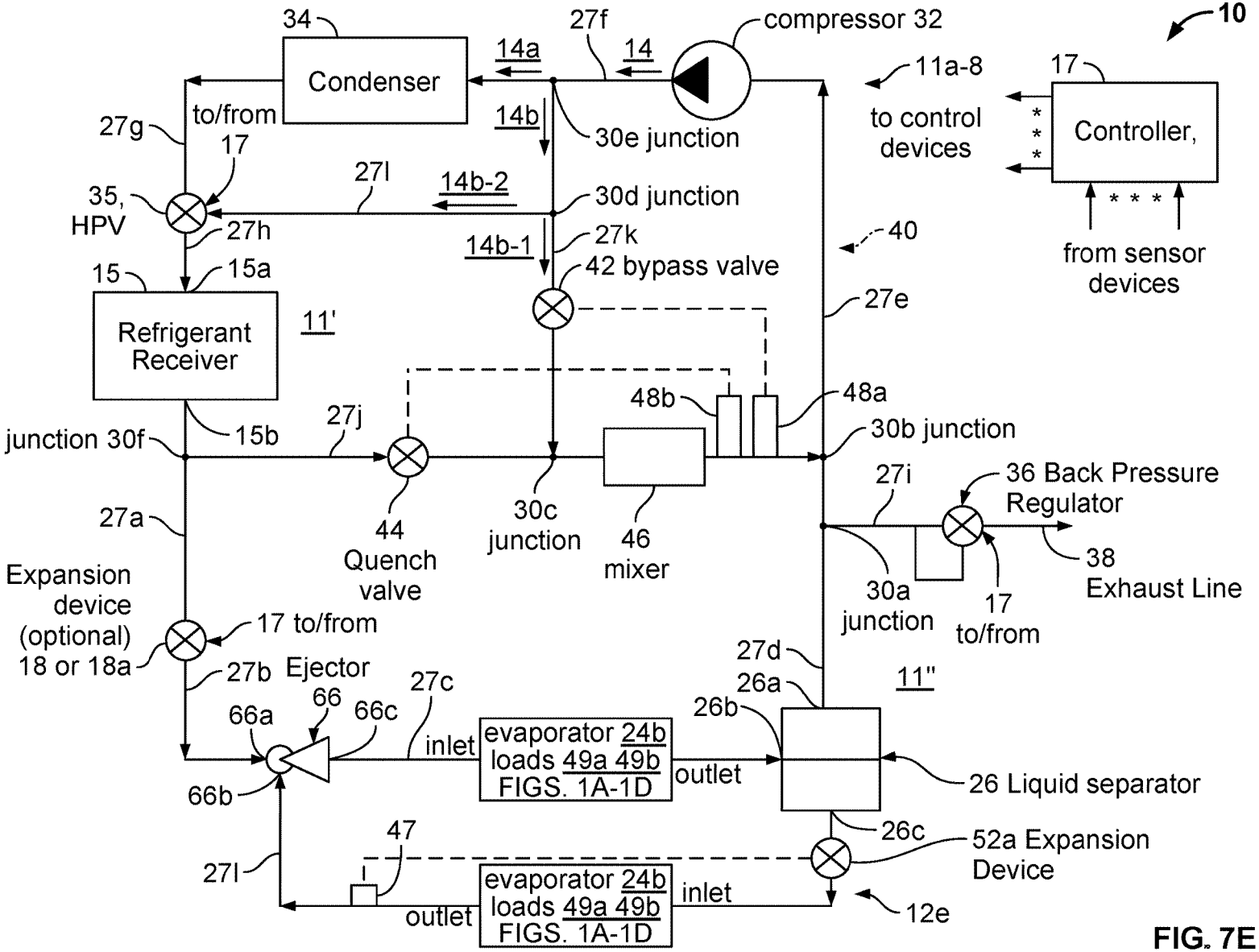

Referring now to FIG. 7E, the TMS 10 includes the OCRSCCRS 11*a*-8 that includes the OCRS 11" integrated with the CCRS 11' and including the modulation circuit 40, with operation as discussed above. The OCRS 11" of OCRSCCRS 11*a*-8 uses an alternative ejector assisted closed-circuit refrigeration system (E-OCRS) 12*e*.

The OCRSCCRS 11*a*-8 includes the devices as discussed in FIG. 7C, including the evaporators 24*a*, 24*b*. The thermal loads 49*a* and 49*b* are coupled to the evaporator 24*a* and the thermal loads 49*a*' and 49*b*' are coupled to the evaporator 24*b*, which evaporators are configured to extract heat from the loads 49*a*, 49*b* and 49*a*', 49*b*'. Conduits 27*a*-27*m* couple the various aforementioned items, as shown.

In this embodiment, the OCRSCCRS 11*a*-8 also includes an expansion valve device 52*a*. The expansion device 52*a* is a sensor-controlled expansion device, such as an electrically controlled expansion valve, as discussed above. The evaporators 24*a*, 24*b* operate in two-phase (liquid/vapor) and superheated region with controlled superheat. OCRSCCRS 11*a*-8 includes a controllable expansion valve device 52*a* that is attached to the liquid-side outlet 26*c* of the liquid separator 26 and to the evaporator 24, and having a control port that is fed from a sensor 47. The sensor-controlled expansion valve device 52*a* and sensor 47 provide a mechanism to measure and control superheat.

Closed-circuit and open-circuit operation as generally as discussed above for FIG. 7C, except for provision of the mechanism to measure and control superheat.

Referring now to FIG. 7F, the TMS 10 includes the OCRSCCRS 11*a*-9 that includes the OCRS 11" integrated with the CCRS 11' and including the modulation circuit 40, with operation as discussed above. The OCRS 11" of OCRSCCRS 11*a*-9 uses an alternative ejector assisted closed-circuit refrigeration system (E-OCRS) 12*f*.

The OCRSCCRS 11*a*-9 includes the evaporators 24*a*, 24*b* and the first thermal loads 49*a* and 49*a* and the second thermal loads 49*a*' and 49*b*' coupled to the evaporators 24*a* and 24*b* respectively, as FIG. 7C. The OCRSCCRS 11*a*-9 also includes a third thermal load 49*c* coupled to an evaporator 24*d* that is configured to extract heat from the load 49*c*. The evaporator 24*d* is coupled to an expansion valve device 51 that is disposed between the liquid-side outlet 26*c* of the liquid separator 26 and an inlet to the evaporator 24*d*. Conduits 27*a*-27*n* couple the various aforementioned items, as shown.

The evaporators 24*a*, 24*b* operate in two-phase (liquid/vapor) and the third evaporator 24*d* operates in superheated region with controlled superheat. OCRSCCRS 11*a*-9 includes the controllable expansion valve device 52*a* that has an inlet attached to the outlet 26*c* of liquid separator 26 and has an outlet attached to the evaporator 24*d*. The expansion valve device 52*a* has a control port that is fed from sensor 47. The sensor 47 controls the expansion valve device 52*a* and provides a mechanism to measure and control superheat at the evaporator 24*d*.

Closed-circuit and open-circuit operation as generally as discussed above for FIG. 7E, except for provision of the third evaporator 24*d*. In the various embodiments above, the vapor quality of the refrigerant fluid in open-circuit operation after passing through evaporator can be controlled either directly or indirectly with respect to a vapor quality set point by the controller 17.

In some embodiments, as shown in FIGS. 6A, 7E and 7F, the TMS 10 includes a sensor 43 or 47 that provide a measurement of superheat, and indirectly, vapor quality. For example, in FIG. 7E, sensor 47 is a combination of temperature and pressure sensors that measure the refrigerant fluid superheat downstream from the heat load and transmit the measurements to the controller 17. The controller 17 adjusts the expansion valve device 52*a* based on the measured superheat relative to a superheat set point value. By doing so, controller 17 indirectly adjusts the vapor quality of the refrigerant fluid emerging from evaporator 24*d*.

Figure 7G:
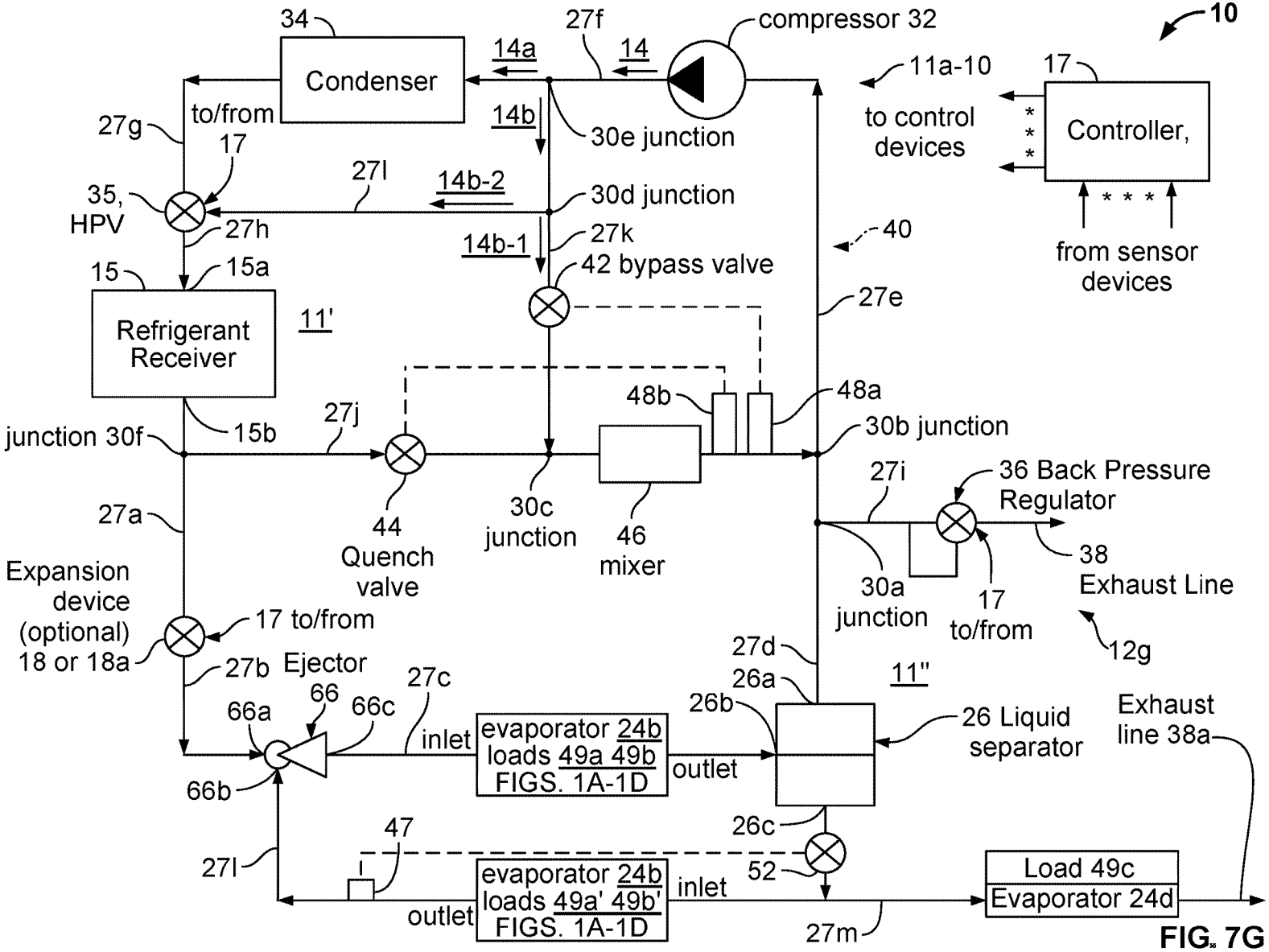
FIG. 7G is a schematic diagram of an example of a thermal management system that includes an open-circuit/closed-circuit refrigeration system with an ejector and the modulating capacity control circuit of FIG. 1 and with controlled superheat.

Referring now to FIG. 7G, the TMS 10 includes the OCRSCCRS 11*a*-10 that includes the OCRS 11" integrated with the CCRS 11' and including the modulation circuit 40, with operation as discussed above. The OCRS 11" of OCRSCCRS 11*a*-10 uses an alternative ejector assisted closed-circuit refrigeration system (E-OCRS) 12*g*.

The OCRSCCRS 11*a*-10 includes the devices as discussed in FIG. 7C, including the evaporators 24*a*, 24*b*. In this embodiment the OCRSCCRS 11*a*-10 also includes the third evaporator 24*d*, but that shares the same expansion valve, i.e., expansion valve device 52, as the evaporators 24*a*, 24*b*. The evaporators 24*a*, 24*b* operate in two-phase (liquid/vapor) and evaporator 24*d* operates in superheated region with controlled superheat. Conduits 27*a*-27*m* couple the various aforementioned items, as shown. Additional conduits (not referenced) couple the evaporator 24*d* to a second exhaust line 38*a* and second back-pressure regulator (not shown).

Figure 8:
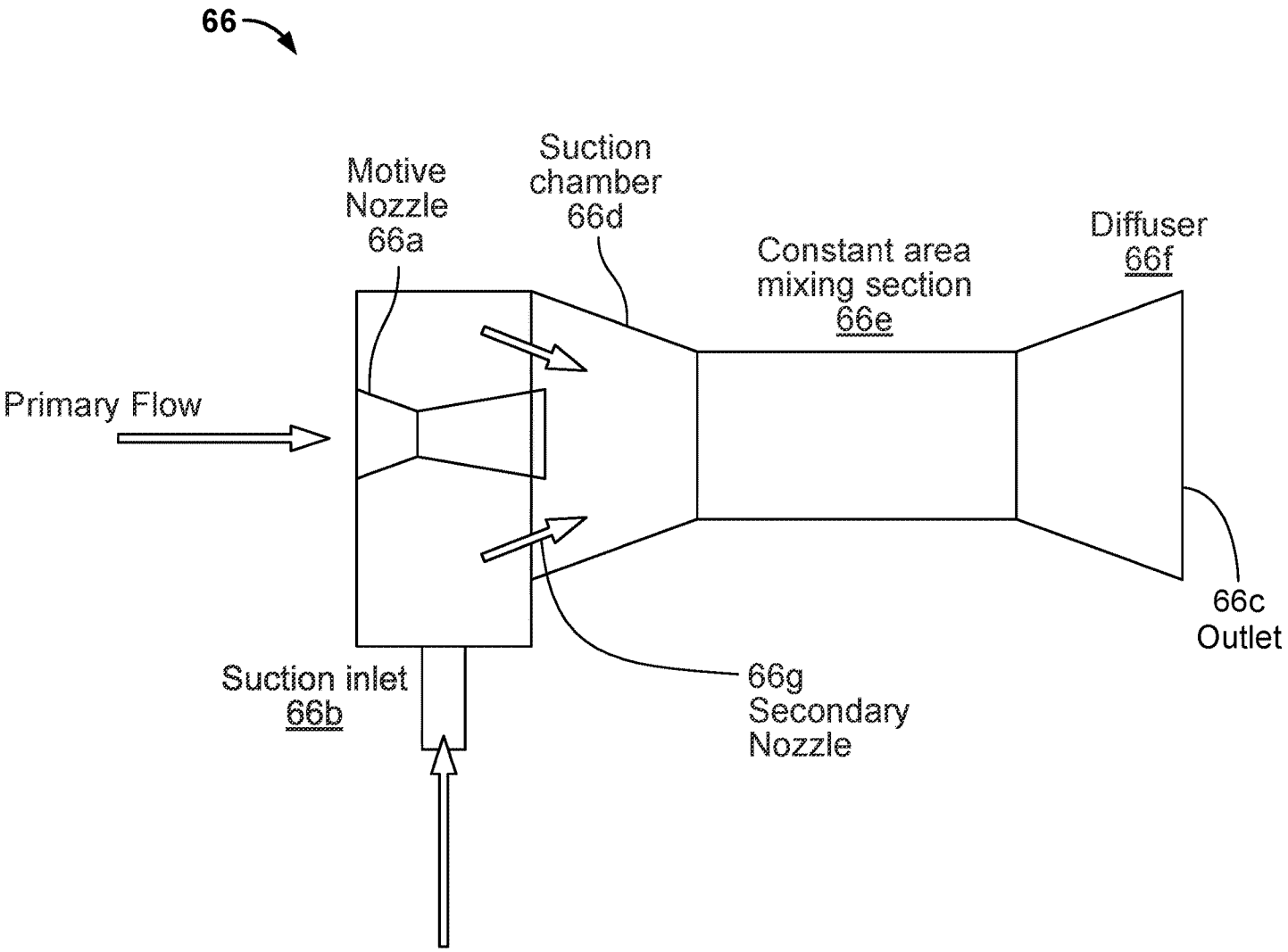
FIG. 8 is a schematic diagram of an ejector.

Referring now also to FIG. 8, a typical configuration for the ejector 66 is shown. This exemplary ejector 66 includes a motive nozzle 66*a* (or primary inlet), a suction inlet 66*b* (or secondary inlet), a secondary nozzle 66*g* that feeds a suction chamber 66*d*, a mixing chamber 66*e* for the primary flow of refrigerant and secondary flow of refrigerant to mix, and a diffuser 66*f*. In one embodiment, the ejector 66 is passively controlled by built-in flow control.

Liquid refrigerant from the refrigerant receiver 15 is the primary flow. In the motive nozzle 66*a* potential energy of the primary flow is converted into kinetic energy reducing the potential energy (the established static pressure) of the primary flow. The secondary flow from the outlet of the evaporator 24 has a pressure that is higher than the established static pressure in the suction chamber 66*d*, and thus the secondary flow is entrained through the suction inlet 66*b* (secondary inlet) and the secondary nozzle(s) internal to the ejector 66. The two streams (primary flow and secondary flow) mix together in the mixing section 66*e*. In the diffuser section 66*f*, the kinetic energy of the mixed streams is converted into potential energy elevating the pressure of the mixed flow liquid/vapor refrigerant that leaves the ejector 66 and is fed to the liquid separator 26.

In the context of open-circuit refrigeration systems, the use of the ejector 66 allows for recirculation of liquid refrigerant captured by the liquid separator 66 to increase the efficiency of the OCRS 11" of the TMS 10. That is, by allowing for some recirculation of refrigerant, but without the need for a compressor or a condenser, as in the CCRS 11', this recirculation reduces the required amount of refrigerant needed for a given amount of cooling of high heat loads 49*b* over a given period of operation of the OCRS 11".

Several alternatives can be used with the TMS system 10 that uses any of the OCRSCCRS variations 11*a*-4 to 11*a*-10. These alternative can use the recuperative heat exchanger 50 (as described in FIG. 6). One alternative would have the recuperative heat exchanger 50 coupled downstream from the junction 30*f* and downstream from the junction 30*a*, Another alternative of the TMS 10 would have the recuperative heat exchanger 50 of FIG. 6 coupled upstream of the junction 30*f* and the junction 30*a*, e.g., coupled to the outlet of the receiver 15 and the outlet of the junction device 30*b*. Another alternative to the TMS 10 using the recuperative heat exchanger 50 of FIG. 6 is to locate a first recuperative heat exchanger 50 downstream from the junction 30*f* and downstream from the junction 30*a* and a second recuperative heat exchanger (not shown) "above" line 15*b* and junction 30*b*, e.g., coupled to the outlet of the receiver 15 and the outlet of the junction device 30*b*, i.e., the TMS 10 would have two recuperative heat exchangers.

IV. Thermal Management Systems with Closed-Circuit Refrigeration System with Modulation Control Integrated with Open-Circuit Refrigeration Systems with Pump Assist FIGS. 9A-9F show pump assisted type alternative configurations 12*i*-12*n* for the OCRS 11" of OCRSCCRS's 11*a*-11 to 11*a*-16. Items illustrated and referenced, but not mentioned in the discussion below, are discussed and referenced in FIG. 1. Any of the configurations discussed in FIGS. 9A-9F can have the junction device 30*g* placed before or after the optional expansion valve 18 if included.

Figure 9A:
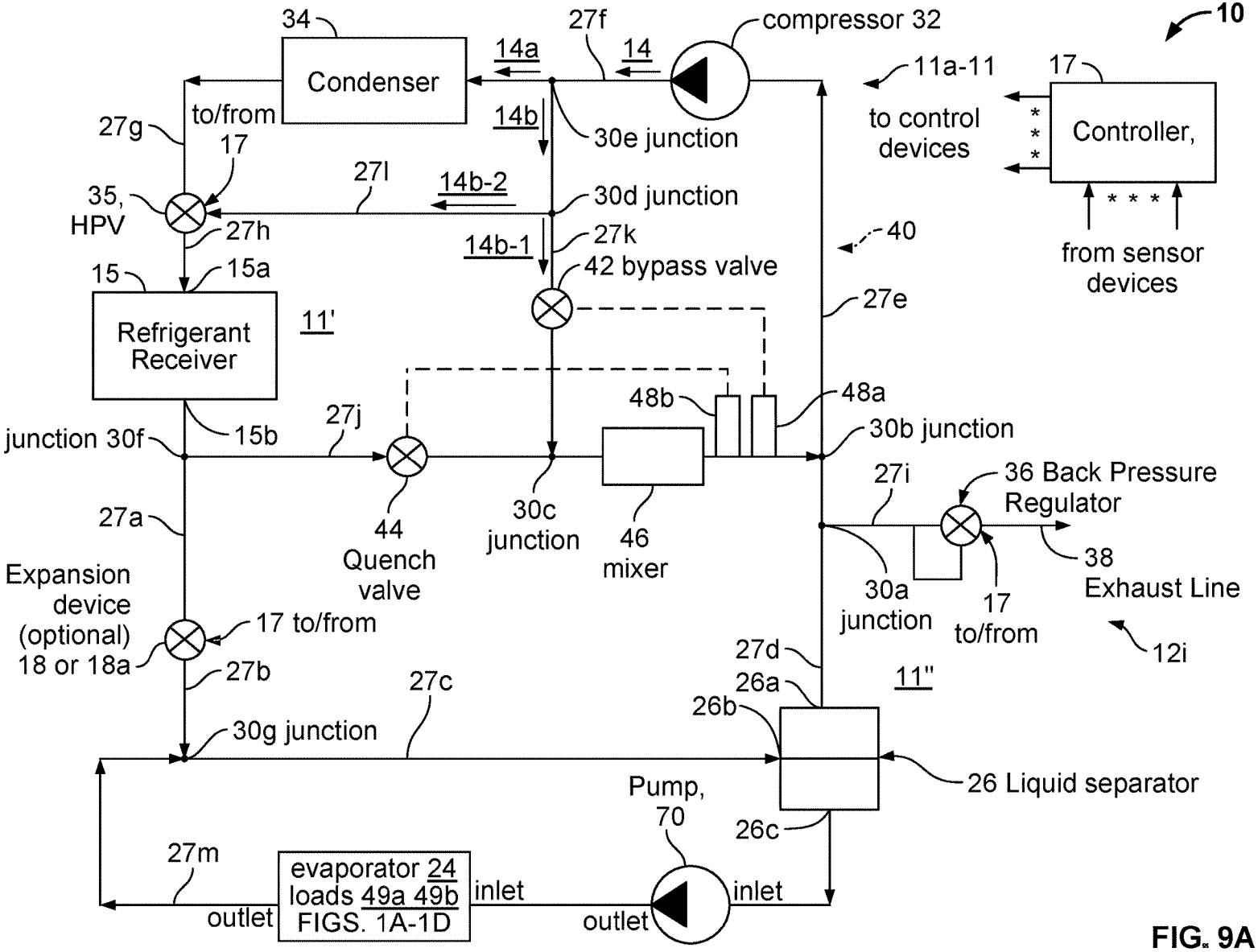
FIGS. 9A-9E are schematic diagrams of examples of a thermal management system that includes an open-circuit/closed-circuit refrigeration system with a pump and the modulating capacity control circuit of FIG. 1.

Referring now to FIG. 9A, the TMS 10 includes OCRSCCRS 11*a*-11 that has an OCRS 11" integrated with the CCRS 11' and includes the modulation circuit 40, with operation of the modulation circuit 40, as discussed above. The OCRS 11" of OCRSCCRS 11*a*-11 uses a pump assisted open-circuit refrigeration system (OCRSP) 12*i*. The OCRSP 12*i* portion of the OCRSCCRS 11*a*-11 is one of several OCRSP 12*i*-12*n* alternative configurations that will be discussed herein. The OCRSCCRS 11*a*-11 can include a plurality of refrigerant receivers (not shown).

CCRS 11' includes in addition to the modulation control circuit 40, receiver 15, expansion valve device 18, evaporator 24, a pump 70, liquid separator 26, compressor 32, condenser 34, and junction devices 30*a*, 30*b*, and 30*g*. The OCRS 11" is the OCRSP 12*i* and includes the receiver 15, the expansion valve device 18, evaporator 24, liquid separator 26, the pump 70, and back-pressure regulator 36 that feeds exhaust line 38.

CCRS 11' provides cooling for low heat loads over long time intervals while the open-circuit refrigeration system 11" provides cooling for high heat loads over short time intervals is shown, as generally discussed above. The TMS 10 includes the OCRSCCRS 11*a*-11 and the heat loads 49*a*, 49*b*. The heat load 49*a* is a low heat load 49*a* whereas the high heat load 49*b* is a high heat load 49*b*, as discussed above.

The junction device 30*f* has the first port coupled to the receiver 15, a second port coupled to quench valve 44, and a third port coupled to expansion valve device 18. Junction device 30*g* has a first port coupled to the outlet of the expansion valve device 18, a second port coupled to the inlet 26*b* of the liquid separator 26, and a third port coupled to the outlet of the evaporator 24. The pump 70 has an inlet coupled to the liquid-side outlet 26*c* of the liquid separator 26 and an outlet coupled to an inlet of the evaporator 24.

The vapor-side outlet 26*a* of the liquid separator 26 is coupled to via junction 30*a* to an inlet (not referenced) of the compressor 32 that controls a vapor pressure in the evaporator 24 and feeds vapor to the condenser 34. The liquid separator 26 vapor outlet 26*a* is coupled to one port of the junction device 30*a* that feeds compressor 32 and the back-pressure regulator 36. The back-pressure regulator 36 has an outlet that feeds an exhaust line 38. The liquid-side outlet 26*c* of the liquid separator 26 is coupled to an inlet of the pump 70. Conduits 27*a*-271 couple the various aforementioned items as shown.

In OCRSCCRS 11*a*-11, the pumped liquid from the pump 70 is fed directly into the inlet to the evaporator 24 along with the primary refrigerant flow from the expansion valve device 18. These liquid refrigerant steams from the refrigerant receiver 15 and the pump 70 are mixed downstream from the expansion valve device 18 in the junction 30*g*. Thermal loads 49*a*, 49*b* are coupled to the evaporator 24. The evaporator 24 is configured to extract heat from the loads 49*a*, 49*b* and to control the vapor quality at the outlet of the evaporator 24.

The modulating capacity/temperature control circuit 40 modulates cooling of temperature varying heat loads, as discussed above. The modulating capacity/temperature control circuit 40 adds modulated capacity control to the CCRS 11'. The system 10 with the modulating capacity control circuit 40 can generate any capacity in the capacity range of zero to full capacity of the system 10 to satisfy various heat loads in a heat load range from 0 to the full load. The modulating capacity control circuit 40 includes the head pressure control valve 35, a bypass valve 42, a quench valve 44, and a mixer 46. The quench valve 44, the hot gas bypass valve 42, and the head pressure control valve 35 are available as mechanical devices with built in control capability or as electronic devices.

The bypass valve 42 is coupled between an outlet of the compressor 32, via junction devices 30*d* and 30*e*, and a junction device 30*c*. The bypass valve 42 is controlled or responsive to a control signal that comes either from a sensor 48*a* (or indirectly from the sensor 48*a* via the controller 17). The quench valve 44 is coupled between the outlet of the receiver 15 and a port of the junction device 30*c*. The quench valve 44 is controlled or responsive to a control signal that comes either from a sensor 48*b* (or indirectly from the sensor 48*b* via the controller 17). The mixer 46 is coupled to another port of the junction 30*c* and a port of the junction 30*b* and along the conduit that couples the mixer 46 to junction 30*b* are disposed the sensors 48*a*, 48*b*. The junction 30*d* is coupled via conduit 27*l* to an inlet to the head pressure control valve 35.

A. Closed-Circuit Refrigeration Operation

The OCRSCCRS 11*a*-11 operates as follows. The back-pressure regulator 36 is placed in an OFF position. Under closed-circuit refrigeration operation circulating refrigerant enters the compressor 32 as a saturated or superheated vapor and is compressed to a higher pressure at a higher temperature (a superheated vapor). This superheated vapor is at a temperature and pressure at which it can be condensed in the condenser 34 by either cooling water or cooling air flowing across a coil or tubes in the condenser 34. Compressed circulating refrigerant fluid (denoted by arrow 14) exits from the compressor 32 and enters junction 30*e*. In FIG. 9A, a first portion (denoted by arrow 14*a*) of the compressed circulating refrigerant 14, via junction 30*e*, is fed to the condenser 34 and a second portion (denoted by arrow 14*b*) of the compressed circulating refrigerant 14 is fed to the modulating capacity control circuit 40.

At the condenser 34, the first portion 14*a* of the circulating refrigerant loses heat and thus removes heat from the system 10, which removed heat is carried away by either the water or air (whichever may be the case) flowing over the coil or tubes, providing a condensed liquid refrigerant. The first portion 14*a* of the circulating refrigerant is routed into the refrigerant receiver 15, exits the refrigerant receiver 15, and enters the optional control device, e.g., the optional expansion valve device 18 (through the optional solenoid valve, if used.) The refrigerant is enthalpically expanded in the expansion valve device 18 and the high pressure sub-cooled liquid refrigerant turns into liquid-vapor mixture at a low pressure and temperature. The temperature of the liquid and vapor refrigerant mixture (evaporating temperature) is lower than the temperature of the low heat load 49*a*. The mixture is directed to the inlet 26*b* of the liquid separator 26.

Vapor exits the vapor port 26*a* of the liquid vapor separator 26 and is returned to the compressor 32, whereas a liquid portion exits from the liquid outlet 26*c* of the liquid separator 26 and enters the pump 70. The liquid stream that exits the liquid separator 26 and that enters the pump 70 is pumped into the evaporator 24 that provides cooling duty and discharges the refrigerant in a two-phase state at a relatively high exit vapor quality (fraction of vapor to liquid). The discharged refrigerant is fed to the second inlet of the junction 30*g*. Vapor from the vapor-side 26*a* of the liquid separator 26 is fed to the compressor 32 on to the condenser 34 and back into the receiver 15 for closed-circuit operation.

At the outlet of the pump 70, the evaporator 24 is where the circulating refrigerant absorbs and removes heat from the applied low heat load 49*a* which heat is subsequently rejected in the condenser 34 and transferred to an ambient by water or air used in the condenser 34. To complete the refrigeration cycle, the refrigerant vapor from the evaporator 24 is returned to the junction 30*g* and stored in the liquid separator 26 and again a saturated vapor portion of the refrigerant in the liquid separator 26 is routed back into the compressor 32.

The second portion 14*b* of the compressed circulating refrigerant is split into a first sub-portion (denoted by arrow 14*b*-1) and a second sub-portion (denoted by arrow 14*b*-2). The hot gas bypass valve 42 receives the first compressed circulating refrigerant sub-portion 14*b*-1 from the junction device 30*d*, bypassing the condenser 34, the receiver 15, the expansion valve device 18, and the evaporator 24, and directs the compressed circulating refrigerant sub-portion 14*b*-1 into the junction 30*c*. This first compressed circulating refrigerant sub-portion 14*b*-1 is enthalpically expanded from a high pressure to a low pressure in the bypass valve 42 under control of the sensor 48*a*.

The second compressed circulating refrigerant sub-portion 14*b*-2 is directed to the head pressure valve 35 that feds the second compressed circulating refrigerant sub-portion into the refrigerant receiver 15. The output 15*b* of the refrigerant receiver 15 is coupled to the quench valve 44. The quench valve 44 has an output that is coupled to the junction 30*c*. Junction 30*c* is coupled to an input to the mixer 46. An output of the mixer 46 is coupled to the junction 30*b*. The quench valve 44 directs and enthalpically expands the second sub-portion of the compressed liquid refrigerant from high pressure to low pressure, bypassing the expansion valve 18, liquid separator 26, and the evaporator 24.

As discussed above, when the OCRS 11" is off, the steady-state CCRS 11' provides temperature control of continuous loads. Thus, the hot gas bypassed, i.e., the first sub-portion 14*b*-1, and second sub-portion 14*b*-2 that is fed into the receiver 15 and is involved with the liquid flow stream from the receiver 15, both bypass the evaporator 24 to appropriately accommodate the reduced heat load. The mixer 46 operates as a mixing heat exchanger providing direct contact of the expanded vapor stream and two-phase mixture formed after the expansion of the liquid stream at the low pressure.

The hot gas bypass valve 42 as controlled by sensor 48*a* controls a set low evaporating/suction pressure. If the evaporating pressure is reduced below the set evaporating/suction pressure limit the hot gas bypass valve 42 is actuated. The quench valve 44 is an expansion valve device that controls refrigerant superheat at the mixer 46 exit. The quench valve 44 opens a flow opening when the superheat increases and thus increases the refrigerant flow rate to recover an increase in superheat. The quench valve 44 closes the flow opening when the superheat is reduced, and thus reduces the refrigerant flow rate to recover lessened superheat. The mixer 46 mixes the vapor (first sub-portion 14*b*-1) and two-phase mixture (refrigerant liquid and second sub-portion 14*b*-2). The liquid portion evaporates, leaving the mixer 46 with the superheat controlled by the quench valve 44.

Condensing temperature depends on ambient temperature. When ambient temperature is low the condensing pressure temperature is low as well. At a certain low condensing pressure, pressure difference between the condensing and evaporating pressures and compressor discharge and suction pressures become very low and unacceptable for the compressor 32, the expansion valve device 18, and the quench valve 44. The head pressure control valve 35 is provided to control the condensing pressure above the set limit.

An approach for maintaining normal head pressure in the refrigeration system during periods of low ambient temperature is to restrict liquid flow from the condenser 34 in the CCRS 11' to the refrigerant receiver 15. At the same time, the modulating capacity control circuit 40 diverts hot gas to the inlet 15*a* of the receiver 15. This diversion backs liquid refrigerant up into the condenser 34 reducing the condenser capacity, which in turn, increases condensing pressure. However, at the same time the hot gas raises liquid pressure in the receiver, allowing the system to operate normally.

B. Open/Closed-Circuit Refrigeration Operation

On the other hand, when a high heat load 49*b* is applied, a mechanism such as the controller 17 causes the OCRSCCRS 11*a*-11 to operate in both a closed and open cycle configuration, as discussed above. The closed cycle portion would be similar to that described above under the heading "Closed-circuit Refrigeration Operation."

The OCRS 11" has the controller 17 configured to cause the back-pressure regulator 36 to be placed in an ON position, opening the back-pressure regulator 36 to permit the back-pressure regulator 36 to exhaust vapor through the exhaust line 38. The back-pressure regulator 36 maintains a back pressure at an inlet to the back-pressure regulator 36, according to a set point pressure, while allowing the back-pressure regulator 36 to exhaust refrigerant vapor to the exhaust line 38.

In OCRSCCRS 11*a*-11, the pump 70 in the OCRSP 12*i* can operate across a reduced pressure differential (pressure difference between inlet and outlet of the pump 70). In the context of open-circuit refrigeration systems, the use of the pump 70 allows for some recirculation of liquid refrigerant from the liquid separator 26 to enable operation at reduced vapor quality at the evaporator 24 outlet, that also avoids discharging remaining liquid out of the system at less than the separation efficiency of the liquid separator 26 allows. This recirculation reduces the required amount of refrigerant needed for a given amount of cooling over a given period of operation. The configuration above reduces the vapor quality at the evaporator 24 inlet and thus may improve refrigerant distribution (of the two-phase mixture) in the evaporator 24.

During start-up OCRSCCRS 11*a*-11 needs to charge the evaporator 24 with liquid refrigerant, via the liquid separator 26 and pump 70.

Various types of pumps can be used for pump 70. Exemplary types include gear, centrifugal, rotary vane, types. When choosing a pump, the pump should be capable of withstanding the expected fluid flows, including criteria such as temperature ranges for the fluids, and materials of the pump should be compatible with the properties of the fluid. A subcooled refrigerant can be provided at the pump 70 outlet to avoid cavitation. To do that a certain liquid level in the liquid separator 26 may provide hydrostatic pressure corresponding to that sub-cooling.

Figure 9B:
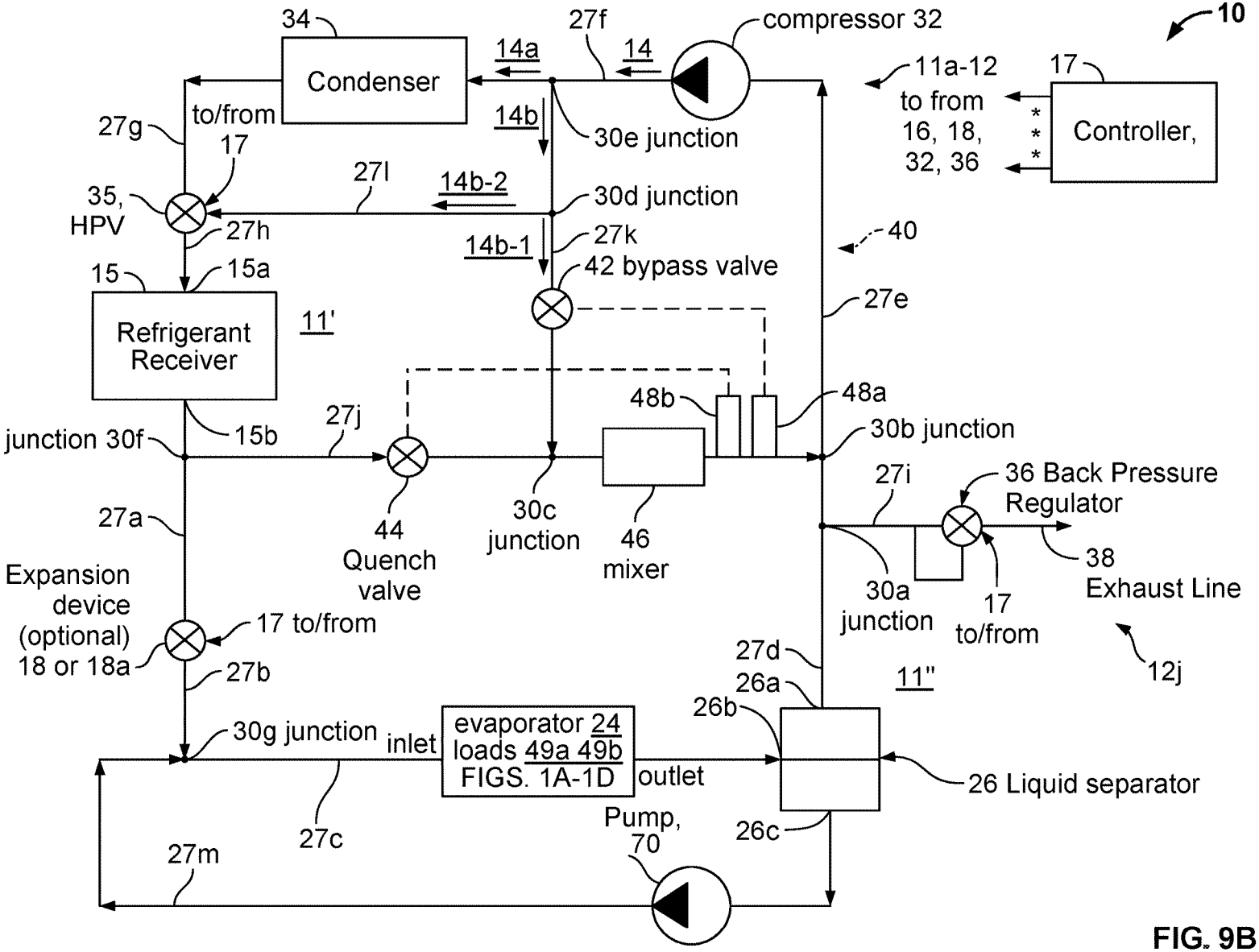

Referring now to FIG. 9B, the TMS 10 includes OCRSCCRS 11*a*-12 that has the OCRS 11" integrated with the closed-circuit refrigeration system CCRS 11' and includes the modulation circuit 40, with operation of the modulation circuit 40, as discussed above. This alternative OCRSCCRS 11*a*-12 uses pump assisted open-circuit refrigeration system (OCRSP) 12*j*, with the evaporator 24 having an inlet coupled to the outlet of the expansion valve device 18 and an outlet coupled to the inlet 26*b* of the liquid separator 26. The liquid refrigerant from the refrigerant receiver 15 mixes with an amount of pumped refrigerant from the pump 70 and expands at a constant enthalpy in the expansion valve device 18. The expansion valve device 18 turns the liquid into a two-phase mixture. The two-phase mixture stream enters the evaporator 24. The evaporator 24 absorbs the heat load and liquid/vapor from the evaporator 24 enters the liquid separator 26. The refrigerant liquid stream exiting the liquid separator 26 is pumped by the pump 70 back into the evaporator 24 via the junction device 30*g*. In this configuration, the pump 70 pumps a secondary liquid refrigerant fluid flow, e.g., a recirculation liquid refrigerant flow from the evaporator 24, via the liquid separator 26, back via the junction 30*g* into the evaporator 24.

The evaporator 24 may be configured to maintain exit vapor quality below the so called "critical vapor quality" defined as "1." Vapor quality is the ratio of mass of vapor to mass of liquid+vapor and in the systems herein is generally kept in a range of approximately 0.5 to almost 1.0; more specifically 0.6 to 0.95; more specifically 0.75 to 0.9 more specifically 0.8 to 0.9 or more specifically about 0.8 to 0.85. "Vapor quality" is thus defined as mass of vapor/total mass (vapor+liquid). In this sense, vapor quality cannot exceed "1" or be equal to a value less than "0," as discussed above.

Figure 9C:
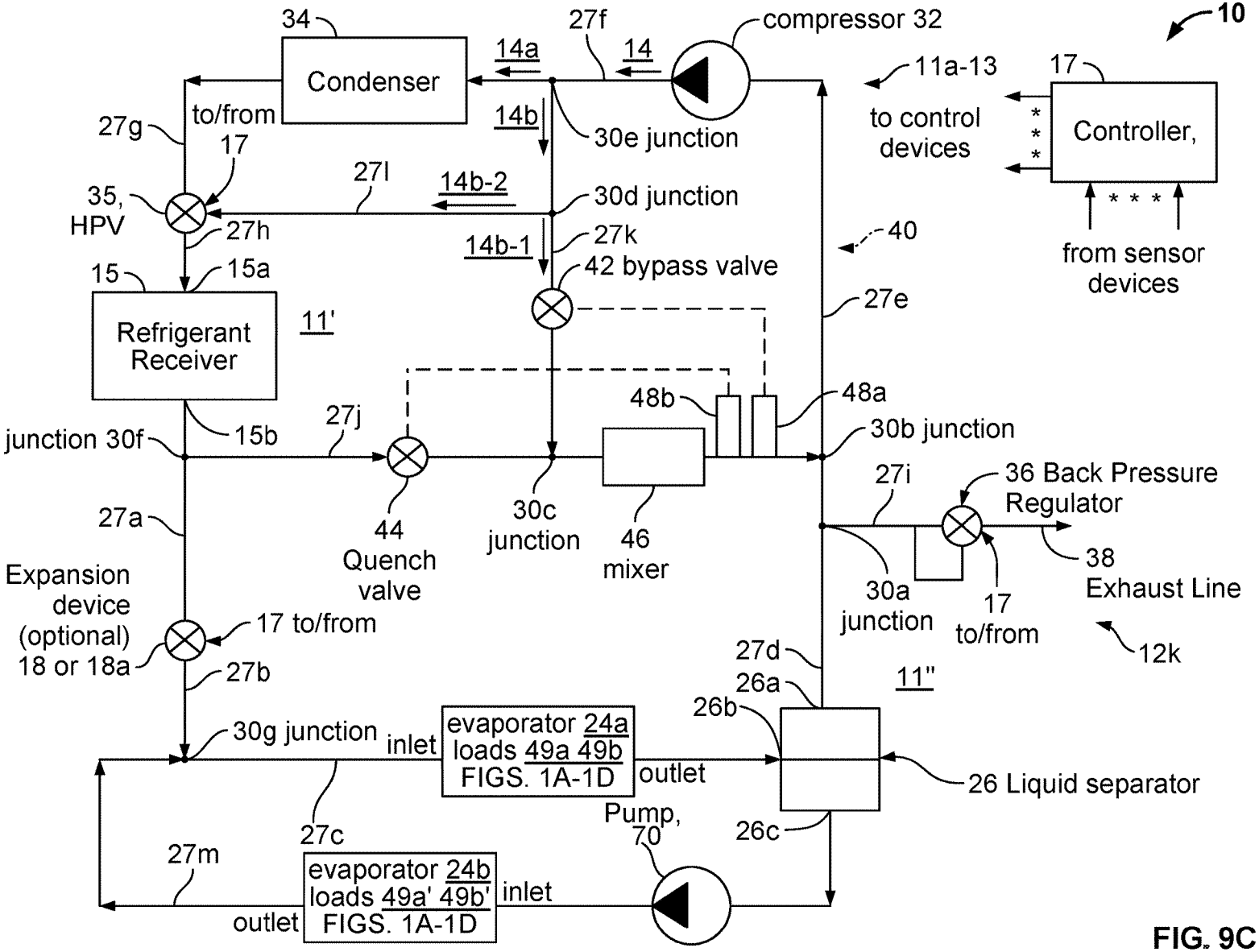

Referring now to FIG. 9C, an alternative OCRSCCRS 11*a*-13 is shown that has the OCRS 11" integrated with the closed-circuit refrigeration system CCRS 11' and includes the modulation circuit 40, with operation of the modulation circuit 40, as discussed above. OCRSCCRS 11*a*-13 includes the functional components of FIG. 9A, as discussed above, but uses the pump assisted open-circuit refrigeration system (OCRSP) 12*k* that has a first evaporator 24*a* coupled between the outlet of the junction device 30*g* and the inlet 26*b* of the liquid separator 26 (as evaporator 24 FIG. 8A) and a second evaporator 24*b* having an inlet that is coupled to the outlet of the pump 70 and having an outlet coupled to a second inlet of the junction device 30*g*. The vapor-side outlet 26*a* of the liquid separator 26 is coupled via junctions 30*a* and 30*b* to an inlet (not referenced) of the compressor 32 that controls a vapor pressure in the evaporator 24 and feeds vapor to the condenser 34. The liquid separator 26 vapor outlet 26*a* is coupled to one port of the junction device 30*a*, which is also coupled to the back-pressure regulator 36. The back-pressure regulator 36 has an outlet that feeds an exhaust line 38. The liquid-side outlet 26*c* of the liquid separator 26 is coupled to an inlet of the pump 70.

Thermal loads 49*a*, 49*a* are coupled to the evaporator 24*a* and thermal loads 49*a*', 49*b*' are coupled to the evaporator 24*b*. The evaporators 24*a*, 24*b* are configured to extract heat from the respective loads 49*a*, 49*b*; 49*a*', 49*b*' that are in contact with the corresponding evaporators 24*a*, 24*b*. Conduits 27*a*-27*k* couple the various aforementioned items as shown.

An operating advantage of the OCRSCCRS 11*a*-13 is that by placing evaporators 24*a*, 24*b* at both the outlet and the second inlet of the junction device 30*g*, it is possible to combine loads which require operation in two-phase region and which allows operation with a superheat.

Figure 9D:
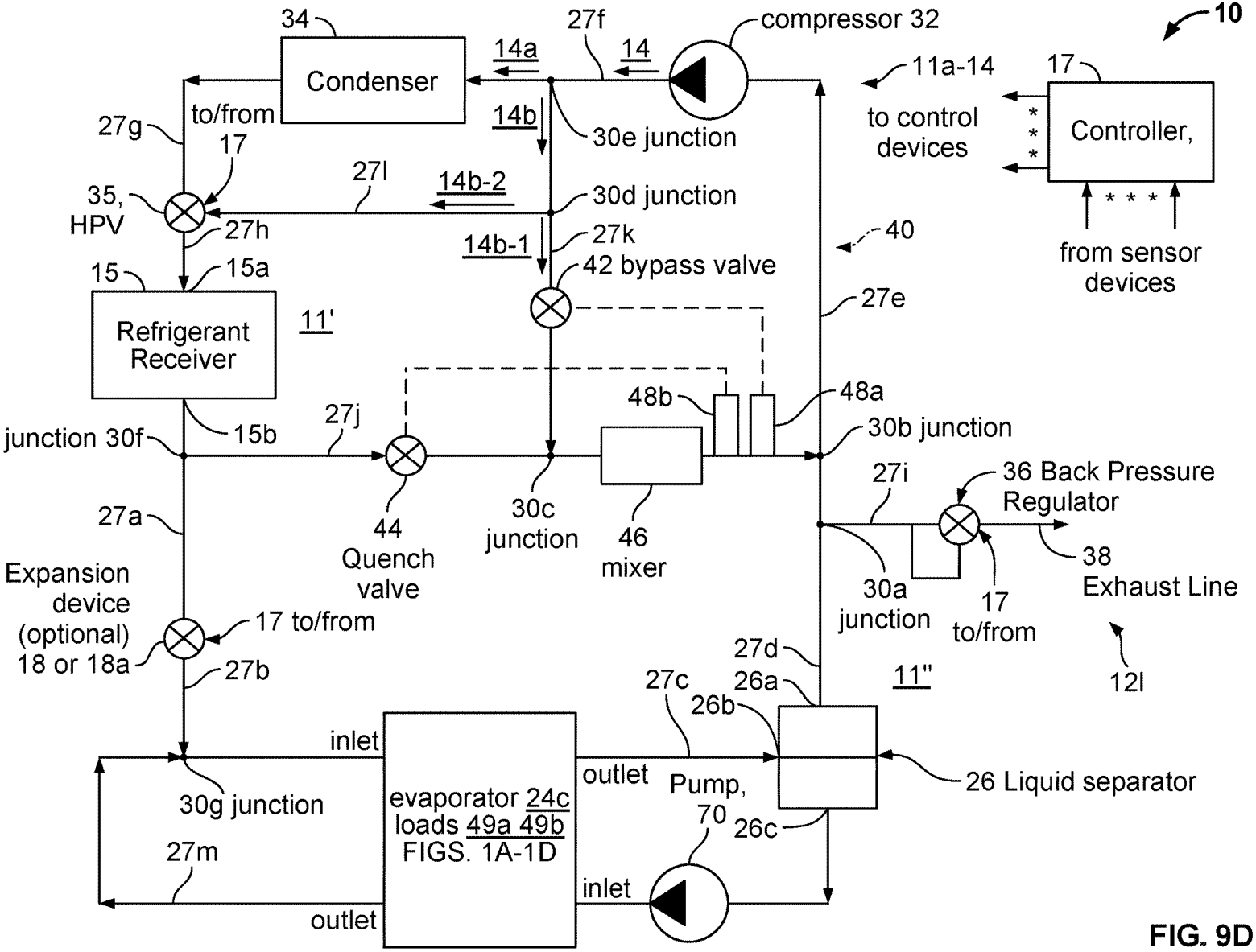

Referring now to FIG. 9D, an alternative OCRSCCRS 11*a*-14 is shown that has the OCRS 11" integrated with the closed-circuit refrigeration system CCRS 11' and includes the modulation circuit 40, with operation of the modulation circuit 40, as discussed above. OCRSCCRS 11*a*-14 includes the functional components of FIG. 9A, as discussed above, but uses the pump assisted open-circuit refrigeration system (OCRSP) 121 that has a single evaporator 24*c* coupled between the outlet of the junction device 30*g*, the inlet 26*b* of the liquid separator 26, the outlet of the pump 70, and the second inlet of the junction device 30*g*. OCRSCCRS 11*a*-14 includes the functional components, as discussed above for FIG. 9A but includes the single evaporator 24*c* that is attached downstream from and upstream of the junction device 30*g*. A first thermal load 49*a* is coupled to the evaporator 24*c*. The evaporator 24*c* is configured to extract heat from the first load 49*a* that is in contact with the evaporator 24*c*. A second thermal load 49*b* is also coupled to the evaporator 24*c*. The evaporator 24*c* is configured to extract heat from the second load 49*b* that is in contact with the evaporator 24*c*.

Figure 9E:
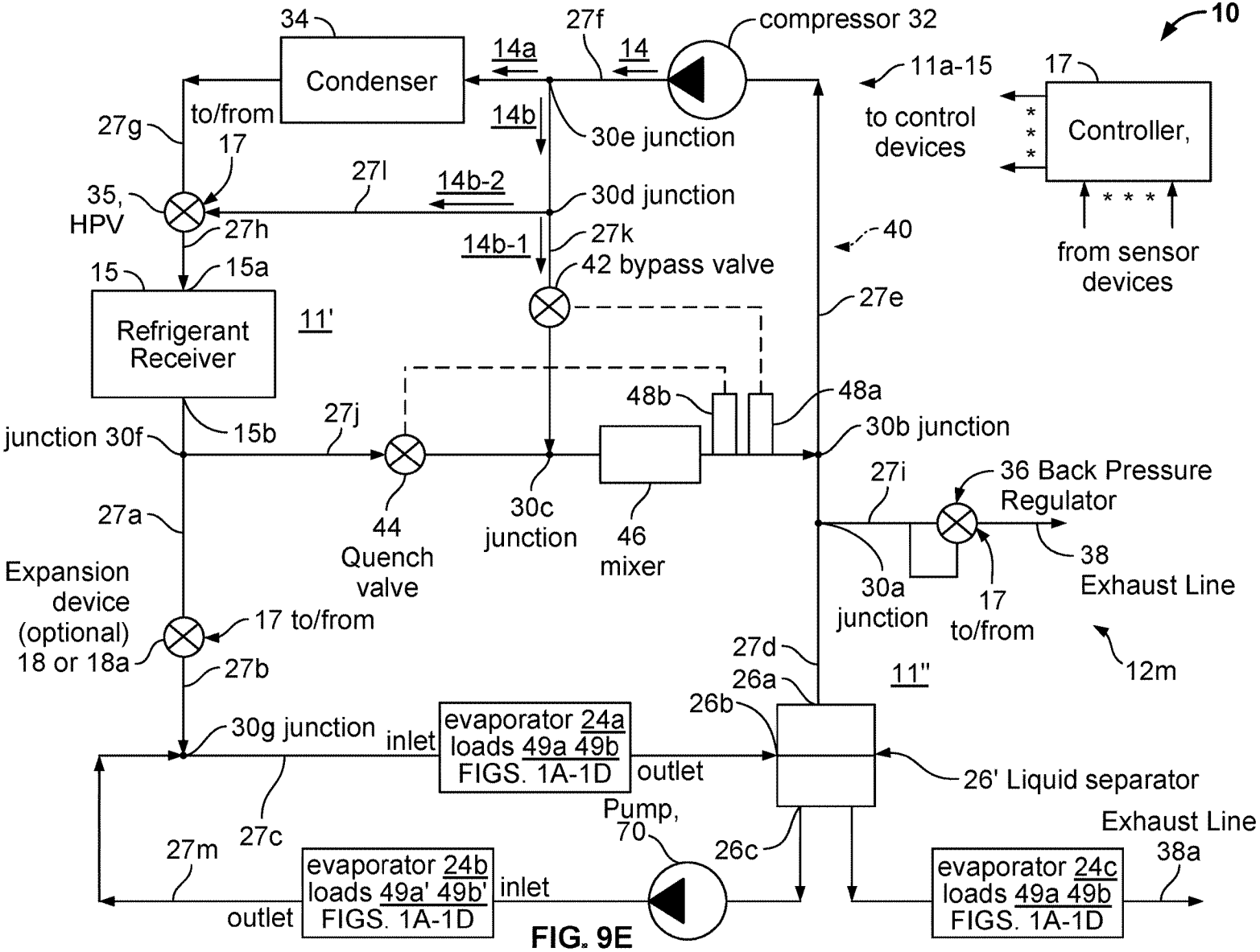

Referring now to FIG. 9E, an alternative OCRSCCRS 11*a*-15 is shown that has the OCRS 11" integrated with the closed-circuit refrigeration system CCRS 11' and includes the modulation circuit 40, with operation of the modulation circuit 40, as discussed above. OCRSCCRS 11*a*-15 includes the functional components of FIG. 9A, as discussed above, but uses the pump assisted open-circuit refrigeration system OCRSP 12*m* that has a liquid separator 26', configured to have a second outlet (such a function could be provided with another junction device). The second outlet diverts a portion of the liquid exiting the liquid separator 26' into a third evaporator 24*c* that is in thermal contact with a load 49*c* and which extracts heat from the load 49*c* and exhausts vapor from a second vapor exhaust line 38*a*.

An operating advantage of the OCRSCCRS 11*a*-15 is that by placing evaporators 24*a*, 24*b* at both the outlet and the second inlet of the junction device 30*g*, it is possible to run the evaporators 24*a*, 24*b* with changing refrigerant rates through the junction device 30*g* to change at different temperatures or change recirculating rates. By using the evaporators 24*a*, 24*b*, the configuration reduces vapor quality at the outlet of the evaporator 24*b* and thus increases circulation rate, as the pump 70 would be 'pumping' less vapor and more liquid. That is, with OCRSP 12*m* the evaporator 24*b* is downstream from the pump 70 and better refrigerant distribution could be provided with this component configuration since liquid refrigerant enters the evaporator 24*b* rather than a liquid/vapor stream as could be for the evaporator 24*a*.

In addition, some heat loads that may be cooled by an evaporator in the superheated phase region, at the same time do not need to actively control superheat. OCRSCCRS 11*a*-15 employs the additional evaporator circuit 24*c* cooling heat load(s) in two-phase and superheated regions. The exhaust lines 38, 38*a* may or may not be combined. The third evaporator 24*c* can be fed a portion of the liquid refrigerant and operate in superheated region without the need for active superheat control.

Figure 9F:
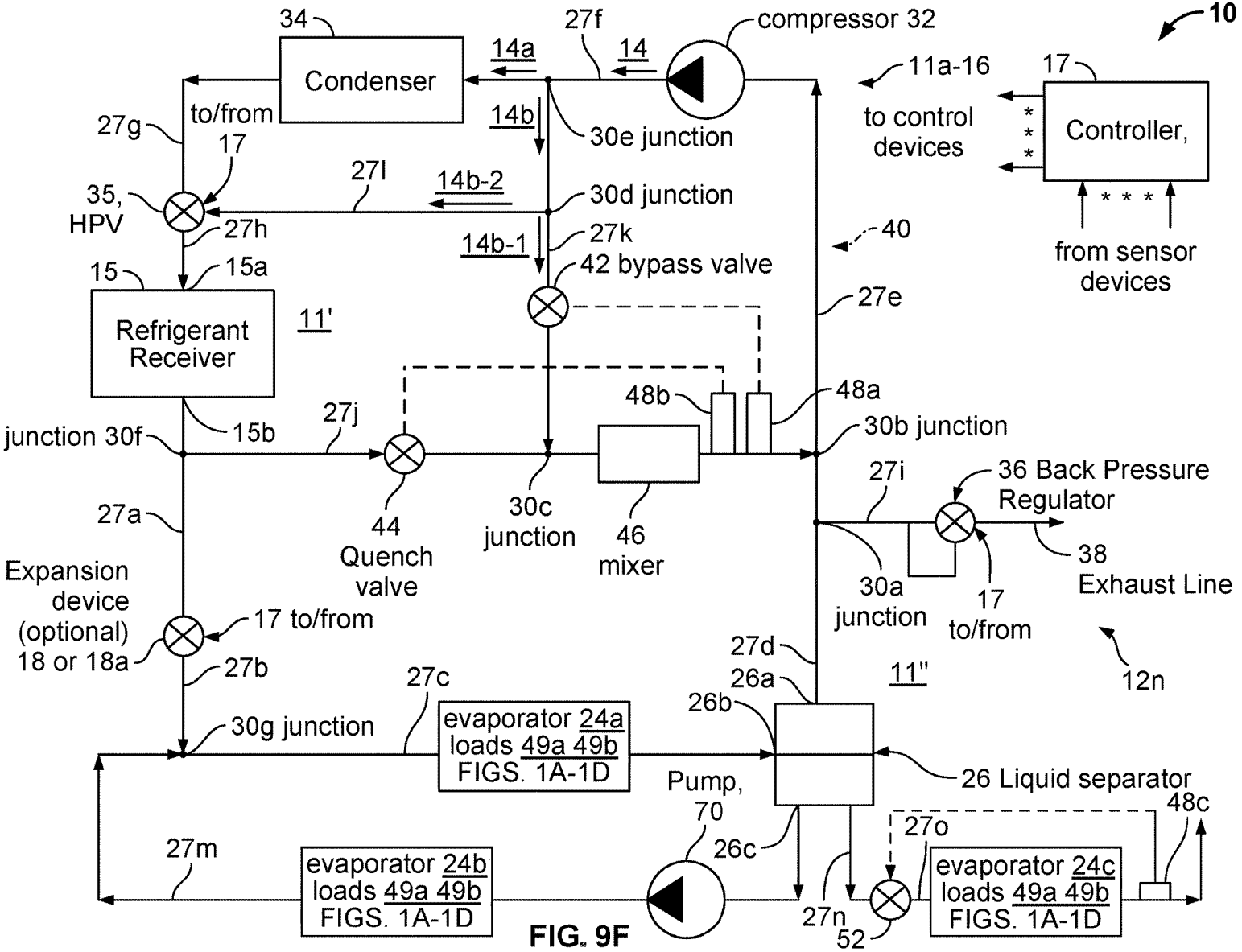
FIG. 9F and FIG. 9G are schematic diagram examples of a thermal management system that includes an open-circuit/closed-circuit refrigeration system with a pump and the modulating capacity control circuit of FIG. 1, with controlled superheat.

Referring now to FIG. 9F, an alternative OCRSCCRS 11*a*-16 is shown that has the OCRS 11" integrated with the closed-circuit refrigeration system CCRS 11' and includes the modulation circuit 40, with operation of the modulation circuit 40, as discussed above. OCRSCCRS 11*a*-16 includes the functional components of FIG. 9E, as discussed above, but uses the pump assisted open-circuit refrigeration system (OCRSP) 12*n* that includes sensor device 48*c* and second expansion valve device 52, (similar to that shown for the ejector configuration of FIG. 7F). OCRSCCRS 11*a*-16 includes the controllable expansion valve device 52 that has a control port that is fed directly from the sensor 48*c* or indirectly via the controller 17 and provides a mechanism to measure and control superheat.

The sensor 48*c* disposed approximate to the outlet of the evaporator 24*c* provides a measurement of superheat, and indirectly, vapor quality. For example, sensor 48*c* can be a combination of temperature and pressure sensors that measures the refrigerant fluid superheat downstream from the heat load, and transmits the measurements to the controller 17. The controller 17 adjusts the expansion valve device 52 based on the measured superheat relative to a superheat set point value. By doing so, controller 17 indirectly adjusts the vapor quality of the refrigerant fluid emerging from evaporator 24*c*. The evaporators 24*a*, 24*b* operate in two-phase (liquid/vapor) and the third evaporator 24*c* operates in superheated region with controlled superheat.

Figure 9G:
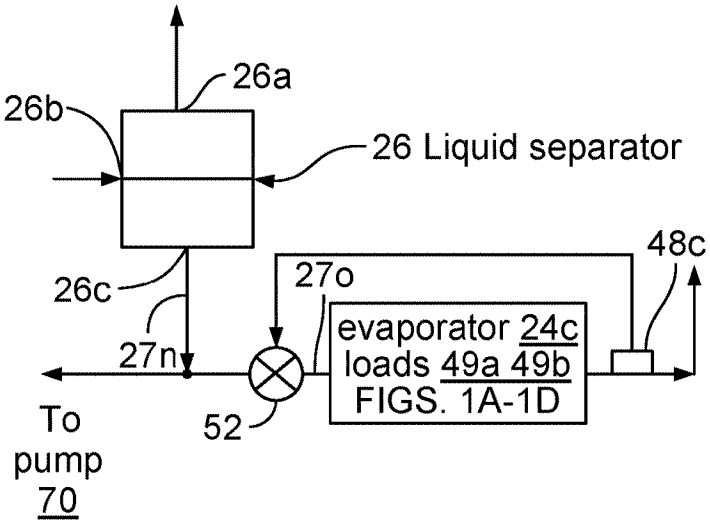

FIG. 9G shows a portion of FIG. 9F using a single liquid-side outlet 26*c* from the liquid separator 26.

Several alternatives can be used with the TMS system 10 that uses any of the CCRS variations 11*a*-11 to 11*a*-16. These alternative can use the recuperative heat exchanger 50 (as described in FIG. 6B). One alternative would have the recuperative heat exchanger 50 coupled downstream from the junction 30*f* and downstream from the junction 30*a*, Another alternative of the TMS 10 would have the recuperative heat exchanger 50 of FIG. 6B coupled upstream of the junction 30*f* and the junction 30*a*, e.g., coupled to the outlet of the receiver 15 and the outlet of the junction device 30*b*. Another alternative to the TMS 10 using the recuperative heat exchanger 50 of FIG. 6B is to locate a first recuperative heat exchanger 50 downstream from the junction 30*f* and downstream from the junction 30*a* and a second recuperative heat exchanger (not shown) "above" line 15*b* and junction 30*b*, e.g., coupled to the outlet of the receiver 15 and the outlet of the junction device 30*b*, i.e., the TMS 10 would have two recuperative heat exchangers.

Figure 10A:
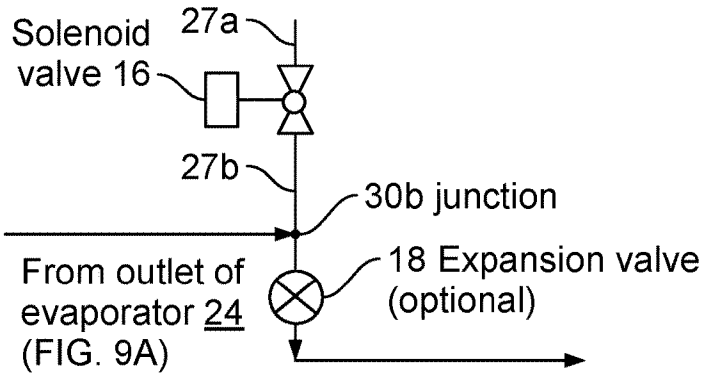
FIGS. 10A and 10B are schematics of arrangements of a junction device in the refrigeration system configurations of FIGS. 9A-9G.

FIG. 10A shows an alternative location for the junction device 30*g* having one of the inlets and the outlet interposed between solenoid valve 16 and expansion valve device 18 and having its other inlet coupled to the outlet of the evaporator 24.

Figure 10B:
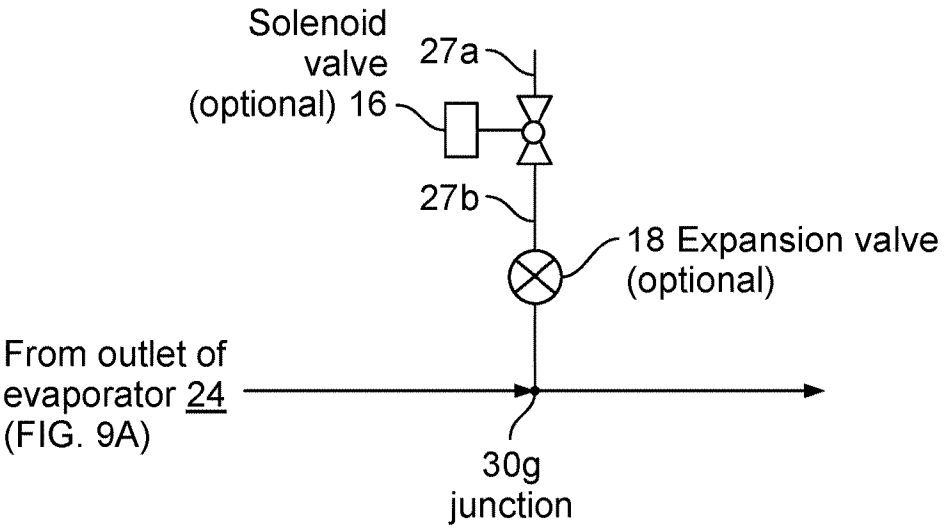

FIG. 10B shows another alternative location for the junction device 30*g* having one of the inlets and the outlet interposed between the outlet of the expansion valve device 18 and the evaporator 24 (FIG. 9A) or liquid separator 26 (FIG. 9B) and having its other inlet coupled to the outlet of the evaporator 24 (FIG. 9A).

Any of the configurations that were discussed above in FIGS. 9A to 9F can have the junction device 30*g* placed in the various locations shown in FIG. 10A or 10B.

If both of the optional solenoid control valve 16 and optional expansion valve device 18 are not included, then all of the locations for the junction device 30*g* are in essence the same, provided that there are no other intervening functional devices between the outlet of the receiver 15 and the inlet (that is in the refrigerant flow path) of the junction device 30*g*.

V. Thermal Management Systems with Closed-Circuit Refrigeration Systems Integrated with Open-Circuit Refrigeration Systems with Alternative Modulated Capacity Control Configurations FIGS. 11, 12A-12F and 13A-13E discussed below use the modulating capacity control circuit 40'. Items illustrated and referenced, but not mentioned in the discussion below are discussed and referenced in FIG. 1 and/or FIG. 11. In FIGS. 12A and 13A a portion of the OCRSCCRS 11*b*-2 and a portion of the OCRSCCRS 11*b*-8 (including portions of the CCRS 11' and the OCRS 11") are grouped in dashed line boxes 13*a*, 13*b*, as mentioned above. These boxes 13*a*, 13*b* will be referred to in the discussion of FIGS. 12B-12F and 13B-13E in the interests of brevity.

Figure 11:
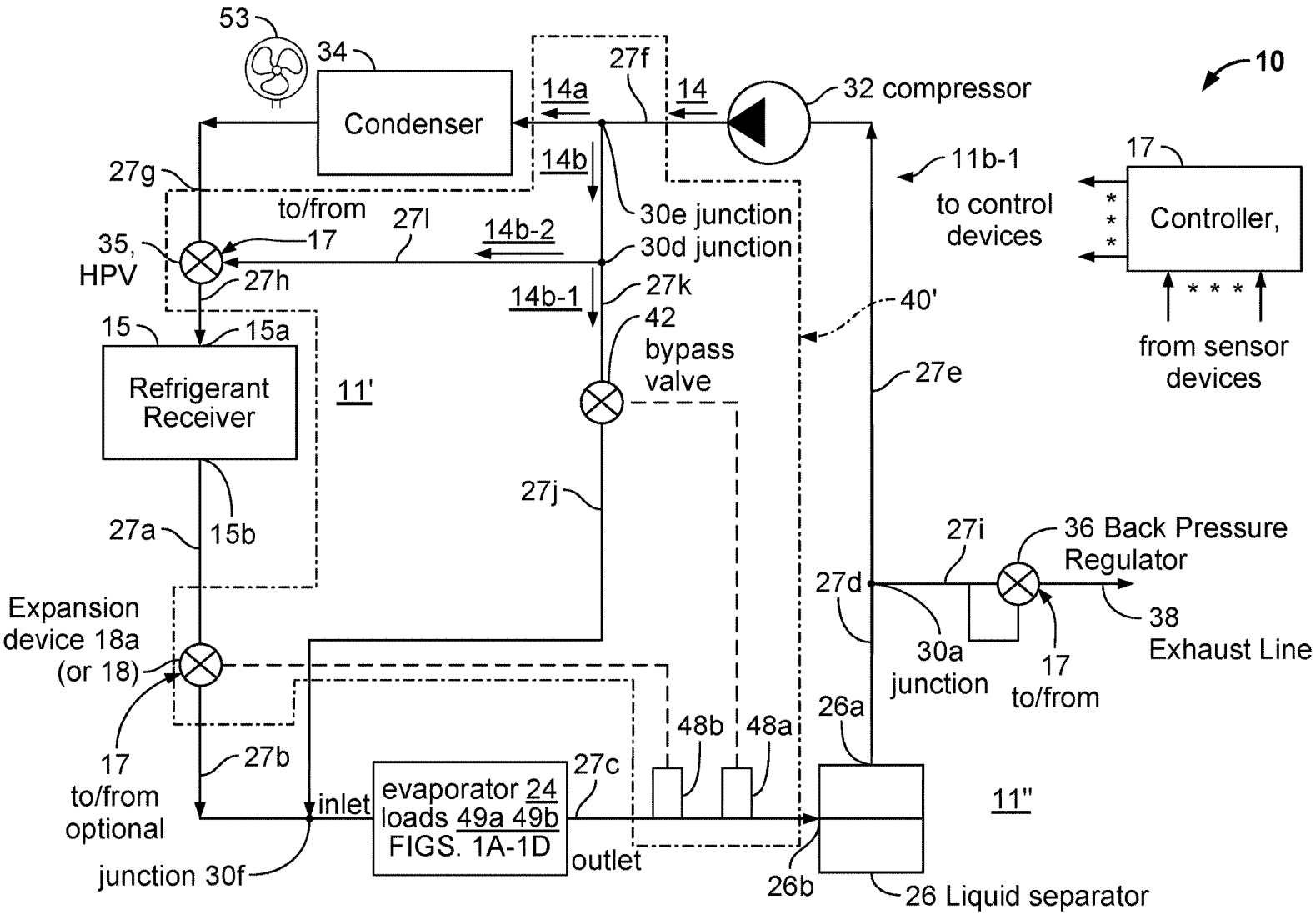
FIG. 11 is a schematic diagram of another example of a thermal management system that includes an integrated open-circuit/closed-circuit refrigeration system, with an alternative modulating capacity control circuit.

Referring to FIG. 11, a thermal management system (TMS) 10 includes an Open-Circuit Refrigeration System integrated with a Closed-Circuit Refrigeration System (OCRSCCRS) 11*b*-1 an with alternative modulation circuit 40' is shown. The TMS 10 provides closed-circuit refrigeration for low heat loads over long time intervals and open-circuit refrigeration for refrigeration of high heat loads over short time intervals (relative to the interval of refrigeration of low heat load). More specifically, the OCRSCCRS 11*b*-1 includes a Closed-Circuit Refrigeration System portion (CCRS) 11' and an Open-Circuit Refrigeration System portion (OCRS) 11".

Not shown in FIG. 11, but which would be typically included, is an oil return path, as discussed in FIG. 1A.

CCRS 11' includes the receiver 15 having inlet 15*a* and outlet 15*b*, optional solenoid valve (not shown), the control device 18 (i.e., an expansion valve device 18), the evaporator arrangement 24 (evaporator 24) with detailed examples shown in FIGS. 1B-1E, the liquid separator 26 having vapor-side port 26*a* and inlet port 26*b*, junction devices 30*a*, 30*e*, and 30*f*, the compressor 32, the condenser 34 (or a gas cooler of a trans-critical refrigeration system), and the head pressure control valve 35 all of which are coupled via conduits 27*a*-27*h*, generally as discussed in FIG. 1.

OCRS 11" includes the receiver 15, the optional solenoid valve (not shown), the optional control device 18 (i.e., expansion valve device 18), the evaporator 24, the liquid separator 26, and the junction device 30*a* coupled via the conduits 27*a*-27*e*. OCRS 11" also includes a conduit 27*i* that is coupled to the junction device 30*a* and a back-pressure regulator 36 that is coupled to an exhaust line 38, as discussed in FIG. 1.

TMS 10 includes the OCRSCCRS 11*b*-1 and heat loads 49*a*, 49*b* (shown with the evaporator 24), as discussed in FIG. 1 and FIGS. 1B-1E. As mentioned, the OCRS 11" handles cooling of the high loads during short periods and the CCRS 11' deals with continuously operating loads. Often steady-state heat loading varies. As mentioned above, FIG. 1 depicts an embodiment of the modulating capacity control circuit 40 for controlling cooling of varying steady-state heat loads.

FIG. 11, depicts an alternative embodiment of a modulating capacity control circuit 40'. The modulating capacity control circuit 40' adds modulated capacity control for the CCRS 11'. The system 10 with the modulating capacity control circuit 40' can generate any cooling capacity in the capacity range of zero to full capacity of the CCRS 11' to satisfy various heat loads in a heat load range from 0 to the full load capacity of the CCRS 11'.

The modulating capacity control circuit 40' includes the head pressure control valve 35 and the bypass valve 42, connected via conduit 27*l* and the junction device 30*d* (junction devices 30*b* and 30*c* of FIG. 1 are not needed in this embodiment). FIG. 11 may in addition include a variable speed fan 53, as in FIG. 1. The head pressure control valve 35 may or may not be used in conjunction with the variable flow fan 53 pulling air through the condenser 34. Alternatively, in some implementations the speed at which the variable flow fan 53 pulls air through the condenser 34 can be used to control head pressure, without the need for head pressure valve 35.

Unlike the embodiment 40 of FIG. 1, the modulating capacity control circuit 40' eliminates the quench valve and the mixer (FIG. 1). The bypass valve 42 is coupled between an outlet of the compressor 32, via junction device 30*d* and conduit 27*k*, to an input to the evaporator 24, via conduit 27*j* and the junction device 30*f*. The bypass valve 42 is controlled or responsive to a control signal that comes from the sensor 48*a* (or indirectly from the sensor 48*a* via the controller 17). The evaporator 24 and junction device 30*f* effectively provides the function of the mixer (in FIG. 1) cooling the hot gas bypass stream. The expansion valve device 18 is controlled via or responsive to a control signal that comes from the sensor 48*b* (or indirectly from the sensor 48*b* via the controller 17) and provides the function of the quench valve (in FIG. 1).

A. Closed-Circuit Refrigeration Operation

Closed-circuit refrigeration operation is as discussed above except for the function of the modulating capacity control circuit 40'. In the configuration of FIG. 11, a first portion (denoted by arrow 14*a*) of the compressed circulating refrigerant 14, via junction 30*e*, is fed to the condenser 34 and a second portion (denoted by arrow 14*b*) of the compressed circulating refrigerant 14 is fed to the modulating capacity control circuit 40'.

At the condenser 34, the first portion 14*a* of the circulating refrigerant loses heat and thus removes heat from the system, is routed into the refrigerant receiver 15, exits the refrigerant receiver 15, and enters the expansion valve device 18 (through the optional solenoid valve, if used), as discussed above in FIG. 1. The second portion 14*b* of the compressed circulating refrigerant is split into a first sub-portion (denoted by arrow 14*b*-1) and a second sub-portion (denoted by arrow 14*b*-2). The hot gas bypass valve 42 receives the first compressed circulating refrigerant sub-portion 14*b*-1 from the junction device 30*d*, bypassing the condenser 34, the receiver 15, and the expansion valve device 18, and directs the compressed circulating refrigerant sub-portion 14*b*-1 into the junction 30*f*.

The hot gas bypass valve 42 controls a set low evaporating/suction pressure. If the evaporating/suction pressure is reduced below a set limit value, the hot gas bypass valve 42 is actuated. The refrigerant is expanded in the hot gas bypass valve 42 and the expanded refrigerant enters the evaporator 24. The expansion valve device 18 controls refrigerant superheat at the evaporator 24 exit. The heat load acting on the evaporator 24, the enthalpy of the hot gas bypassed, and the enthalpy of the two-phase refrigerant formed after liquid expansion in the expansion valve device 18 generate the superheat at the evaporator exit. The expansion valve device 18 opens the flow opening, when the superheat increases, and thus increases the refrigerant flow rate to recover the growing superheat. The expansion valve device 18 closes the flow opening, when the superheat is reduced, thus reducing the refrigerant flow rate to recover lessened superheat. In the evaporator 24 and the junction 30*f*, the vapor and two-phase mixture mix, the liquid portion evaporates, and leaves the evaporator 24 and the junction 30*f* with the superheat controlled by the expansion valve device 18.

B. Open/Closed-Circuit Refrigeration Operation

On the other hand, when a high heat load 49*b* is applied, a mechanism such as the controller 17 causes the OCRSC-CRS 11*b*-1 to operate in both a closed and open cycle configuration. The closed-circuit portion is similar to that described above, except that the evaporator 24 in this case operates within a threshold of a vapor quality, the liquid separator 26 receives two-phase mixture, and compressor 32 receives saturated vapor from the liquid separator 26. When the OCRSCCRS 11*b*-1 operates with the open cycle, this causes the controller 17 to be configured to cause the back-pressure regulator 36 to be placed in an ON position, thus opening the back-pressure regulator 36 to permit the back-pressure regulator 36 to exhaust vapor through the exhaust line 38. The back-pressure regulator 36 maintains a back pressure at its inlet, according to a set point pressure, while allowing the back-pressure regulator 36 to exhaust refrigerant vapor through the exhaust line 38, as discussed in FIG. 1.

The OCRSCCRS 11*b*-1 operates like a thermal energy storage (TES) system, increasing cooling capacity of the TMS 10 when a pulsing heat load is activated, but without a duty cycle cooling penalty commonly encountered with TES systems (see discussion above for FIG. 1). The cooling duty is executed without the concomitant penalty of conventional TES systems provided that the receiver 15 has enough refrigerant charge and the refrigerant flow rate flowing through the evaporator 24 matches the rate needed by the high load 49*b*. The back-pressure regulator 36 exhausts the refrigerant vapor less the refrigerant vapor recirculated by the compressor 32. The rate of exhaust of the refrigerant vapor through the exhaust line 38 is governed by the set point pressure used at the input to the back-pressure regulator 36. When the high load 49*b* is no longer in use or its temperature is reduced, this occurrence is sensed by a sensor (not shown) and a signal from the sensor (or otherwise, such as communicated directly by the high heat load) is sent to the controller 17, as discussed in FIG. 1.

Referring now to FIGS. 12A-12F alternative OCRSCCRS configurations 11*b*-2 to 11*b*-7 are shown using the modulating capacity control circuit 40' (FIG. 11) or a variation thereof. Items illustrated and referenced, but not mentioned in the discussion below are discussed and referenced in either FIG. 1 and/or FIG. 11.

FIG. 12A depicts the outlet of the bypass valve 42 coupled via conduit 2'7*p* and a junction 30*g* to the inlet of the evaporator 24 and the outlet of ejector 66. At the outlet of the evaporator 24 are sensors that control the expansion valve device 18*a* and bypass valve 42, as discussed in FIG. 11.

FIG. 12B shows an embodiment with two evaporators 24*a*, 24*b*. For basics of operation, reference is made to FIG. 11 and FIG. 7C.

FIG. 12C shows a single evaporator 24*c*. For basics of operation, reference is made to FIG. 11 and FIG. 7D.

FIG. 12D shows the two evaporators 24*a*, 24*b* with the sensor 47 to control operation of the expansion valve device 52. For basics of operation, reference is made to FIG. 11 and FIG.

FIGS. 12E and 12F show the two evaporators 24*a*, 24*b* as in FIG. 12B, and a third evaporator 24*d*. For basics of operation, reference is made to FIG. 11 and FIGS. 7F and 7G.

FIG. 13A depicts the bypass valve 42 outlet coupled via conduit 2'7*p* and junction 30*g* couple to the inlet of the evaporator 24. At the outlet of the evaporator 24 are sensors that control the expansion valve device 18 and bypass valve 42, as discussed in FIG. 11. Pump 70 is shown disposed between liquid-side outlet 26*c* and an inlet to the junction device 30*g*. For basics of operation, reference is made to FIG. 11 and FIG. 9B.

Figure 13B:
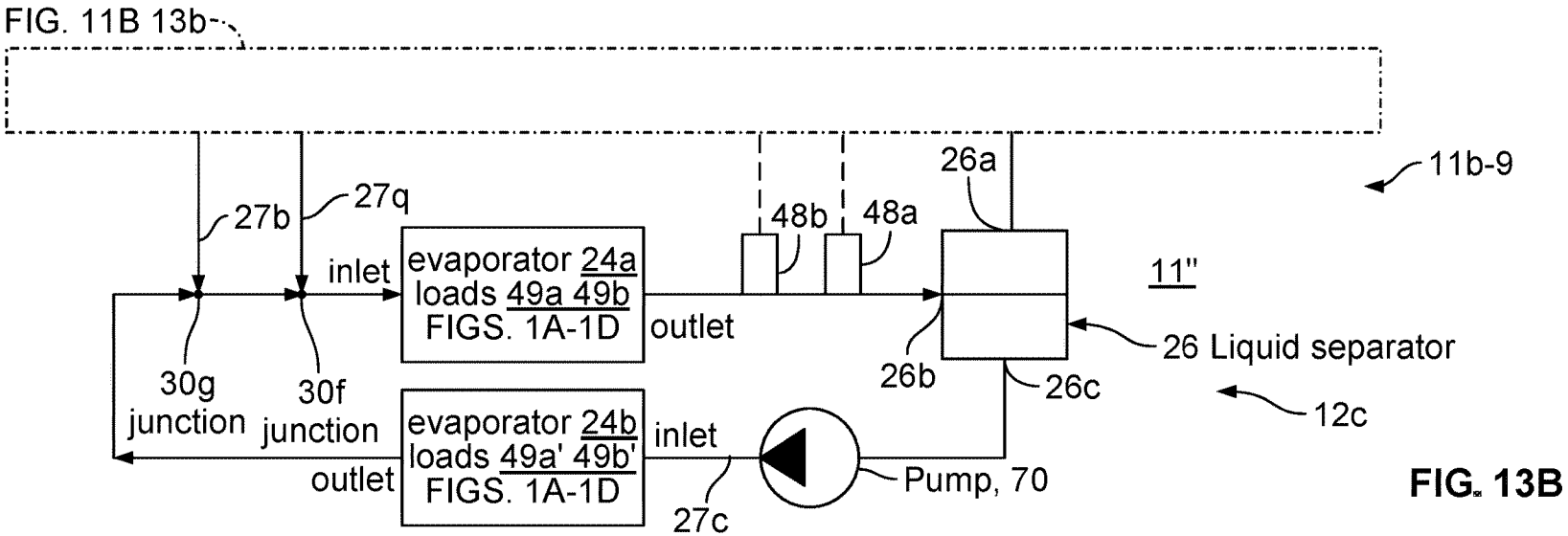

FIG. 13B shows an embodiment with two evaporators 24*a*, 24*b*. For basics of operation, reference is made to FIG. 5 and FIG. 9C.

Figure 13C:
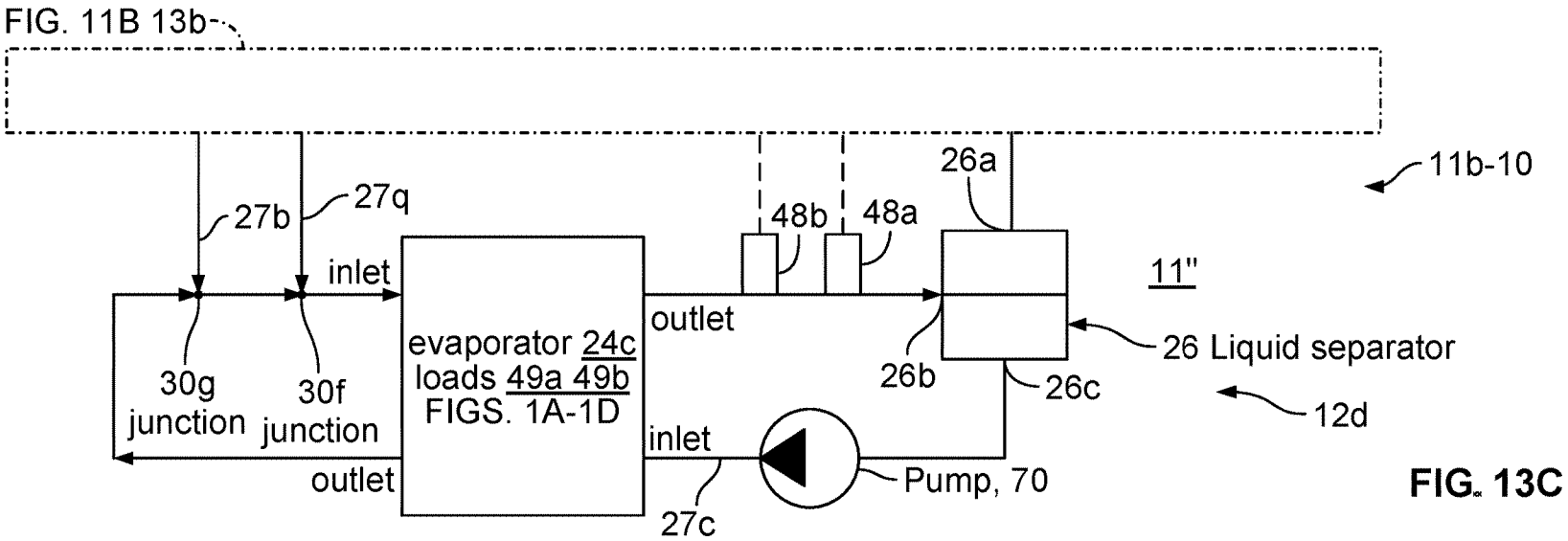

FIG. 13C shows a single evaporator 24*c*. For basics of operation, reference is made to FIG. 5 and FIG. 9D.

Figure 13D:
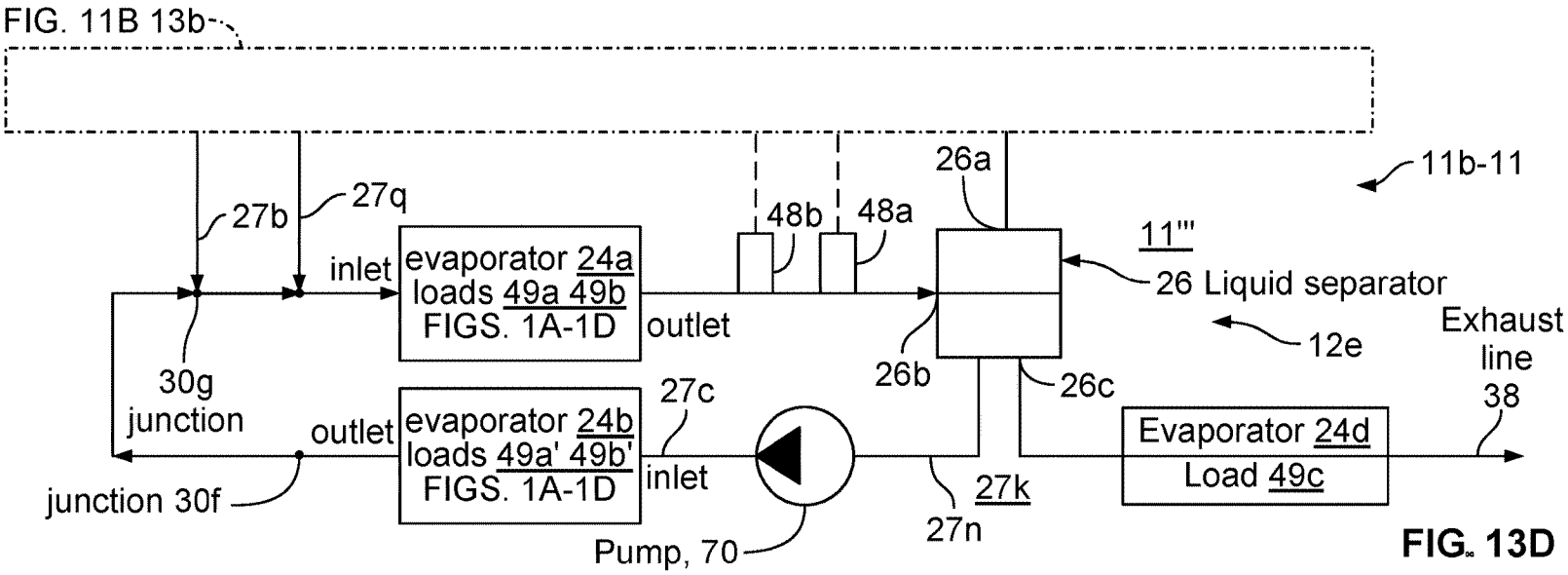
Figure 13E:
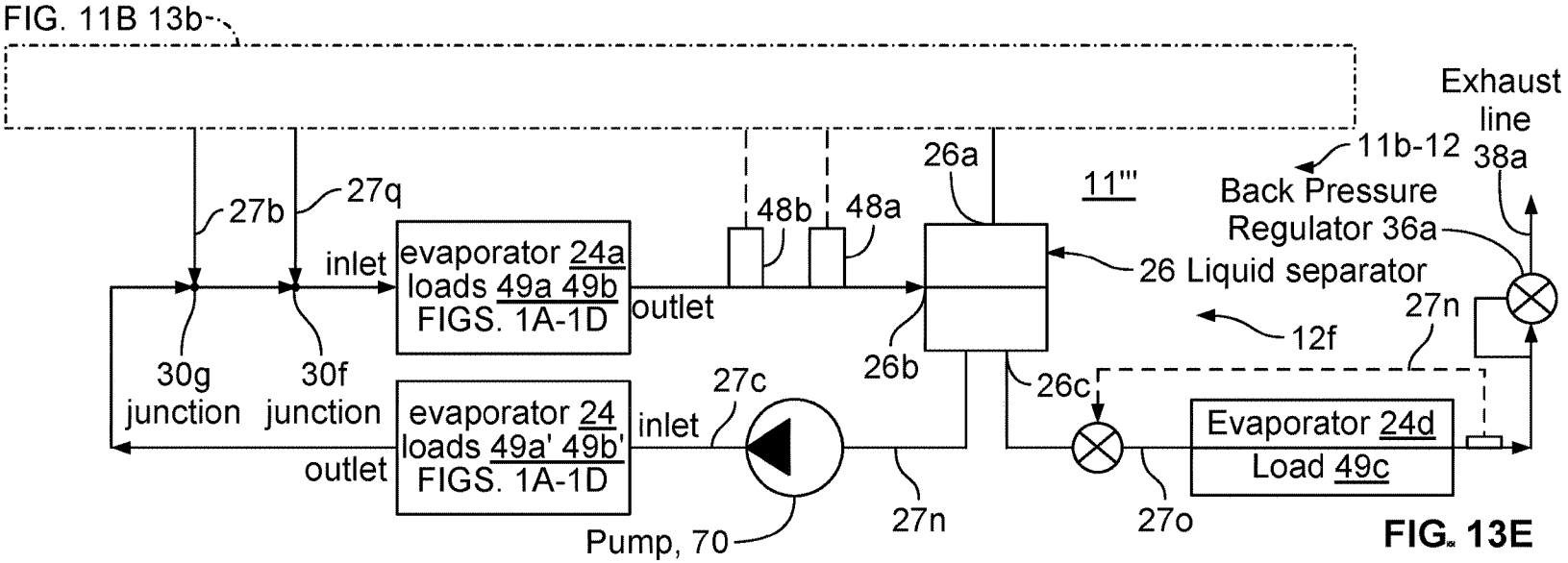

FIGS. 13D and 13E show the two evaporators 24*a*, 24*b* as in FIG. 13B, and a third evaporator 24*d*. For basics of operation, reference is made to FIG. 11 and FIGS. 9E and 9F.

Returning to FIG. 4 above, this figure depicted a configuration for the liquid separator 26, (implemented as a coalescing liquid separator or a flash drum for example) having ports 26*a*-26*c* coupled to conduits.

Figure 14C:
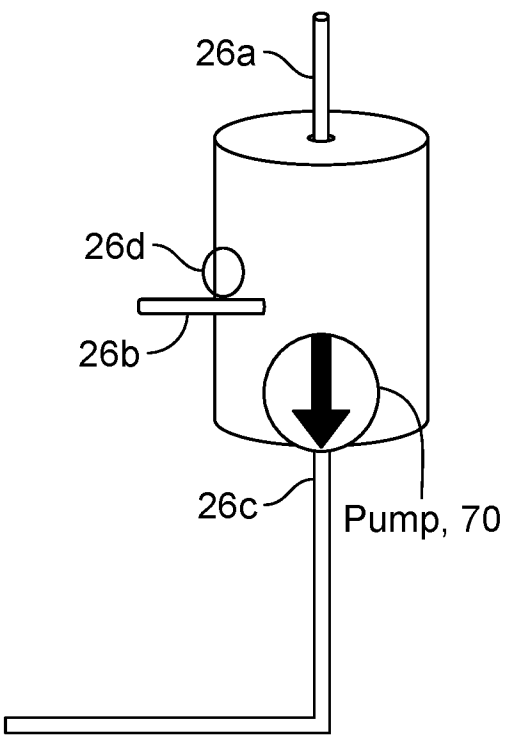
FIGS. 14A-14C are diagrams of liquid separator configurations.
Figure 14B:
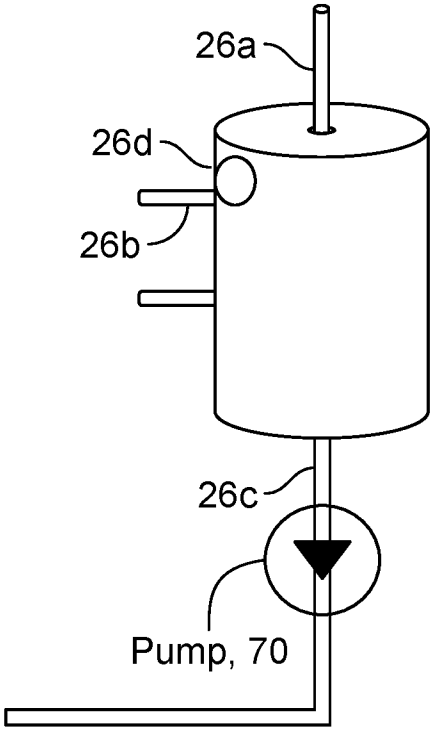
Figure 14A:
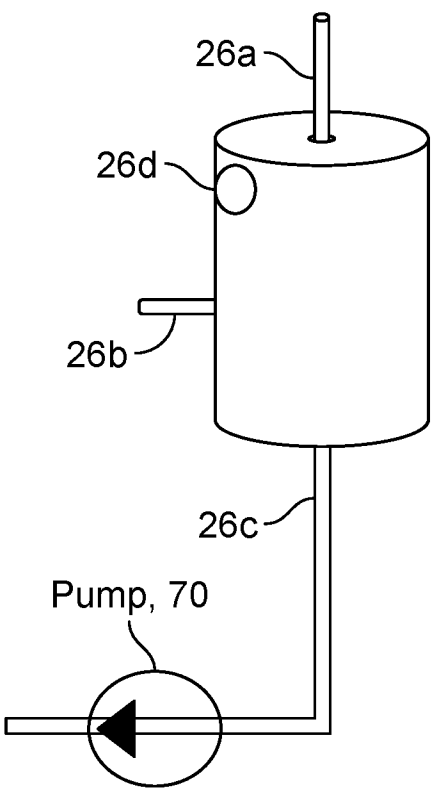

Referring now to FIGS. 14A-14C alternative configurations of the liquid separator 26 (implemented as a flash drum for example), which has ports 26*a*-26*c*, especially useful for the open-circuit refrigeration system with pump (OCRSP) configurations are shown.

In FIG. 14A, the pump 70 is located distal from the liquid-side outlet 26*c*. This configuration potentially presents the possibility of cavitation. To minimize the possibility of cavitation one of the configurations of FIG. 14B or 14C can be used.

In FIG. 14B, the pump 70 is located distal from the liquid-side outlet 26*c*, but the height at which the inlet 26*b* is located is higher than that of FIG. 14A. This would result in an increase in liquid pressure at the liquid-side port 26*c* of the liquid separator 26 and concomitant therewith an increase in liquid pressure at the inlet of the pump 70. Increasing the pressure at the inlet to the pump 70 should minimize possibility of cavitation.

Another strategy is presented in FIG. 14C, where the pump 70 is located proximate to or indeed, as shown, inside of the liquid-side port 26*c*. In addition, although not shown, the height at which the inlet 26*b* is located can be adjusted to that of FIG. 14B, rather than the height of FIG. 14A, as shown in FIG. 14B. This would result in an increase in liquid pressure at the inlet of the pump 70 further minimizing the possibility of cavitation.

Another alternative strategy that can be used for any of the configurations depicted involves the use of a sensor 26*d* that produces a signal that is a measure of the height of a column of liquid in the liquid separator 26. The signal is sent to the controller 17 that will be used to start the pump 70, once a sufficient height of liquid is contained by the liquid separator 26.

Referring now to FIG. 15, another alternative strategy that can be used for any of the configurations depicted involves the use of the recuperative heat exchanger 50. As shown in FIG. 15, this alternative example of a TMS 10 includes an Open-circuit Refrigeration System integrated with a Closed-circuit System (OCRSCCRS) 11*b*-13 and uses the alternative modulation circuit 40' as shown in FIG. 11 above. The TMS 10 provides closed-circuit refrigeration for low heat loads over long time intervals and open-circuit refrigeration for refrigeration of high heat loads over short time intervals (relative to the interval of refrigeration of low heat load). More specifically, the OCRSCCRS 11*b*-13 includes the CCRS portion 11' and the OCRS portion 11".

The heat exchanger 50 is an evaporator, which brings in thermal contact two refrigerant streams. In FIG. 15, a first of the streams is the liquid stream leaving the receiver 15 and a second stream is the vapor refrigerant leaving the liquid separator 26. The recuperative heat exchanger 50 has two fluid paths. A first fluid path is between a first inlet and first outlet of the recuperative heat exchanger 50. The first fluid path has the first inlet of recuperative heat exchanger 50 coupled to the outlet 15*b* of the receiver 15 and the first outlet of the recuperative heat exchanger 50 coupled to the inlet of the expansion valve device 18. A second fluid path is between a second inlet and second outlet of the recuperative heat exchanger 50. The second fluid path has the second inlet of recuperative heat exchanger 50 coupled to the vapor-side outlet 26*a* of the liquid separator 26 and the second outlet of the recuperative heat exchanger 50 is coupled to the inlet of the junction 30*a*.

The recuperative heat exchanger 50 provides thermal contact between the liquid refrigerant leaving the receiver 15 and the refrigerant vapor from the liquid separator 26. The use of the recuperative heat exchanger 50, at the outlet of the receiver 15 may further reduce liquid refrigerant mass flow rate demand from the receiver 50 by re-using the enthalpy of the exhaust vapor to precool the refrigerant liquid entering the evaporator that reduces the enthalpy of the refrigerant entering the evaporator 24 and thus reduces mass flow rate demand and provides a relative increase in energy efficiency of the system 10.

Figure 15A:
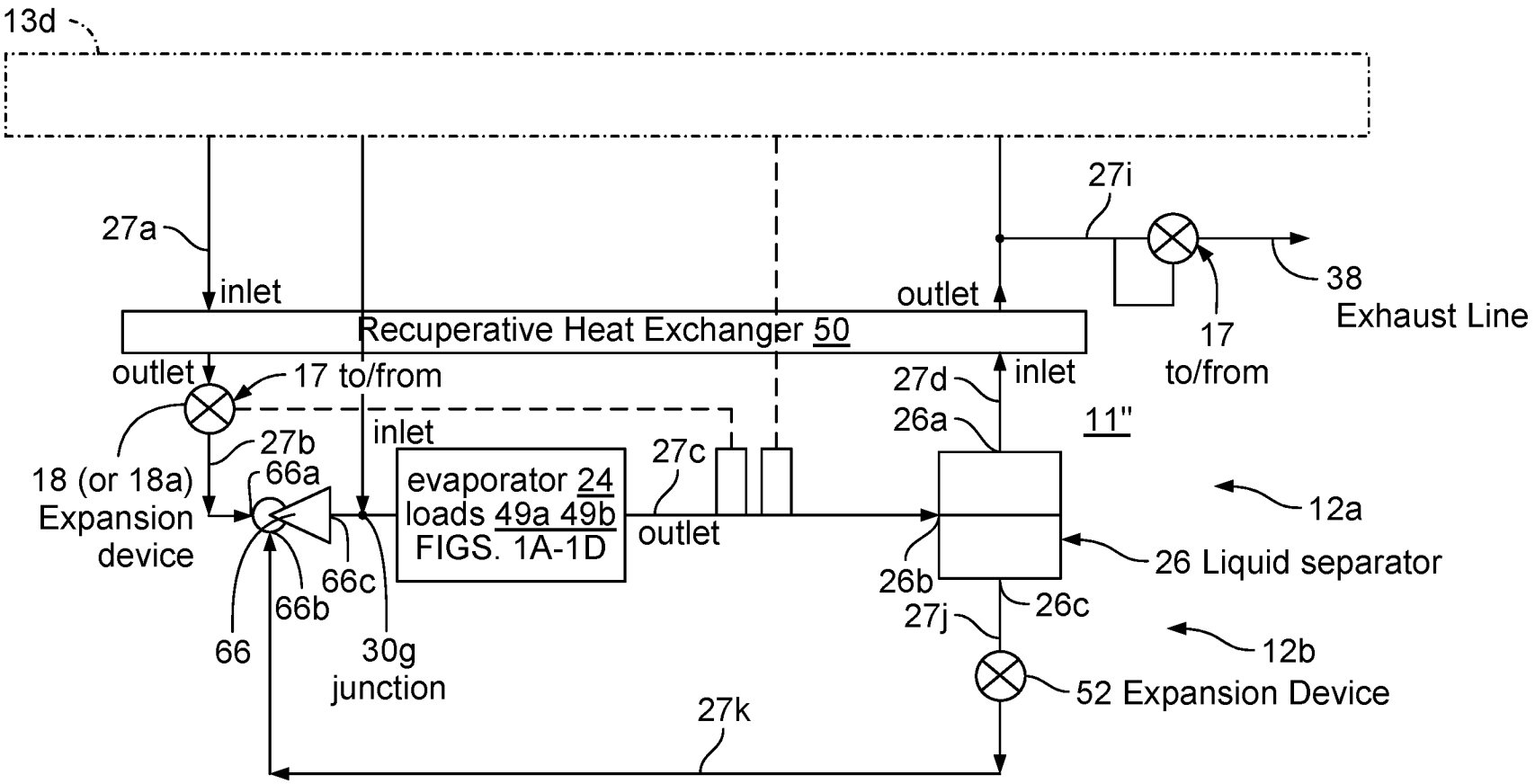
FIGS. 15A and 15B are schematic diagrams of alternative implementations using the recuperative heat exchanger of FIG. 15.
Figure 15B:
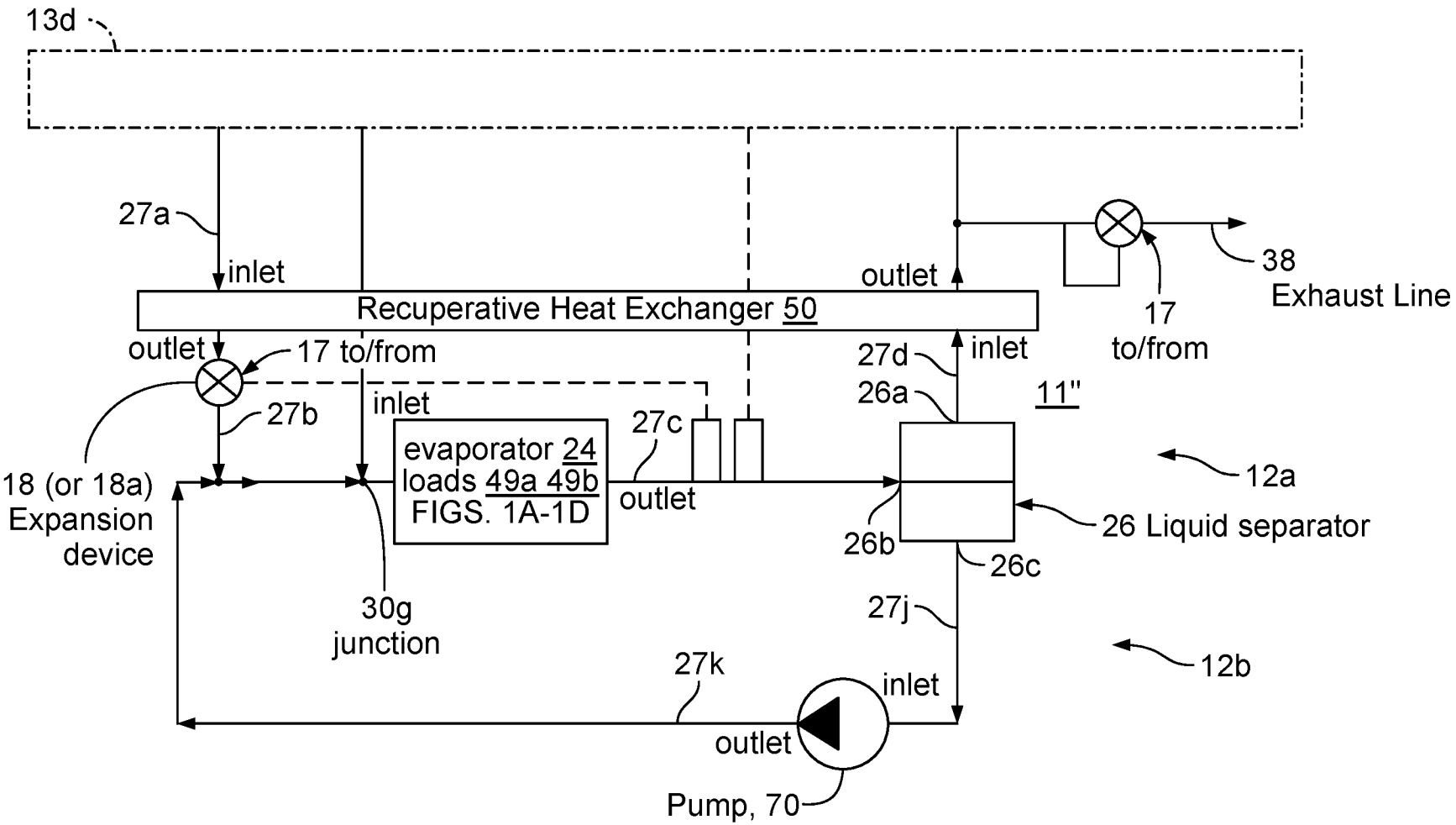

The recuperative heat exchanger 50 may be used with any of the embodiments 11*b*-1 to 11*b*-12 discussed above. For example, FIGS. 15A and 15B show alternative implementations using the recuperative heat exchanger. FIG. 15A shows an ejector implementation, whereas FIG. 15B shows a pump implementation. Detailed discussion of implementations using the ejector are discussed above in conjunction with FIGS. 12A-12F and of the pump implementation are discussed in conjunction with FIGS. 13A-13E.

Figure 16A:
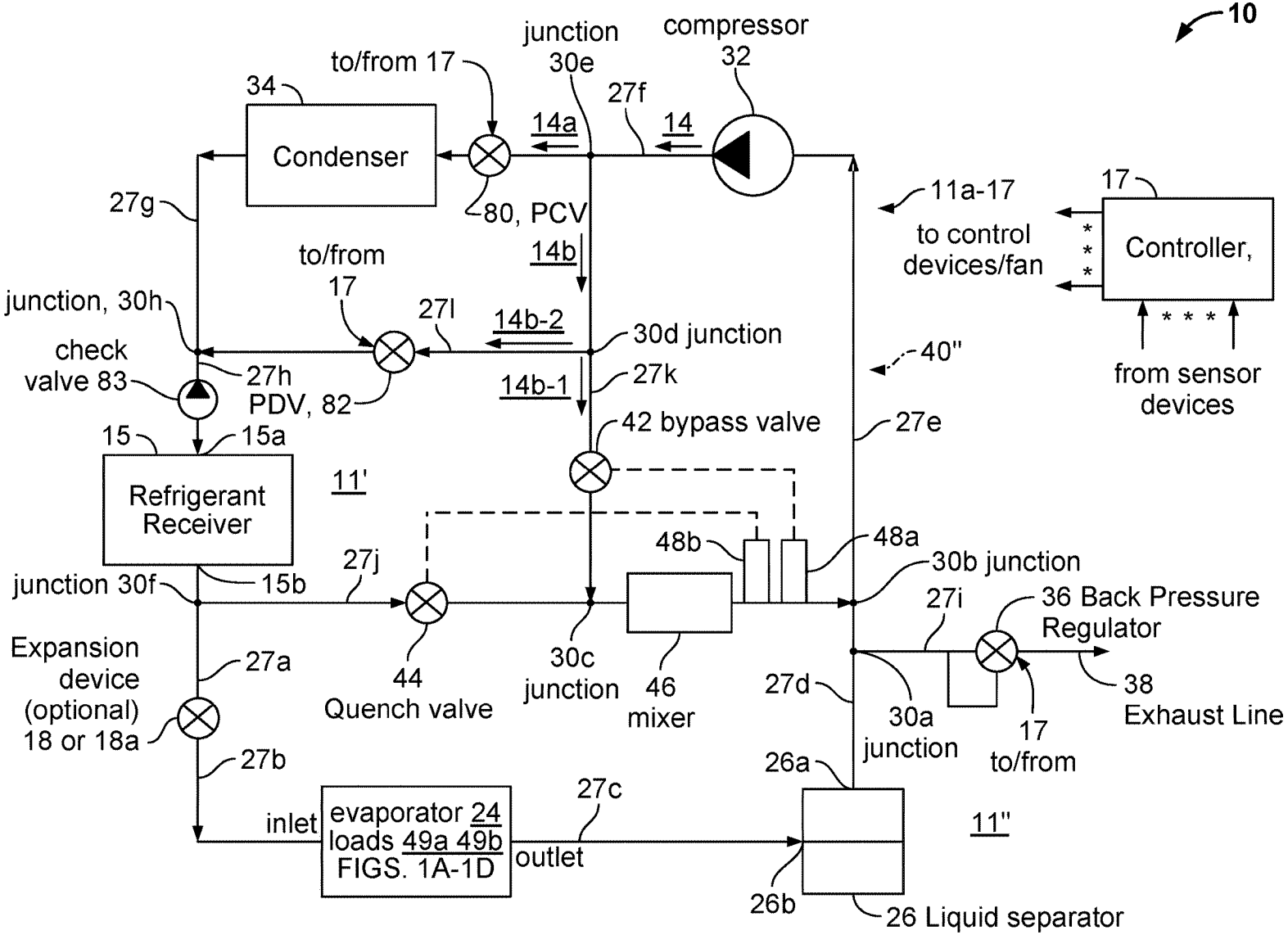
FIGS. 16A and 16B are schematic diagrams of examples of a thermal management system that includes another alternative modulating capacity control circuit.
Figure 16B:
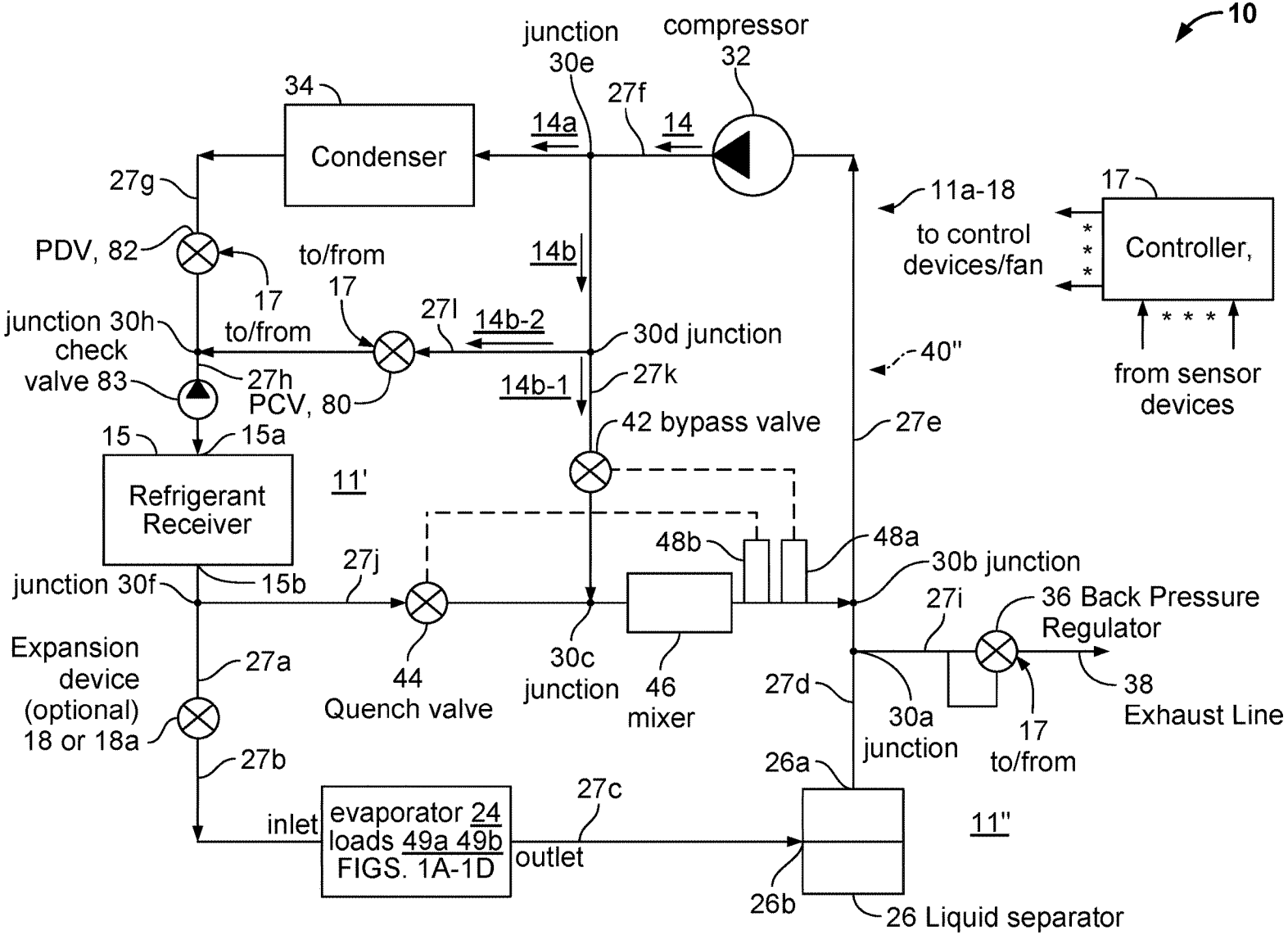

Referring now to FIGS. 16A and 16B, another alternative example of a TMS 10 that includes an Open-Circuit Refrigeration System integrated with a Closed-Circuit System (OCRSCCRS) 11*a*-17 (FIG. 16A) and 11*a*-18 (FIG. 16B) are shown. The TMS 10 provides closed-circuit refrigeration for low heat loads over long time intervals and open-circuit refrigeration for refrigeration of high heat loads over short time intervals (relative to the interval of refrigeration of low heat load). More specifically, the OCRSCCRS 11*a*-17 and 11*a*-18 includes CCRS 11' and OCRS 11".

These embodiments use another alternative modulation configuration 40" (a two-valve arrangement for valve 35 (FIG. 1)), but otherwise include the components as explained in FIG. 1, for the modulation circuit 40, but not repeated here for brevity.

In FIG. 16A, a pressure control valve 80 is disposed in the refrigerant path between the junction 30*e* and the inlet to the condenser 34. A check valve 83 is disposed in the refrigerant path between a junction 30*h* and inlet 15*a* to the refrigerant receiver 15. In this arrangement, a head pressure control is provided by the two valves (the pressure control valve 80 and a pressure differential valve 82 (PDV)). The approach implies controlling pressure in the receiver 15 at a sufficiently high level during low ambient temperatures. The pressure control valve 80 closes when the discharge pressure drops below a set point pressure, and the pressure control valve 80 opens when the pressure reaches the set point pressure, while the pressure differential control valve 82 maintains constant pressure differential. The check valve 83 prevents the back flow from the receiver 15 to the condenser 34.

In FIG. 16B, the pressure control valve 80 is disposed in the refrigerant path between the junction 30*d* that receives the second sub-portion of the refrigerant flow 14*b*-2 and junction 30*h* that is fed from the outlet of the pressure differential valve 82. The check valve 83 is disposed in the refrigerant path between the junction 30*h* and inlet to the refrigerant receiver 15 and the pressure differential valve 82 is disposed at the outlet of the condenser 34 and inlet to the junction 30*h*.

In general, pressure differential valve 82 controls the upstream pressure, that is the pressure in the condenser 34, and pressure control valve 80 controls downstream pressure, that is the pressure in receiver 15 or the pressure difference across the condenser 34.

Several alternatives can be used with the TMS system 10 that uses any of the CCRS variations 11*a*-3 to 11*a*-9. These alternative can use the recuperative heat exchanger 50 (as described in FIG. 6).

One alternative would have the recuperative heat exchanger 50 coupled downstream from the junction 30*f* and downstream from the junction 30*a*, as shown in FIG. 6. Another alternative of the TMS 10 would have the recuperative heat exchanger 50 of FIG. 6 coupled upstream of the junction 30*f* and the junction 30*a*, e.g., coupled to the outlet of the receiver 15 and the outlet of the junction device 30*b*. Another alternative for the TMS 10, using the recuperative heat exchanger 50 of FIG. 6 is to locate a first recuperative heat exchanger 50 downstream from the junction 30*f* and downstream from the junction 30*a* and a second recuperative heat exchanger (not shown) "above" outlet 15*b* and junction 30*b*, e.g., coupled to the outlet of the receiver 15 and the outlet of the junction device 30*b*, i.e., the TMS 10 would have two recuperative heat exchangers.

In addition. the variable fan speed 53 can be used, where the speed and related cooling air flow rate vary according to sensed pressure at the condenser inlet or outlet.

Various combinations of the sensors can be used to measure thermodynamic properties of the TMS 10 that are used to adjust the control devices or pumps discussed above and which signals are processed by the controller 17. Connections (wired or wireless) are provided between each of the sensors and controller 17. In many embodiments, system includes only certain combinations of the sensors (e.g., one, two, three, or four of the sensors) to provide suitable control signals for the control devices.

VI. Refrigerants and Considerations for Choosing Configurations

A variety of different refrigerant fluids can be used in TMS 10. Depending on the application for both open-circuit refrigeration system operation and closed-circuit refrigeration system operation, emissions regulations and operating environments may limit the types of refrigerant fluids that can be used.

For example, in certain embodiments, the refrigerant fluid can be ammonia having very large latent heat; after passing through the cooling circuit, the ammonia refrigerant vapor in the open-circuit operation can be disposed of by incineration, by chemical treatment (i.e., neutralization), and/or by direct venting to the atmosphere. In certain embodiments, the refrigerant fluid can be an ammonia-based mixture that includes ammonia and one or more other substances. For example, mixtures can include one or more additives that facilitate ammonia absorption or ammonia burning.

More generally, any fluid can be used as a refrigerant in the open-circuit refrigeration systems disclosed herein, provided that the fluid is suitable for cooling heat loads 49*a*-49*b* (e.g., the fluid boils at an appropriate temperature) and, in embodiments where the refrigerant fluid is exhausted directly to the environment, regulations and other safety and operating considerations do not inhibit such discharge.

Ammonia under standard conditions of pressure and temperature is in a liquid or two-phase state. Thus, the receiver 15 typically will store ammonia at a saturated pressure corresponding to the surrounding temperature. The pressure in the receiver 15 storing ammonia will change during operation. The use of the control device 18 can stabilize pressure in the receiver 15 during operation, by adjusting the control device 18 (e.g., automatically or by controller 17) based on a measurement of the evaporation pressure (pe) of the refrigerant fluid and/or a measurement of the evaporation temperature of the refrigerant fluid.

VII. Controller and Control Considerations

FIG. 17 shows the controller 17 that includes a processor 17*a*, memory 17*b*, storage 17*c*, and I/O interfaces 17*d*, all of which are connected/coupled together via a bus (or switched network, fabric, etc.) 17*e*.

Any two of the optional devices, such as pressure sensors upstream and downstream from a control device, can be configured to measure information about a pressure differential $p_r - p_e$ across the respective control device and to transmit electronic signals corresponding to the measured pressure from which a pressure difference information can be generated by the controller 17. Other sensors such as flow sensors and temperature sensors can be used as well. In certain embodiments, sensors can be replaced by a single pressure differential sensor, a first end of which is connected adjacent to an inlet and a second end of which is connected adjacent to an outlet of a device to which differential pressure is to be measured, such as the evaporator. The pressure differential sensor measures and transmits information about the refrigerant fluid pressure drop across the device, e.g., the evaporator 24.

Controller 17 can adjust control device 18 based on measurements of one or more of the following system parameter values: the pressure drop ($p_r - p_e$) across first control device 18, the pressure drop across evaporator 24, the refrigerant fluid pressure in receiver 15 ($p_r$), the vapor quality of the refrigerant fluid emerging from evaporator 24 (or at another location in the system), the superheat value of the refrigerant fluid in the system, the evaporation pressure ($p_e$) of the refrigerant fluid, and the evaporation temperature of the refrigerant fluid.

To adjust control device 18 based on a particular value of a measured system parameter value, controller 17 compares the measured value to a set point value (or threshold value) for the system parameter, as will be discussed below.

While, a variety of different refrigerant fluids can be used in any of the OCRSP configurations. For open-circuit refrigeration systems in general, emissions regulations and operating environments may limit the types of refrigerant fluids that can be used. For example, in certain embodiments, the refrigerant fluid can be ammonia having very large latent heat; after passing through the cooling circuit, vaporized ammonia that is captured at the vapor port of the liquid separator can be disposed of by incineration, by chemical treatment (i.e., neutralization), and/or by direct venting to the atmosphere. Any liquid captured in the liquid separator is recycled back into the OCRSP (either directly or indirectly).

Since liquid refrigerant temperature is sensitive to ambient temperature, the density of liquid refrigerant changes even though the pressure in the receiver 15 remains the same. Also, the liquid refrigerant temperature impacts the vapor quality at the evaporator inlet. Therefore, the refrigerant mass and volume flow rates change and the control device 18 can be used.

Temperature sensors can be positioned adjacent to an inlet or an outlet of e.g., the evaporator 24 or between the inlet and the outlet. Such a temperature sensor measures temperature information for the refrigerant fluid within evaporator 24 (which represents the evaporating temperature) and transmits an electronic signal corresponding to the measured information. A temperature sensor can be attached to heat loads 49*a*, 49*b*, which measures temperature information for the load and transmits an electronic signal corresponding to the measured information. An optional temperature sensor can be adjacent to the outlet of evaporator 24 that measures and transmits information about the temperature of the refrigerant fluid as it emerges from evaporator 24.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in the system 10 and the saturated vapor temperature of the refrigerant fluid defined by the refrigerant pressure at the measurement point in the TMS.

To determine the superheat associated with the refrigerant fluid, the system controller 17 (as described) receives information about the refrigerant fluid vapor pressure after emerging from a heat exchanger downstream from evaporator 24, and uses calibration information, a lookup table, a mathematical relationship, or other information to determine the saturated vapor temperature for the refrigerant fluid from the pressure information. The controller 17 also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in TMS 10. As one example, thermocouples and thermistors can function as temperature sensors in TMS 10. Examples of suitable commercially available temperature sensors for use in TMS 10 include, but are not limited to, the 88000 series thermocouple surface probes (available from OMEGA Engineering Inc., Norwalk, Conn.).

TMS 10 can include a vapor quality sensor that measures vapor quality of the refrigerant fluid emerging from evaporator 24. Typically, such a sensor is implemented as a capacitive sensor that measures a difference in capacitance between the liquid and vapor phases of the refrigerant fluid. The capacitance information can be used to directly determine the vapor quality of the refrigerant fluid (e.g., by system controller 17). Alternatively, sensor can determine the vapor quality directly based on the differential capacitance measurements and transmit an electronic signal that includes information about the refrigerant fluid vapor quality. Examples of commercially available vapor quality sensors that can be used in TMS 10 include, but are not limited to, HBX sensors (available from HB Products, Hasselager, Denmark).

It should generally understood that the systems disclosed herein can include a variety of combinations of the various sensors described above, and controller 17 can receive measurement information periodically or aperiodically from any of the various sensors. Moreover, it should be understood any of the sensors described can operate autonomously, measuring information and transmitting the information to controller 17 (or directly to the first and/or second control device) or, alternatively, any of the sensors described above can measure information when activated by controller 17 via a suitable control signal, and measure and transmit information to controller 17 in response to the activating control signal.

To adjust a control device on a particular value of a measured system parameter value, controller 17 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 17 adjusts a respective control device to modify the operating state of the TMS 10. Certain set point values represent a minimum allowable value of a system parameter, and if the measured value is equal to the set point value (or differs from the set point value by 10% or less (e.g., 5% or less, 3% or less, 1% or less) of the set point value), controller 17 adjusts the respective control device to modify the operating state of the system 9, and increase the system parameter value. The controller 17 executes algorithms that use the measured sensor value(s) to provide signals that cause the various control devices to adjust refrigerant flow rates, etc.

Some set point values represent "target" values of system parameters. For such system parameters, if the measured parameter value differs from the set point value by 1% or more (e.g., 3% or more, 5% or more, 10% or more, 20% or more), controller 17 adjusts the respective control device to adjust the operating state of the system, so that the system parameter value more closely matches the set point value.

Optional pressure sensors are configured to measure information about the pressure differential $p_r - p_e$ across a control device and to transmit an electronic signal corresponding to the measured pressure difference information. Two sensors can effectively measure $p_r$, $p_e$. In certain embodiments two sensors can be replaced by a single pressure differential sensor. Where a pressure differential sensor is used, a first end of the sensor is connected upstream of a first control device 18 and a second end of the sensor is connected downstream from first control device.

System also includes optional pressure sensors positioned at the inlet and outlet, respectively, of evaporator 24. A sensor measures and transmits information about the refrigerant fluid pressure upstream from evaporator 24, and a sensor measure and transmit information about the refrigerant fluid pressure downstream from evaporator 24. This information can be used (e.g., by a system controller) to calculate the refrigerant fluid pressure drop across evaporator 24. As above, in certain embodiments, sensors can be replaced by a single pressure differential sensor to measure and transmit the refrigerant fluid pressure drop across evaporator 24.

To measure the evaporating pressure ($p_e$) a sensor can be optionally positioned between the inlet and outlet of evaporator 24, i.e., internal to evaporator 24. In such a configuration, the sensor can provide a direct a direct measurement of the evaporating pressure.

To measure refrigerant fluid pressure at other locations within system, sensor can also optionally be positioned, for example, in-line along a conduit. Pressure sensors at each of these locations can be used to provide information about the refrigerant fluid pressure downstream from evaporator 24, or the pressure drop across evaporator 24.

It should be appreciated that, in the foregoing discussion, any one or various combinations of two sensors discussed in connection with system can correspond to the first measurement device connected to control device 18, and any one or various combination of two sensors can correspond to the second measurement device. In general, as discussed previously, the first measurement device provides information corresponding to a first thermodynamic quantity to the first control device, and the second measurement device provides information corresponding to a second thermodynamic quantity to the second control device, where the first and second thermodynamic quantities are different, and therefore allow the first and second control device to independently control two different system properties (e.g., the vapor quality of the refrigerant fluid and the heat load temperature, respectively).

In some embodiments, one or more of the sensors shown in system are connected directly to control device 18. The first and second control devices 18, 36, respectively, can be configured to adaptively respond directly to the transmitted signals from the sensors, thereby providing for automatic adjustment of the system's operating parameters. In certain embodiments, the first control device 18 and/or second control device 36 can include processing hardware and/or software components that receive transmitted signals from the sensors, optionally perform computational operations, and activate elements of the first control device 18 and/or second control device 36 to adjust such control device in response to the sensor signals.

In addition, controller 17 is optionally connected to control device 18. In embodiments where control device 18 is implemented as a device controllable via an electrical control signal, controller 17 is configured to transmit suitable control signals to the first control device 18 and/or second control device 36 to adjust the configuration of these components. In particular, controller 17 is configured to adjust control device 18 to control the vapor quality of the refrigerant fluid in the system 10.

During operation of the system 10, controller 17 typically receives measurement signals from one or more sensors. The measurements can be received periodically (e.g., at consistent, recurring intervals) or irregularly, depending upon the nature of the measurements and the manner in which the measurement information is used by controller 17. In some embodiments, certain measurements are performed by controller 17 after particular conditions—such as a measured parameter value exceeding or falling below an associated set point value—are reached.

By way of example, Table 1 summarizes various examples of combinations of types of information (e.g., system properties and thermodynamic quantities) that can be measured by the sensors of system and transmitted to controller 17, to allow controller 17 to generate and transmit suitable control signals to control device 18 and/or other control devices. The types of information shown in Table 1 can generally be measured using any suitable device (including combination of one or more of the sensors discussed herein) to provide measurement information to controller 17.

TABLE 1

| | | Measurement Information Used to Adjust First Control Device 18 | | | | | | | |
|---|---|---|---|---|---|---|---|---|---|
| | | FCM Press Drop | Evap Press Drop | Rec Pres | VQ | SH | Evap VQ | Evap P/T | HL Temp |
| Measurement Information Used to Adjust Second Control Device 36 | FCM Press Drop | | | | | | | x | x |
| | Evap Press Drop | | | | | | | x | X |
| | Rec Press | | | | | | | x | X |
| | VQ | | | | | | | x | X |
| | SH | | | | | | | x | X |
| | Evap VQ | | | | | | | x | X |
| | Evap P/T | x | x | x | x | x | x | | X |
| | HL Temp | x | x | x | x | x | x | x | |

FCM Press Drop = refrigerant fluid pressure drop across first control device
Evap Press Drop = refrigerant fluid pressure drop across evaporator
Rec Press = refrigerant fluid pressure in receiver
VQ = vapor quality of refrigerant fluid
SH = superheat of refrigerant fluid
Evap VQ = vapor quality of refrigerant fluid at evaporator outlet
Evap P/T = evaporation pressure or temperature
HL Temp = heat load temperature For example, in some embodiments, control device 18 is adjusted (e.g., automatically or by controller 17) based on a measurement of the evaporation pressure ($p_e$) of the refrigerant fluid and/or a measurement of the evaporation temperature of the refrigerant fluid. In certain embodiments, control device 18 is adjusted (e.g., automatically or by controller 17) based on a measurement of the temperature of thermal load 49*b*.

To adjust the control devices, e.g., 18, 36, 51, 52, compressor 32, pump 70, valves 42, 44, etc., based on a particular value of a measured system parameter value, controller 17 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 17 adjusts control device 18 to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), controller 17 adjusts control device 18, etc. to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), controller 17 adjusts control device 18, etc. to adjust the operating state of the system, so that the system parameter value more closely matches the set point value.

Measured parameter values are assessed in relative terms based on set point values (i.e., as a percentage of set point values). Alternatively, in some embodiments, measured parameter values can be accessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 17 adjusts control device 18, etc. to adjust the operating state of the system, so that the measured system parameter value more closely matches the set point value.

In the foregoing examples, measured parameter values are assessed in relative terms based on set point values (i.e., as a percentage of set point values). Alternatively, in some embodiments, measured parameter values can be in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 17 adjusts control device 18, etc. to adjust the operating state of the system, so that the measured system parameter value more closely matches the set point value.

In certain embodiments, refrigerant fluid emerging from evaporator 24 can be used to cool one or more additional thermal loads. In addition, systems can include a second thermal load connected to a heat exchanger. A variety of mechanical connections can be used to attach second thermal load to heat exchanger, including (but not limited to) brazing, clamping, welding, and any of the other connection types discussed herein.

Heat exchanger includes one or more flow channels through which high vapor quality refrigerant fluid flows after leaving evaporator 24. During operation, as the refrigerant fluid vapor phases through the flow channels, it absorbs heat energy from second thermal load, cooling second thermal load. Typically, second thermal load is not as sensitive as thermal load 49*b* to fluctuations in temperature. Accordingly, while second thermal load is generally not cooled as precisely relative to a particular temperature set point value as thermal load 49*b*, the refrigerant fluid vapor provides cooling that adequately matches the temperature constraints for second thermal load.

In general, the systems disclosed herein can include more than one (e.g., two or more, three or more, four or more, five or more, or even more) thermal loads in addition to thermal loads depicted. Each of the additional thermal loads can have an associated heat exchanger; in some embodiments, multiple additional thermal loads are connected to a single heat exchanger, and in certain embodiments, each additional thermal load has its own heat exchanger. Moreover, each of the additional thermal loads can be cooled by the superheated refrigerant fluid vapor after a heat exchanger attached to the second load or cooled by the high vapor quality fluid stream that emerges from evaporator 24.

Although evaporator 24 and heat exchanger are implemented as separate components, in certain embodiments, these components can be integrated to form a single heat exchanger, with thermal load and second thermal load both connected to the single heat exchanger. The refrigerant fluid vapor that is discharged from the evaporator portion of the single heat exchanger is used to cool second thermal load, which is connected to a second portion of the single heat exchanger.

The vapor quality of the refrigerant fluid after passing through evaporator 24 can be controlled either directly or indirectly with respect to a vapor quality set point by controller 17. In some embodiments, the system includes a vapor quality sensor that provides a direct measurement of vapor quality, which is transmitted to controller 17. Controller 17 adjusts control device depending on configuration to control the vapor quality relative to the vapor quality set point value.

In certain embodiments, the system includes a sensor that measures superheat and indirectly, vapor quality. For example, a combination of temperature and pressure sensors measure the refrigerant fluid superheat downstream from a second heat load and transmit the measurements to controller 17. Controller 17 adjusts control device according to the configuration based on the measured superheat relative to a superheat set point value. By doing so, controller 17 indirectly adjusts the vapor quality of the refrigerant fluid emerging from evaporator 24.

As the two refrigerant fluid streams flow in opposite directions within recuperative heat exchanger, heat is transferred from the refrigerant fluid emerging from evaporator 24 to the refrigerant fluid entering control device 18. Heat transfer between the refrigerant fluid streams can have a number of advantages. For example, recuperative heat transfer can increase the refrigeration effect in evaporator 24, reducing the refrigerant mass transfer rate implemented to handle the heat load presented by thermal load 49*b*. Further, by reducing the refrigerant mass transfer rate through evaporator 24, the amount of refrigerant used to provide cooling duty in a given period of time is reduced. As a result, for a given initial quantity of refrigerant fluid introduced into receiver 15, the operational time over which the system can operate before an additional refrigerant fluid charge is needed can be extended. Alternatively, for the system to effectively cool thermal load 49*b* for a given period of time, a smaller initial charge of refrigerant fluid into receiver 15 can be used.

Because the liquid and vapor phases of the two-phase mixture of refrigerant fluid generated following expansion of the refrigerant fluid in control device 18 can be used for different cooling applications, in some embodiments, the system can include a phase separator to separate the liquid and vapor phases into separate refrigerant streams that follow different flow paths within the TMS 10.

Further, eliminating (or nearly eliminating) the refrigerant vapor from the refrigerant fluid stream entering evaporator 24 can help to reduce the cross-section of the evaporator and improve film boiling in the refrigerant channels. In film boiling, the liquid phase (in the form of a film) is physically separated from the walls of the refrigerant channels by a layer of refrigerant vapor, leading to poor thermal contact and heat transfer between the refrigerant liquid and the refrigerant channels. Reducing film boiling improves the efficiency of heat transfer and the cooling performance of evaporator 24.

In addition, by eliminating (or nearly eliminating) the refrigerant vapor from the refrigerant fluid stream entering evaporator 24, distribution of the liquid refrigerant within the channels of evaporator 24 can be made easier. In certain embodiments, vapor present in the refrigerant channels of evaporator 24 can oppose the flow of liquid refrigerant into the channels. Diverting the vapor phase of the refrigerant fluid before the fluid enters evaporator 24 can help to reduce this difficulty.

In addition to phase separator, or as an alternative to phase separator, in some embodiments the systems disclosed herein can include a phase separator downstream from evaporator 24. Such a configuration can be used when the refrigerant fluid emerging from evaporator is not entirely in the vapor phase, and still includes liquid refrigerant fluid.

VIII. Additional Features of Thermal Management Systems

The foregoing examples of thermal management systems illustrate a number of features that can be included in any of the systems within the scope of this disclosure. In addition, a variety of other features can be present in such systems.

In certain embodiments, refrigerant fluid that is discharged from evaporator 24 and passes through conduit can be directly discharged as exhaust from conduit without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight can be important.

In some embodiments, however, refrigerant fluid vapor can be further processed before it is discharged. Further processing may be desirable depending upon the nature of the refrigerant fluid that is used, as direct discharge of unprocessed refrigerant fluid vapor may be hazardous to humans and/or may be deleterious to mechanical and/or electronic devices in the vicinity of the TMS 10. For example, the unprocessed refrigerant fluid vapor may be flammable or toxic, or may corrode metallic device components. In situations such as these, additional processing of the refrigerant fluid vapor may be desirable.

In general, refrigerant processing apparatus can be implemented in various ways. In some embodiments, refrigerant processing apparatus is a chemical scrubber or water-based scrubber. Within apparatus, the refrigerant fluid is exposed to one or more chemical agents that treat the refrigerant fluid vapor to reduce its deleterious properties. For example, where the refrigerant fluid vapor is basic (e.g., ammonia) or acidic, the refrigerant fluid vapor can be exposed to one or more chemical agents that neutralize the vapor and yield a less basic or acidic product that can be collected for disposal or discharged from apparatus.

As another example, where the refrigerant fluid vapor is highly chemically reactive, the refrigerant fluid vapor can be exposed to one or more chemical agents that oxidize, reduce, or otherwise react with the refrigerant fluid vapor to yield a less reactive product that can be collected for disposal or discharged from apparatus.

In certain embodiments, refrigerant processing apparatus can be implemented as an adsorptive sink for the refrigerant fluid. Apparatus can include, for example, an adsorbent material bed that binds particles of the refrigerant fluid vapor, trapping the refrigerant fluid within apparatus and preventing discharge. The adsorptive process can sequester the refrigerant fluid particles within the adsorbent material bed, which can then be removed from apparatus and sent for disposal.

In some embodiments, where the refrigerant fluid is flammable, refrigerant processing apparatus can be implemented as an incinerator. Incoming refrigerant fluid vapor can be mixed with oxygen or another oxidizing agent and ignited to combust the refrigerant fluid. The combustion products can be discharged from the incinerator or collected (e.g., via an adsorbent material bed) for later disposal.

As an alternative, refrigerant processing apparatus can also be implemented as a combustor of an engine or another mechanical power-generating device. Refrigerant fluid vapor from conduit can be mixed with oxygen, for example, and combusted in a piston-based engine or turbine to perform mechanical work, such as providing drive power for a vehicle or driving a generator to produce electricity. In certain embodiments, the generated electricity can be used to provide electrical operating power for one or more devices, including thermal load 49*b*. For example, thermal load 49*b* can include one or more electronic devices that are powered, at least in part, by electrical energy generated from combustion of refrigerant fluid vapor in refrigerant processing apparatus.

The thermal management systems disclosed herein can optionally include a phase separator upstream from the refrigerant processing apparatus.

Particularly during start-up of the systems disclosed herein, liquid refrigerant may be present in conduits because the systems generally begin operation before high heat load 49*b* and/or heat loads 49*a*, 49*b* are activated. Accordingly, phase separator functions in a manner similar to phase separators to separate liquid refrigerant fluid from refrigerant vapor. The separated liquid refrigerant fluid can be re-directed to another portion of the system, or retained within phase separator until it is converted to refrigerant vapor. By using phase separator, liquid refrigerant fluid can be prevented from entering refrigerant processing apparatus.

IX. Integration with Power Systems

In some embodiments, the refrigeration systems disclosed herein can be combined with power systems to form integrated power and thermal systems, in which certain components of the integrated systems are responsible for providing refrigeration functions and certain components of the integrated systems are responsible for generating operating power.

Figure 18:
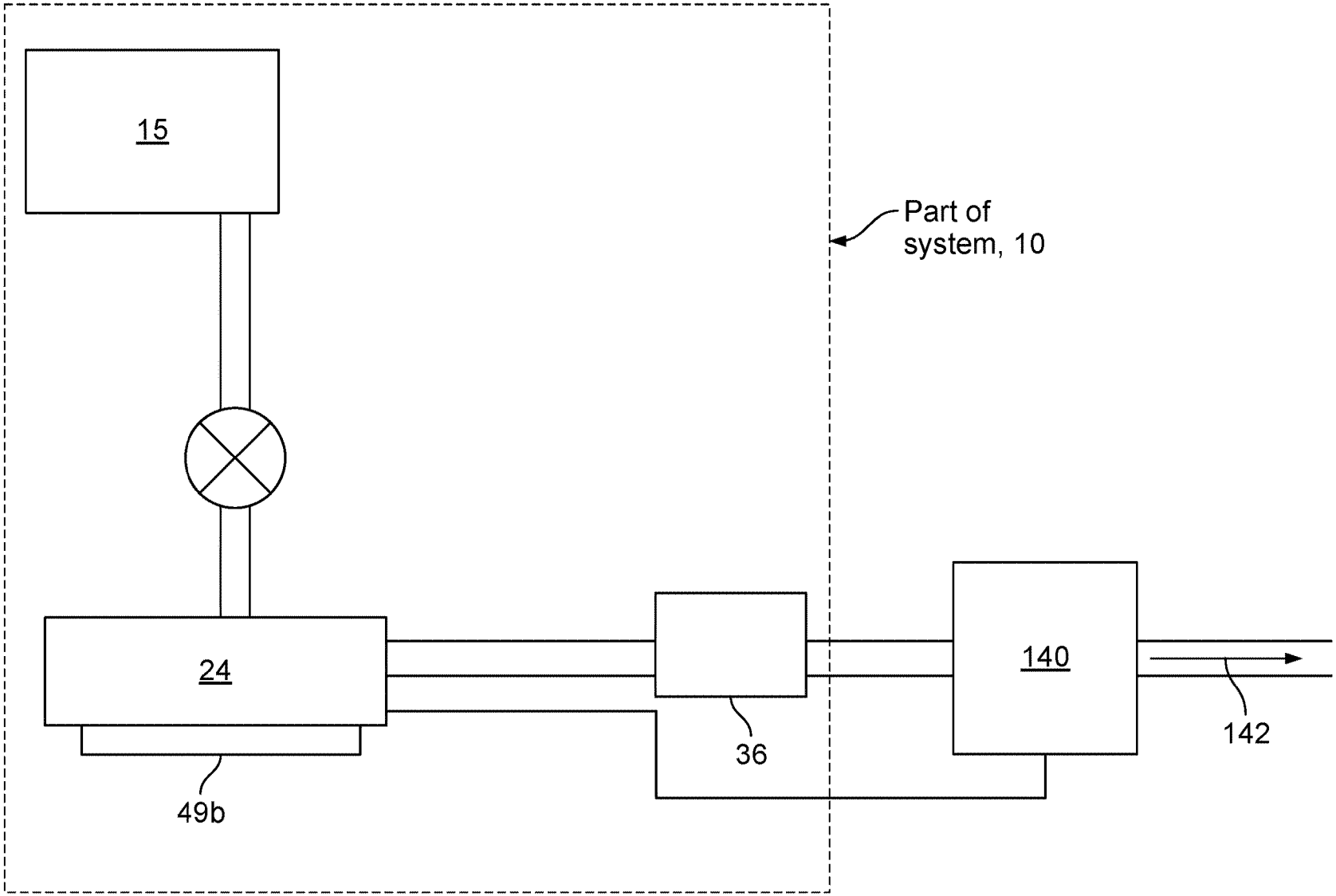
FIG. 18 is a schematic diagram of an example of a thermal management system that includes a power generation apparatus.

FIG. 18 shows an integrated power and TMS 10 that includes many features similar to those discussed above (e.g., see FIG. 1) with only aspects of the OCRS 11" shown. In addition, TMS 10 includes an engine 140 with an inlet that receives the stream of waste refrigerant fluid. Engine 140 can combust the waste refrigerant fluid directly, or alternatively can mix the waste refrigerant fluid with one or more additives (such as oxidizers) before combustion. Where ammonia is used as the refrigerant fluid in system 10, suitable engine configurations for both direct ammonia combustion as fuel, and combustion of ammonia mixed with other additives, can be implemented. In general, combustion of ammonia improves the efficiency of power generation by the engine.

The energy released from combustion of the refrigerant fluid can be used by engine 140 to generate electrical power, e.g., by using the energy to drive a generator. The electrical power can be delivered via electrical connection to thermal load 49*b* to provide operating power for the load. For example, in certain embodiments, thermal load 49*b* includes one or more electrical circuits and/or electronic devices, and engine 140 provides operating power to the circuits/devices via combustion of refrigerant fluid. Byproducts 142 of the combustion process can be discharged from engine 140 via exhaust conduit, as shown in FIG. 18.

Various types of engines and power-generating devices can be implemented as engine 140 in TMS 10. In some embodiments, for example, engine 140 is a conventional four-cycle piston-based engine, and the waste refrigerant fluid is introduced into a combustor of the engine. In certain embodiments, engine 140 is a gas turbine engine, and the waste refrigerant fluid is introduced via the engine inlet to the afterburner of the gas turbine engine.

As discussed above, in some embodiments, TMS 10 can include phase separator (not shown) positioned upstream from engine 140. Phase separator functions to prevent liquid refrigerant fluid from entering engine 140, which may reduce the efficiency of electrical power generation by engine 140.

X. Start-Up and Temporary Operation

In certain embodiments, the thermal management systems disclosed herein operate differently at, and immediately following, system start-up, compared to the manner in which the systems operate after an extended running period. Upon start-up, refrigerant fluid in receiver 15 may be relatively cold, and therefore the receiver pressure ($p_r$) may be lower than a typical receiver pressure during extended operation of the TMS 10. However, if receiver pressure $p_r$ is too low, the system may be unable to maintain a sufficient mass flow rate of refrigerant fluid through evaporator 24 to adequately cool thermal load 49*b*.

As discussed, receiver 15 can optionally include a heater 15*d*. Heater 15*d* can generally be implemented as any of a variety of different conventional heaters, including resistive heaters. In addition, heater 15*d* can correspond to a device or apparatus that transfers some of the enthalpy of the exhaust from engine 140 into receiver 15, or a device or apparatus that transfers enthalpy from any other heat source into receiver 15.

During cold start-up, controller 17 activates heater 15*d* to evaporate portion of the refrigerant fluid in receiver 15 and raise the vapor pressure and pressure $p_r$. This allows the system to deliver refrigerant fluid into evaporator 24 at a sufficient mass flow rate. As the refrigerant fluid in receiver 15 warms up, heater 15*d* can be deactivated by controller 17. By heating refrigerant fluid within receiver 15 at start-up, the system can begin to cool thermal load 49*b* after a relatively short warm-up period.

Controller 17 can also activate heater 15*d* to re-heat refrigerant fluid in receiver 15 between cooling cycles. Thus, for example, when the system runs periodically to provide intermittent cooling of thermal load 49*b*, controller 17 can activate heater 15*d* when the system is not running to ensure that when system operation resumes, the receiver pressure $p_r$ in receiver 15 is sufficient to deliver refrigerant fluid to evaporator 24 at the desired mass flow rate almost immediately. During the system operation the heater typically provides heat input at a reduced rate to maintain an acceptable refrigerant fluid pressure receiver 15. Insulation around receiver 15 can help to reduce heating demands.

XI. Integration with Directed Energy Systems

The thermal management systems and methods disclosed herein can be implemented as part of (or in conjunction with) directed energy systems such as high energy laser systems. Due to their nature, directed energy systems typically present a number of cooling challenges, including certain heat loads for which temperatures are maintained during operation within a relatively narrow range.

Figure 19:
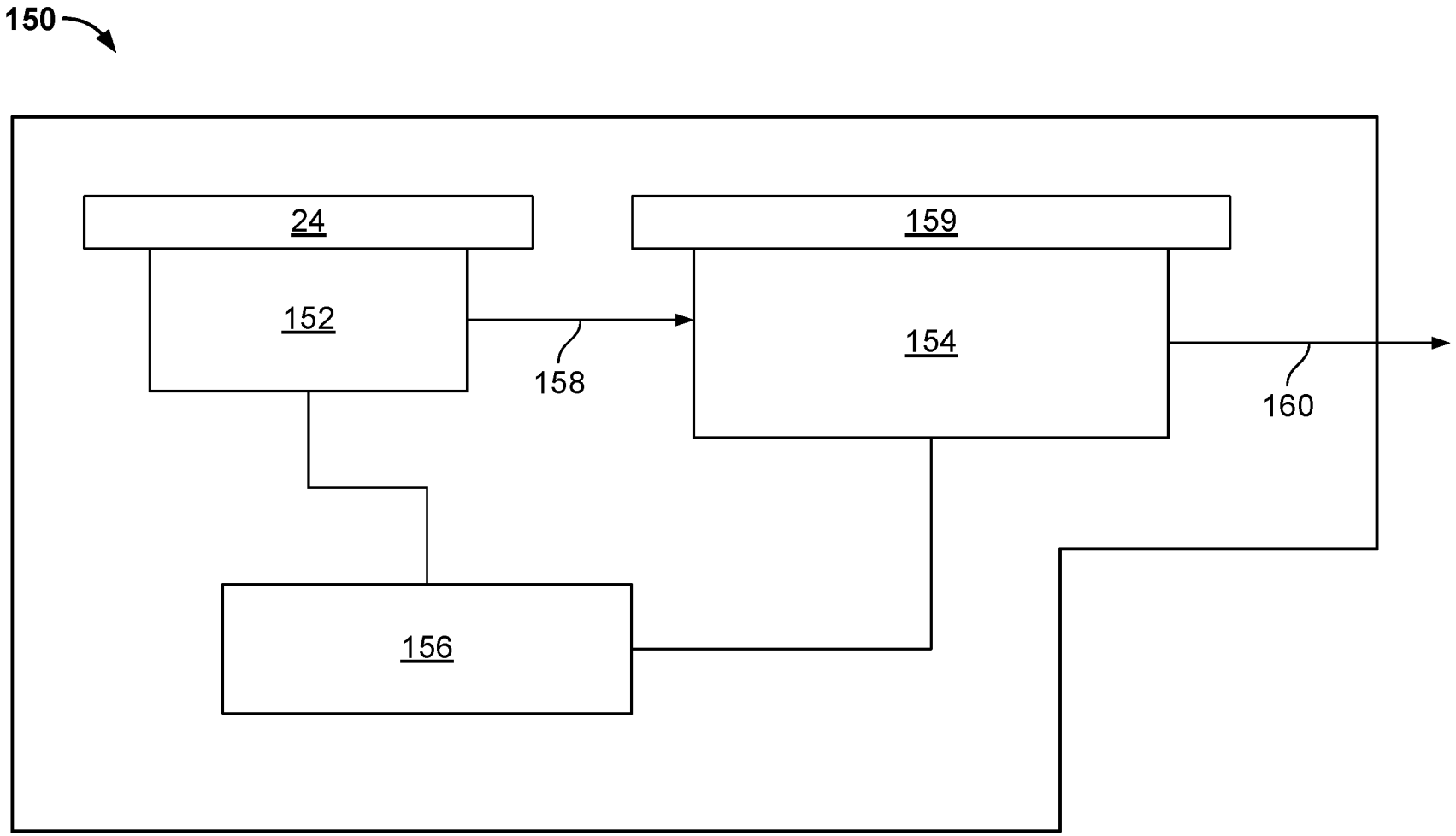
FIG. 19 is a schematic diagram of an example of directed energy system that includes a thermal management system.

FIG. 19 shows one example of a directed energy system, specifically, a high energy laser system 150. System 150 includes a bank of one or more laser diodes 152 and an amplifier 154, both connected to a power source 156. During operation, laser diodes 152 generate an output radiation beam 158 that is amplified by amplifier 154 and directed as output beam 160 onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes.

To regulate the temperatures of various components of directed energy systems such as diodes 152 and amplifier 154, such systems can include components and features of the thermal management systems disclosed herein. In FIG. 19, evaporator 24 is coupled to diodes 152, while in some embodiments of the TMS 10, an optional heat exchanger 159 could be downstream from the evaporator 24 and is in thermal contact with a second load, e.g., the amplifier 154. Heat exchanger 159 includes one or more flow channels through which high vapor quality refrigerant fluid flows after leaving evaporator 24. During operation, as the refrigerant fluid vapor passes through the flow channels, it absorbs heat energy from second thermal load, i.e., the amplifier 154, cooling the amplifier 154. Typically, the amplifier 154 would not be as sensitive as thermal load 152 to fluctuations in temperature. The other components of the thermal management systems disclosed herein are not shown for clarity. However, it should be understood that any of the features and components discussed above can optionally be included in directed energy systems. Diodes 152, due to their temperature-sensitive nature, effectively function as high heat load 49*b* in system 150, while amplifier 154 functions as heat load 49*a*.

System 150 is one example of a directed energy system that can include various features and components of the thermal management systems and methods described herein. However, it should be appreciated that the thermal management systems and methods are general in nature, and can be applied to cool a variety of different heat loads under a wide range of operating conditions.

XII. Hardware and Software Implementations

Controller 17 can generally be implemented as any one of a variety of different electrical or electronic computing or processing devices, and can perform any combination of the various steps discussed above to control various components of the disclosed thermal management systems.

Controller 17 can generally, and optionally, include any one or more of a processor (or multiple processors), a memory, a storage device, and input/output device. Some or all of these components can be interconnected using a system bus. The processor is capable of processing instructions for execution. In some embodiments, the processor is a single-threaded processor. In certain embodiments, the processor is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and the sole processor or one of multiple processors of any kind of computer or computing device.

The memory stores information within the system, and can be a computer-readable medium, such as a volatile or non-volatile memory. The storage device can be capable of providing mass storage for the controller 17. In general, the storage device can include any non-transitory tangible media configured to store computer readable instructions. For example, the storage device can include a computer-readable medium and associated components, including: magnetic disks, such as internal hard disks and removable disks; magneto-optical disks; and optical disks. Storage devices suitable for tangibly embodying computer program instructions and data include all forms of non-volatile memory including by way of example, semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein can be supplemented by, or incorporated in, ASICs (application-specific integrated circuits).

The input/output device provides input/output operations for controller 17, and can include a keyboard and/or pointing device. In some embodiments, the input/output device includes a display unit for displaying graphical user interfaces and system related information.

The features described herein, including components for performing various measurement, monitoring, control, and communication functions, can be implemented in digital electronic circuitry, or in computer hardware, firmware, or in combinations of them. Methods steps can be implemented in a computer program product tangibly embodied in an information carrier, e.g., in a machine-readable storage device, for execution by a programmable processor (e.g., of controller 17), and features can be performed by a programmable processor executing such a program of instructions to perform any of the steps and functions described above. Computer programs suitable for execution by one or more system processors include a set of instructions that can be used directly or indirectly, to cause a processor or other computing device executing the instructions to perform certain activities, including the various steps discussed above.

Computer programs suitable for use with the systems and methods disclosed herein can be written in any form of programming language, including compiled or interpreted languages, and can be deployed in any form, including as stand-alone programs or as modules, components, subroutines, or other units suitable for use in a computing environment.

In addition to one or more processors and/or computing components implemented as part of controller 17, the systems disclosed herein can include additional processors and/or computing components within any of the control device (e.g., control device 18) and any of the sensors discussed above. Processors and/or computing components of the control devices and sensors, and software programs and instructions that are executed by such processors and/or computing components, can generally have any of the features discussed above in connection with controller 17.

OTHER EMBODIMENTS

A number of embodiments have been described. Nevertheless, it will be understood that various modifications may be made without departing from the spirit and scope of the disclosure. Accordingly, other embodiments are within the scope of the following claims.

What is claimed is:

1. A thermal management system, comprising:

a closed cycle refrigeration system comprising a closed-circuit fluid path, the closed cycle refrigeration system comprising:

a receiver configured to store a refrigerant fluid, the receiver comprising an inlet and an outlet;

a condenser fluidly coupled to the receiver and comprising an inlet and an outlet;

a compressor fluidly coupled to the condenser and comprising an inlet and an outlet;

a liquid separator fluidly coupled to the compressor and comprising an inlet, a vapor-side outlet, and a liquid-side outlet; and an evaporator fluidly coupled to the liquid separator and comprising an inlet and an outlet, the evaporator configured to extract heat from a first heat load and a second heat load that are proximate to the evaporator;

a modulation capacity control circuit that modulates cooling capacity of the closed cycle refrigeration system in accordance with a cooling capacity demand on the closed cycle refrigeration system by diverting a portion of refrigerant vapor from the outlet of the compressor away from the inlet of the condenser, the modulation capacity control circuit fluidly coupled to the closed cycle refrigeration system;

an open cycle refrigeration system coupled to the closed cycle refrigeration system, the open cycle refrigeration system comprising an open-circuit fluid path that comprises an exhaust line that includes a fluid outlet that discharges refrigerant vapor to an ambient environment, the refrigerant vapor produced by extraction of the heat from the second heat load; and a pump that pumps liquid refrigerant from the liquid-side outlet of the liquid separator to the evaporator, the pump fluidly coupled to and disposed between the evaporator and the liquid separator, the evaporator fluidly coupled to and disposed between the liquid separator and the pump such that the liquid separator, the pump, and the evaporator form a loop.

2. The system of claim 1, wherein the pump has an inlet that receives refrigerant fluid from the liquid-side outlet and has an outlet that delivers the refrigerant fluid to the inlet of the evaporator.

3. The system of claim 2, wherein the outlet of the pump is coupled to the inlet of the evaporator.

4. The system of claim 1, further comprises:

a junction device comprising a first inlet a second inlet, and an outlet; and an expansion device comprising an inlet coupled to the receiver outlet and comprising an outlet coupled to the first inlet of the junction device.

5. The system of claim 4, wherein the outlet of the junction device is coupled to the inlet of the liquid separator.

6. The system of claim 1, wherein the modulation capacity control circuit comprises:

a first junction device comprising an inlet coupled to the outlet of the compressor, a first outlet coupled to the inlet of the condenser, and a second outlet configured to output the diverted refrigerant vapor;

a second junction device comprising an inlet that receives the diverted refrigerant vapor from the first junction device, a first outlet that outputs a first sub-portion of the diverted refrigerant vapor, and a second outlet that outputs a second sub-portion of the diverted refrigerant vapor;

a head pressure valve comprising a first inlet coupled to the outlet of the condenser, a second inlet that receives the second sub-portion of the diverted refrigerant vapor, and an outlet coupled to the inlet to the receiver; and a bypass valve that has an inlet that receives the first sub-portion of the diverted refrigerant vapor from the second junction device, and the bypass valve further comprising an outlet.

7. The system of claim 6, wherein the modulation capacity control circuit is further configured to selectively divert the first sub-portion of the diverted refrigerant vapor to the inlet of the bypass valve, and to selectively divert the second sub-portion of the diverted refrigerant vapor to the second inlet of the head pressure valve.

8. The system of claim 7, wherein the modulation capacity control circuit further comprises:

a third junction device comprising an inlet that receives the first sub-portion of the diverted refrigerant vapor from the outlet of the bypass valve, a second inlet, and an outlet port;

a mixer device comprising an inlet coupled to the outlet of the third junction device; and a quench valve comprising an inlet coupled to the second inlet of the third junction device.

9. The system of claim 8, further comprising:

an expansion device comprising an inlet coupled to the outlet of the receiver and comprising an outlet.

10. The system of claim 8, further comprising:

a fourth junction device comprising a first inlet, a second inlet, and an outlet, the first inlet receives refrigerant fluid from the receiver, the outlet is coupled to the inlet of the liquid separator, and the second inlet is coupled to the outlet of the evaporator, with the inlet of the evaporator coupled to the outlet of the pump.

11. The system of claim 8, further comprising:

a fourth junction device comprising a first inlet that receives refrigerant fluid from the receiver, a second inlet that receives refrigerant liquid from the liquid-side outlet of the liquid separator, and an outlet coupled to the inlet of the evaporator.

12. The system of claim 11, wherein the evaporator is a first evaporator, the system further comprising:

a second evaporator comprising an inlet and an outlet, with the inlet of the second evaporator coupled to the outlet of the pump and the outlet of the second evaporator coupled to the second inlet of the fourth junction device.

13. The system of claim 10, wherein the inlet and the outlet of the evaporator are a first inlet and a first outlet, the evaporator further comprising a second inlet and a second outlet, with the first inlet of the evaporator coupled to the outlet of the fourth junction device, the first outlet of the evaporator coupled to the inlet of the liquid separator, the second inlet of the evaporator coupled to the outlet of the pump, and the second outlet of the evaporator coupled to the second inlet of the fourth junction device.

14. The system of claim 12, further comprising:

a third evaporator coupled between the liquid-side outlet of the liquid separator and a second exhaust line.

15. The system of claim 14, further comprising:

an expansion device comprising an inlet and an outlet, with the inlet coupled to the liquid-side outlet of the liquid separator.

16. The system of claim 15, further comprising:

a sensor device disposed to sensor a thermodynamic property of refrigerant fluid at the outlet of the third evaporator and to produce a signal that controls operation of the expansion device.

17. The system of claim 6, wherein the modulation capacity control circuit is further configured to selectively divert the first sub-portion of the compressed diverted refrigerant vapor to the inlet of the evaporator, and to selectively divert the second sub-portion of the compressed diverted refrigerant vapor to the second inlet of the head pressure valve.

18. The system of claim 17, further comprising:

a third junction device comprising a first inlet, a second inlet and an outlet, with the first inlet coupled to the outlet of the bypass valve and the outlet coupled to the inlet to the evaporator; and a fourth junction device comprising a first inlet, a second inlet, and an outlet, with the first inlet configured to receive refrigerant fluid from the receiver, the second inlet configured to receive refrigerant fluid from the outlet of the pump, and with the outlet of the fourth junction device coupled to the second inlet of the third junction device.

19. The system of claim 18, wherein the evaporator is a first evaporator, the system further comprising:

a second evaporator comprising an inlet coupled to the outlet of the pump and comprising an outlet coupled to the second inlet of the fourth junction device.

20. The system of claim 18, wherein the inlet and the outlet of the evaporator are a first inlet and a first outlet, the evaporator further comprising a second inlet and a second outlet, wherein the first inlet of the evaporator is coupled to the outlet of the third junction device, the first outlet of the evaporator is coupled to the inlet of the liquid separator, the second inlet of the evaporator is coupled to the outlet of the pump, and the second outlet of the evaporator is coupled to the second inlet of the fourth junction device.

21. The system of claim 19, further comprising:

a third evaporator coupled between the liquid-side outlet of the liquid separator and a second exhaust line.

22. The system of claim 21, further comprising:

an expansion device comprising an inlet coupled to the liquid-side outlet of the liquid separator and comprising an outlet coupled to the inlet of the third evaporator; and a sensor device disposed to sensor a thermodynamic property of refrigerant fluid at the outlet of the third evaporator and to produce a control signal to control operation of the expansion device.

23. The system of claim 1, wherein the refrigerant fluid is ammonia.

24. The system of claim 1, further comprising;

an expansion valve fluidly coupled between an outlet of the receiver and the outlet of the evaporator, with the expansion valve further configured to control a vapor quality of the refrigerant fluid at the outlet of the evaporator during operation of the open cycle refrigeration system.

25. The system of claim 1, wherein one or more control signals cause the system to operate both the closed cycle refrigeration system and the closed cycle refrigeration system.

26. The system of claim 1, further comprising:

a junction device comprising an inlet, a first outlet, and a second outlet, with the inlet coupled to the vapor side outlet of the liquid separator and the first outlet coupled to the compressor inlet; and a back-pressure regulator comprising an inlet and an outlet, with the inlet coupled to the second outlet of the junction device, and the outlet coupled to the exhaust line, with the back pressure regulator configured to regulate pressure at the inlet of the back pressure regulator and to exhaust refrigerant vapor at the exhaust line from the system.

27. The system of claim 1, wherein the inlet of the liquid separator receives a mixed refrigerant fluid flow of refrigerant vapor and refrigerant liquid from the outlet of the evaporator.

28. The system of claim 1, wherein the open cycle refrigeration system, further comprises:

an exhaust line.

29. The system of claim 26, wherein the back-pressure regulator, and the receiver, the evaporator, the liquid separator, and the exhaust line are coupled in the open-circuit fluid path.

30. The system of claim 29, further comprising:

an expansion device comprising an inlet coupled to the receiver outlet and comprising an outlet coupled to the first inlet of the junction device; and wherein the expansion device is configured to control a vapor quality of the refrigerant fluid at the outlet of the evaporator during operation of the open cycle refrigeration system.

31. The system of claim 1, further comprising:

a controller configured to control operation of the closed cycle refrigeration system and the open cycle refrigeration system.

32. The system of claim 1, wherein the second heat load is a high heat load, relative to the first heat load, which high heat load has one or more characteristics of being a high heat flux load or a highly temperature sensitive load or is operative for short periods of time, relative to one or more corresponding characteristics of the first heat load.

33. The system of claim 32, wherein the first heat load has cooling demand that varies over time.

34. The system of claim 32, wherein the first heat load has cooling demand that varies over time relative to the second heat load.

35. A thermal management method, comprises:

transporting a refrigerant fluid from a receiver that stores the refrigerant fluid, through a closed cycle refrigeration system comprising a closed-circuit fluid path that includes the—receiver, an evaporator, a pump, and a liquid separator; and upon receiving a control signal:

transporting the refrigerant fluid from the receiver through an open cycle refrigeration system that comprises an open-circuit fluid path that fluidly couples the receiver, the pump, and the liquid separator to an exhaust line that discharges at least a portion of the refrigerant vapor to an ambient environment;

extracting heat from a first heat load and a second heat load proximate to the evaporator;

modulating cooling capacity of the closed cycle refrigeration system in accordance with a cooling capacity demand on the closed cycle refrigeration system that results at least in part from extraction of the heat from the first heat load; and discharging a portion of the refrigerant vapor from the exhaust line so that the discharged refrigerant vapor is not returned to the refrigerant fluid flow path; and circulating, with the pump, liquid refrigerant from a liquid-side outlet of the liquid separator to the evaporator.

36. The method of claim 35, wherein modulating further comprises:

selectively diverting a portion of refrigerant vapor from an outlet of a compressor away from an inlet of a condenser and to an inlet of the receiver; and maintaining, by a head pressure valve, a head pressure at an outlet of the condenser.

37. The method of claim 36, wherein modulating further comprises:

receiving a first sub-portion of the diverted refrigerant vapor at an inlet of a bypass valve; and receiving condensed refrigerant from the condenser at an inlet of the head pressure valve and a second sub-portion of the diverted refrigerant vapor at a second inlet of the head pressure valve.

38. The method of claim 37, further comprises:

receiving the control signal by a back-pressure regulator that is coupled to the exhaust line to control discharge of the refrigerant vapor, such that the discharged refrigerant vapor is not returned to the receiver.

39. A thermal management system, comprising:

a receiver configured to store a refrigerant fluid, the receiver comprising an inlet and an outlet;

a condenser comprising an inlet and an outlet;

a compressor comprising an inlet and an outlet;

a liquid separator having an inlet, a vapor-side outlet, and a liquid-side outlet;

an evaporator comprising an inlet and an outlet, the evaporator configured to extract heat from a first heat load and a second heat load that are proximate to the evaporator;

a closed-circuit refrigeration system comprising a closed-circuit fluid path including the condenser, the compressor, the receiver, the liquid separator, and the evaporator;

a modulation capacity control circuit configured to modulate cooling capacity of the closed-circuit refrigeration system in accordance with a cooling capacity demand on the closed-circuit refrigeration system that results at least in part from extraction of the heat from the first heat load, by diverting a portion of refrigerant vapor from the outlet of the compressor away from the inlet of the condenser;

an open-circuit refrigeration system comprising an open-circuit fluid path with the receiver and the evaporator, with the open circuit refrigeration system configured to discharge refrigerant vapor produced by extraction of the heat from the second heat load such that the discharged refrigerant vapor is not returned to the receiver;

a pump disposed in a refrigerant fluid loop with the evaporator and the liquid separator, the pump configured to pump liquid refrigerant from the liquid-side outlet of the liquid separator;

a junction device comprising a first inlet, a second inlet, and an outlet; and an expansion valve comprising an inlet coupled to the receiver outlet and an outlet coupled to the first inlet of the junction device.

* * * * *